US008084173B2

(12) United States Patent
Yu et al.

(10) Patent No.: US 8,084,173 B2
(45) **Date of Patent: *Dec. 27, 2011**

(54) LOW FRICTION ELECTROSTATOGRAPHIC IMAGING MEMBER

(75) Inventors: Robert C. U. Yu, Webster, NY (US); Stephen T. Avery, Rochester, NY (US); Kent J. Evans, Lima, NY (US)

(73) Assignee: Xerox Corporation, Norwalk, CT (US)

( * ) Notice: Subject to any disclaimer, the term of this patent is extended or adjusted under 35 U.S.C. 154(b) by 565 days.

This patent is subject to a terminal disclaimer.

(21) Appl. No.: 12/099,089

(22) Filed: Apr. 7, 2008

(65) Prior Publication Data

US 2009/0253063 A1 Oct. 8, 2009

(51) Int. Cl.
*G03G 5/10* (2006.01)

(52) U.S. Cl. ..... 430/69

(58) Field of Classification Search ..... 399/159; 430/69

See application file for complete search history.

(56) References Cited

U.S. PATENT DOCUMENTS

| | | | | |
|---|---|---|---|---|
| 3,121,006 | A | 2/1964 | Middleton et al. | |
| 3,820,989 | A | 6/1974 | Rule et al. | |
| 3,837,851 | A | 9/1974 | Shattuck et al. | |
| 3,895,944 | A | 7/1975 | Wiedemann et al. | |
| 4,150,987 | A | 4/1979 | Anderson et al. | |
| 4,245,021 | A | 1/1981 | Kazami et al. | |
| 4,256,821 | A | 3/1981 | Enomoto et al. | |
| 4,265,990 | A | 5/1981 | Stolka et al. | |
| 4,278,746 | A | 7/1981 | Goto et al. | |
| 4,286,033 | A | 8/1981 | Neyhart et al. | |
| 4,291,110 | A | 9/1981 | Lee | |
| 4,297,426 | A | 10/1981 | Sakai et al. | |
| 4,315,982 | A | 2/1982 | Ishikawa et al. | |
| 4,338,387 | A | 7/1982 | Hewitt | |
| 4,338,388 | A | 7/1982 | Sakai et al. | |
| 4,385,106 | A | 5/1983 | Sakai | |
| 4,387,147 | A | 6/1983 | Sakai | |
| 4,399,207 | A | 8/1983 | Sakai et al. | |
| 4,399,208 | A | 8/1983 | Takasu et al. | |
| 4,587,189 | A | 5/1986 | Hor et al. | |
| 4,654,284 | A | 3/1987 | Yu et al. | |
| 4,664,995 | A | 5/1987 | Horgan et al. | |
| 4,988,597 | A | 1/1991 | Spiewak et al. | |
| 5,021,309 | A | 6/1991 | Yu | |
| 5,069,993 | A | 12/1991 | Robinette et al. | |
| 5,244,762 | A | 9/1993 | Spiewak et al. | |
| 5,725,983 | A * | 3/1998 | Yu | 430/58.05 |
| 5,756,245 | A | 5/1998 | Esteghamatian et al. | |
| 5,919,590 | A | 7/1999 | Yu et al. | |
| 5,935,748 | A * | 8/1999 | Yu et al. | 430/69 |
| 6,124,514 | A | 9/2000 | Emmrich et al. | |
| 6,214,514 | B1 | 4/2001 | Evans et al. | |
| 6,528,226 | B1 | 3/2003 | Yu et al. | |
| 6,756,169 | B2 | 6/2004 | Lin et al. | |
| 6,933,089 | B2 | 8/2005 | Horgan et al. | |
| 7,018,756 | B2 | 3/2006 | Pai et al. | |
| 7,422,831 | B2 * | 9/2008 | Yu | 430/69 |
| 7,455,941 | B2 * | 11/2008 | Evans et al. | 430/69 |
| 7,462,434 | B2 * | 12/2008 | Yu et al. | 430/69 |
| 7,504,187 | B2 * | 3/2009 | Yu et al. | 430/69 |
| 7,527,906 | B2 * | 5/2009 | Yu et al. | 430/69 |
| 2007/0059622 | A1 * | 3/2007 | Yu et al. | 430/66 |
| 2007/0059623 | A1 * | 3/2007 | Yu | 430/69 |
| 2007/0072101 | A1 * | 3/2007 | Dinh et al. | 430/66 |
| 2007/0141487 | A1 * | 6/2007 | Yu et al. | 430/56 |
| 2007/0292797 | A1 * | 12/2007 | Yu et al. | 430/69 |
| 2008/0020312 | A1 * | 1/2008 | Wu et al. | 430/69 |

OTHER PUBLICATIONS

USPTO Trademark Electronic Search System (TESS) file for trademark LEXAN, Serial No. 72003291, registration date Nov. 13, 1956, printed on Oct. 30, 2010.*

* cited by examiner

*Primary Examiner* — Janis L Dote

(74) *Attorney, Agent, or Firm* — Pillsbury Winthrop Shaw Pittman LLP

(57) ABSTRACT

Present embodiments pertain to an improved electrostatographic imaging member having low contact friction surfaces to ease sliding mechanical interaction and suppressing abrasion/wear failure and methods of preparing thereof. The improved imaging member has layers comprising one or two low surface energy polymeric materials that enhance the physical and mechanical functions and reduce the layers surface contact friction of the imaging member to extend service life.

19 Claims, 2 Drawing Sheets

LOW FRICTION ELECTROSTATOGRAPHIC IMAGING MEMBER

CROSS REFERENCE TO RELATED APPLICATION

Reference is made to copending, commonly assigned U.S. patent application Ser. No. 12/099,097 to Yu et al., filed Apr. 7, 2008, entitled, "Low Friction Electrostatographic Imaging Member", copending, commonly assigned U.S. patent application Ser. No. 12/099,045 to Yu et al., filed Apr. 7, 2008, entitled, "Low Friction Electrostatographic Imaging Member", copending, commonly assigned U.S. patent application Ser. No. 12/099,083 to Yu et al., filed Apr. 7, 2008, entitled, "Low Friction Electrostatographic Imaging Member", copending, commonly assigned U.S. patent application Ser No. 12/099,073 to Yu et al., filed Apr. 7, 2008, entitled, "Low Friction Electrostatographic Imaging Member", and copending, commonly assigned U.S. patent application Ser. No. 12/099,063 to Yu et al., filed Apr. 7, 2008, entitled, "Low Friction Electrostatographic Imaging Member".

BACKGROUND

The present embodiments are directed to an imaging member used in electrostatography and a process for making and using the member. More particularly, the embodiments pertain to the preparation of an improved electrostatographic imaging member having low contact friction surfaces to ease sliding mechanical interaction and suppressing abrasion/wear failure. The improved imaging member has a slippery imaging layer, an additional low surface energy protective overcoat layer, and/or a reduced contact friction anti-curl back coating, each of which comprise one or two low surface energy polymeric materials that enhance the physical and mechanical functions of the imaging member to impart service life extension.

In electrostatographic reproducing apparatuses, including digital, image on image, and contact electrostatic printing apparatuses, a light image of an original to be copied is typically recorded in the form of an electrostatic latent image upon a photosensitive member and the latent image is subsequently rendered visible by the application of electroscopic thermoplastic resin particles and pigment particles, or toner. Electrostatographic imaging members are well known in the art. Typical electrostatographic imaging members include, for example: (1) electrophotographic imaging member (photoreceptors) commonly utilized in electrophotographic (xerographic) processing systems; (2) electroreceptors such as ionographic imaging member belts for electrographic imaging systems; and (3) intermediate toner image transfer members such as an intermediate toner image transferring member which is used to remove the toner images from a photoreceptor surface and subsequently transfer these images onto a receiving paper.

Although the scope of the present disclosure covers the preparation of all types of electrostatographic imaging members in either a rigid drum design or a flexible belt configuration, for reasons of simplicity, the embodiments and discussion following hereinafter will be focused solely on and represented by electrophotographic imaging members in the flexible belt configuration. Electrophotographic flexible belt imaging members may include a photoconductive layer including a single layer or composite layers. The flexible belt electrophotographic imaging members may be seamless or seamed belts. The seamed belts are usually formed by cutting a rectangular sheet from a web, overlapping opposite ends, and welding the overlapped ends together to form a welded seam. Typical flexible electrophotographic imaging member belts include a charge transport layer and a charge generating layer on one side of a supporting substrate layer and an anti-curl back coating coated onto the opposite side of the substrate layer. By comparison, a typical flexible electrographic imaging member belt has a more simple material structure, and it includes a dielectric imaging layer on one side of a flexible supporting substrate and an anti-curl back coating on the opposite side of the substrate to render flatness. Since typical negatively-charged flexible electrophotographic imaging members exhibit undesirable upward imaging member curling after completion of coating the top outermost charge transport layer, an anti-curl back coating, applied to the backside, is required to balance the curl. Thus, the application of an anti-curl back coating is desirable to provide the appropriate imaging member with desirable flatness.

One type of composite photoconductive layer used in xerography is illustrated in U.S. Pat. No. 4,265,990 which describes a negatively-charged photosensitive member having at least two electrically operative layers. One layer comprises a photoconductive layer which is capable of photogenerating holes and injecting the photogenerated holes into a contiguous charge transport layer. Generally, where the two electrically operative layers are supported on a conductive layer, the photoconductive layer is sandwiched between a contiguous charge transport layer and the supporting conductive layer. Alternatively, the charge transport layer of a positively-charged imaging member is sandwiched between the supporting electrode and a photoconductive layer. Photosensitive members having at least two electrically operative layers, as disclosed above, provide excellent electrostatic latent images when charged in the dark with a uniform negative electrostatic charge, exposed to a light image and thereafter developed with finely divided electroscopic marking particles. The resulting toner image is usually transferred to a suitable receiving member such as paper or to an intermediate transfer member which thereafter transfers the image to a receiving member such as paper.

In the case where the charge generating layer (CGL) is sandwiched between the outermost exposed charge transport layer (CTL) and the electrically conducting layer, the outer surface of the CTL is charged negatively and the conductive layer is charged positively. The CGL then should be capable of generating electron hole pair when exposed image wise and inject only the holes through the CTL. In the alternate case when the CTL is sandwiched between the CGL and the conductive layer, the outer surface of Gen layer is charged positively while conductive layer is charged negatively and the holes are injected through from the CGL to the CTL. The CTL should be able to transport the holes with as little trapping of charge as possible. In a typical flexible imaging member web like photoreceptor, the charge conductive layer may be a thin coating of metal on a flexible substrate support layer.

In either positively charged flexible imaging member belts or negatively charged flexible imaging member belts, an anti-curl back coating is usually used to counteract imaging member curling and maintain imaging member belt flatness.

As more advanced, higher speed electrophotographic copiers, duplicators and printers were developed, however, degradation of image quality was encountered during extended cycling. The complex, highly sophisticated duplicating and printing systems operating at very high speeds have placed stringent requirements, including narrow operating limits on photoreceptors. For example, the numerous layers used in many modern photoconductive imaging members must be highly flexible, adhere well to adjacent layers, and exhibit predictable electrical characteristics within narrow operating limits to provide excellent toner images over many thousands of cycles. One type of negatively charged multilayered photoreceptor that has been employed as a belt in electrophotographic imaging systems comprises a substrate, a conductive layer, an optional blocking layer, an optional adhesive layer, a CGL, an outermost exposed CTL and a conductive ground strip layer adjacent to one edge of the imaging layers, and an optional overcoat layer adjacent to another edge of the imaging layers. Such a photoreceptor usually further comprises an anti-curl back coating (ACBC) on the side of the substrate opposite the side carrying the conductive layer, support layer, blocking layer, adhesive layer, charge generating layer, CTL and other layers. The CTL is usually the last layer to be coated to become the outermost exposed layer and is applied by solution coating then followed by drying the wet applied coating at elevated temperatures of about 115° C., and finally cooling it down to ambient room temperature of about 25° C. When a production web stock of several thousand feet of coated multilayered photoreceptor material is obtained after finishing the CTL coating through drying/cooling process, upward curling of the multilayered photoreceptor is observed.

This upward curling is a consequence of thermal contraction mismatch between the CTL and the substrate support. Since the CTL in a typical photoreceptor device has a coefficient of thermal contraction approximately 3.7 times greater than that of the flexible substrate support, the CTL exhibits a larger dimensional shrinkage than that of the substrate support as the imaging member web stock (after through elevated temperature heating/drying process) as it cools down to ambient room temperature. The exhibition of upward imaging member curling after completion of CTL coating is due to the consequence of the heating/cooling processing, according to the mechanism: (1) as the web stock carrying the wet applied CTL is dried at elevated temperature, dimensional contraction does occur when the wet CTL coating is losing its solvent during 115° C. elevated temperature drying, because the CTL at 115° C. still remains as a viscous liquid after losing its solvent. Since its glass transition temperature (Tg) is about 85° C., the CTL will flow to automatically re-adjust itself to compensate the losing of solvent and maintain its dimension; (2) as the CTL in a viscous liquid state is cooling down further and reaching its Tg at 85° C., the CTL instantaneously solidifies and adheres to the CGL because it has transformed itself from being a viscous liquid into a solid layer at its Tg; and (3) cooling down the solidified CTL of the imaging member web from 85° C. down to 25° C. room ambient will then cause the CTL to contract more than the substrate support since it has an approximately 3.7 times greater thermal coefficient of dimensional contraction than that of the substrate support. This dimensional contraction mis-match between these two coating layers results in tension strain built-up in the CTL, at this instant, is pulling the imaging member upward to exhibit curling. If unrestrained at this point, the imaging member web stock will spontaneously curl upwardly into a 1.5-inch tube. To offset the curling effect, an ACBC is applied to the backside of the flexible substrate support, opposite to the side carrying the photo electrically active CTL/CGL, and render the imaging member web stock with desired flatness.

Curling of a photoreceptor web is undesirable because it hinders fabrication of the web into cut sheets and subsequent welding into a belt. An ACBC, having a counter curling effect to balance the applied photo electrically active layers, is applied to the opposite or back side of the support substrate to maintain the overall photoreceptor flatness by offsetting the curl effect which is arisen from the mismatch of the thermal contraction coefficient between the substrate and the CTL, resulting in greater CTL dimensional shrinkage than that of the substrate. However, common ACBC formulations do not always provide satisfying dynamic photoreceptor belt performance result under a normal machine functioning condition. For example, exhibition of ACBC wear and its propensity to cause tribo-electrical charging up are frequently seen problems that prematurely cut short the service life of a belt and requires frequent costly replacement in the field. ACBC wear reduces the thickness and thereby diminishes its anti-curling capacity. Moreover, ACBC tribo-electrical charge up against belt support module rollers and backer bars is very problematic since it increases the torque for effective belt drive to the point (in some occasions) causing total belt stalling under the dynamic belt cycling machine operation condition.

Other layers of the imaging member, for example the top outermost exposed CTL in a negatively charge imaging member, also suffer from the machine operational conditions, such as exposure to high surface friction and extensive cycling. Such harsh conditions lead to abrasion, wearing away, and susceptibility of surface scratching of the CTL which otherwise adversely affect machine performance. Another imaging member functional problem associated with the CTL is its propensity to give rise to early development of surface filming due its high surface energy. CTL surface filming is undesirable because it pre-maturely causes degradation of copy printout quality. Moreover, the outermost exposed CTL has also been found to exhibit early onset of surface cracking, as consequence of repetition of bending stress belt cyclic fatiguing, airborne chemical species exposure, and direct solvent contact, under a normal machine belt functioning condition. CTL cracking is a serious mechanical failure since the cracks manifest themselves as defects in print-out copies. All these imaging member layers failures remain to be resolved.

In U.S. Pat. No. 5,069,993, which is hereby incorporated by reference in its entirety, an exposed layer in an electrophotographic imaging member is provided with increase resistance to stress cracking and reduced coefficient of surface friction, without adverse effects on optical clarity and electrical performance. The layer contains a polymethylsiloxane copolymer and an inactive film forming resin binder. Various specific film forming resins for the anti-curl layer and adhesion promoters are disclosed.

U.S. Pat. No. 5,021,309, which is hereby incorporated by reference in its entirety, shows an electrophotographic imaging device, with material for an exposed anti-curl layer has organic fillers dispersed therein. The fillers provide coefficient of surface contact friction reduction, increased wear resistance, and improved adhesion of the anti-curl layer, without adversely affecting the optical and mechanical properties of the imaging member.

U.S. Pat. No. 5,919,590, which is hereby incorporated by reference in its entirety, shows an electrostatographic imaging member comprising a supporting substrate having an electrically conductive layer, at least one imaging layer, an anti-curl layer, an optional ground strip layer and an optional overcoat layer, the anti-curl layer including a film forming polycarbonate binder, an optional adhesion promoter, and optional dispersed particles selected from the group consisting of inorganic particles, organic particles, and mixtures thereof.

In U.S. Pat. No. 4,654,284, which is hereby incorporated by reference in its entirety, an electrophotographic imaging member is disclosed comprising a flexible support substrate layer having an anti-curl layer, the anti-curl layer comprising a film forming binder, crystalline particles dispersed in the film forming binder and a reaction product of a bifunctional chemical coupling agent with both the binder and the crystalline particles. The use of VITEL PE 100 in the anti-curl layer is described.

In U.S. Pat. No. 6,528,226, which is hereby incorporated by reference in its entirety, a process for preparing an imaging member is disclosed that includes applying an organic layer to an imaging member substrate, treating the organic layer and/or a backside of the substrate with a corona discharge effluent, and applying an overcoat layer to the organic layer and/or an anti-curl back coating to the backside of the substrate.

The above disclosures show that, while attempts to resolve charge transport layer and anti-curl back coating problems have been made, those solutions do not address all the additional problems that arise. Therefore, there is a need to provide improved imaging members that have mechanically robust outer layers to effect service life extension but without causing the introduction of other undesirable problems.

To resolve these physical/mechanical associated problems and effect the imaging member service life extension, the present embodiments provide: (1) slippery CTL formulation, (2) addition of an low surface energy overcoating layer and (3) a low friction ACBC design. The improved imaging member of this disclosure, as described and detailed in the embodiments presented hereinafter, addresses the shortcomings of traditional imaging layers discussed above and specific improvements to provide physical/mechanical robust functions to the imaging member.

SUMMARY

According to aspects illustrated herein, there is provided an electrophotographic imaging member comprising a flexible substrate with a conducting layer; at least one imaging layer positioned on a first side of the substrate; an anticurl back coating positioned on a second side of the substrate opposite to the at least one imaging layer, wherein the anticurl back coating has at least one layer and a thickness of from about 5 to about 80 microns and further comprises a low surface energy modified polycarbonate polymer having a molecular weight of between about 20,000 and about 200,000, the polymer being formed and selected from the group consisting of modified Bisphenol A polycarbonate of poly(4,4'-isopropylidene diphenyl carbonate) having a small fraction of polydimethyl siloxane in the polymer back bone and having the following formula (I):

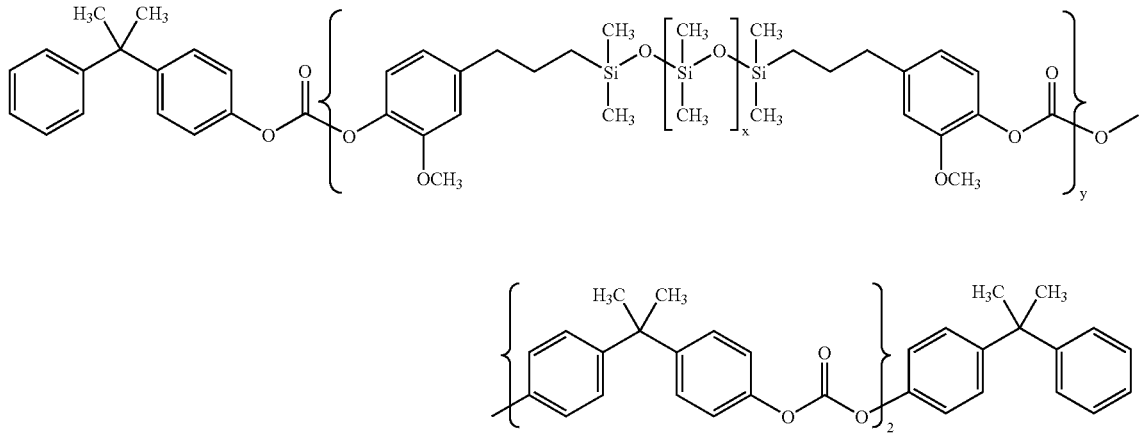

wherein x is an integer between about 40 and about 50 while y and z are integers representing a number of the respective repeating units, a modified Bisphenol Z polycarbonate of poly(4,4'-diphenyl-1,1'-cyclohexane carbonate) having a small fraction of polydimethyl siloxane in the polymer back bone and having the following formula (II):

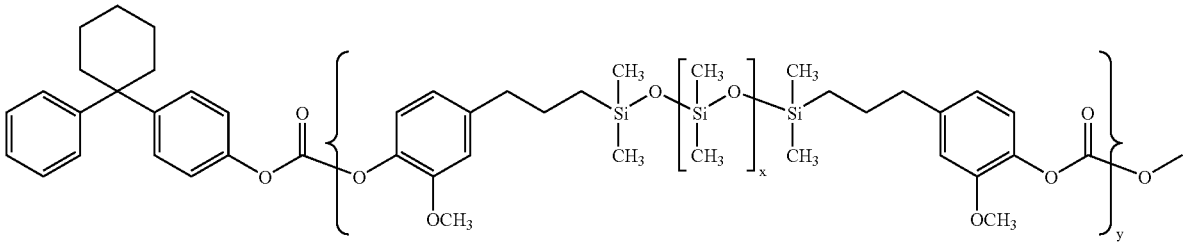

-continued

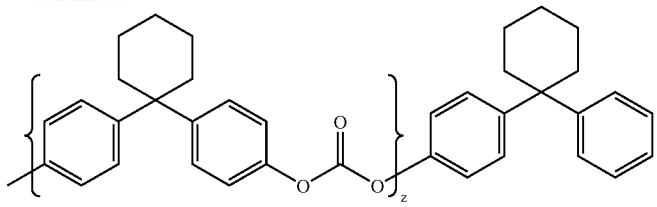

wherein x is an integer between about 40 and about 50 while y and z are integers representing a number of the respective repeating units, a modified Bisphenol C polycarbonate derived from the modification of poly(4,4'-isopropylidene diphenyl carbonate) having a small fraction of polydimethyl siloxane in the polymer back bone and having the following formula (III):

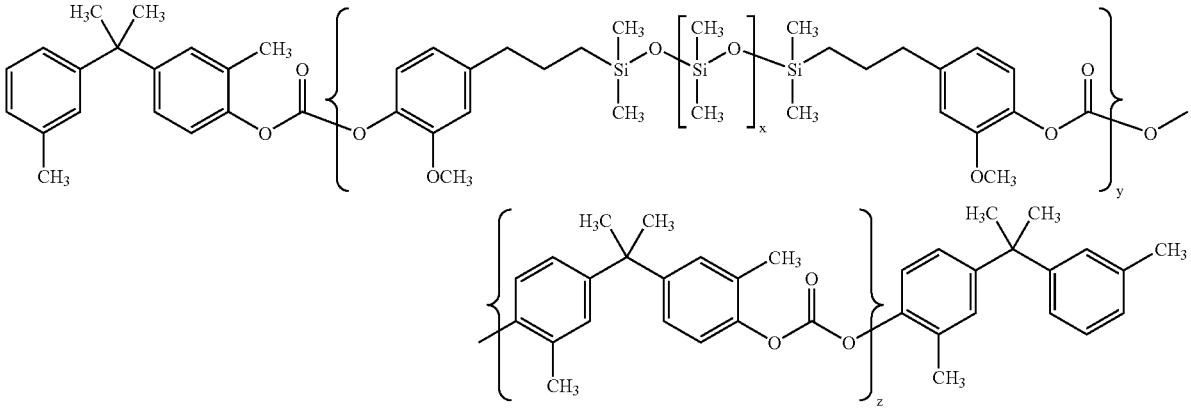

wherein x is an integer between about 40 and about 50 while y and z are integers representing a number of the respective repeating units, a modification of the modified Bisphenol Z polycarbonate of poly(4,4'-diphenyl-1,1'-cyclohexane carbonate) having a small fraction of polydimethyl siloxane in the polymer back bone and having the following formula (IV):

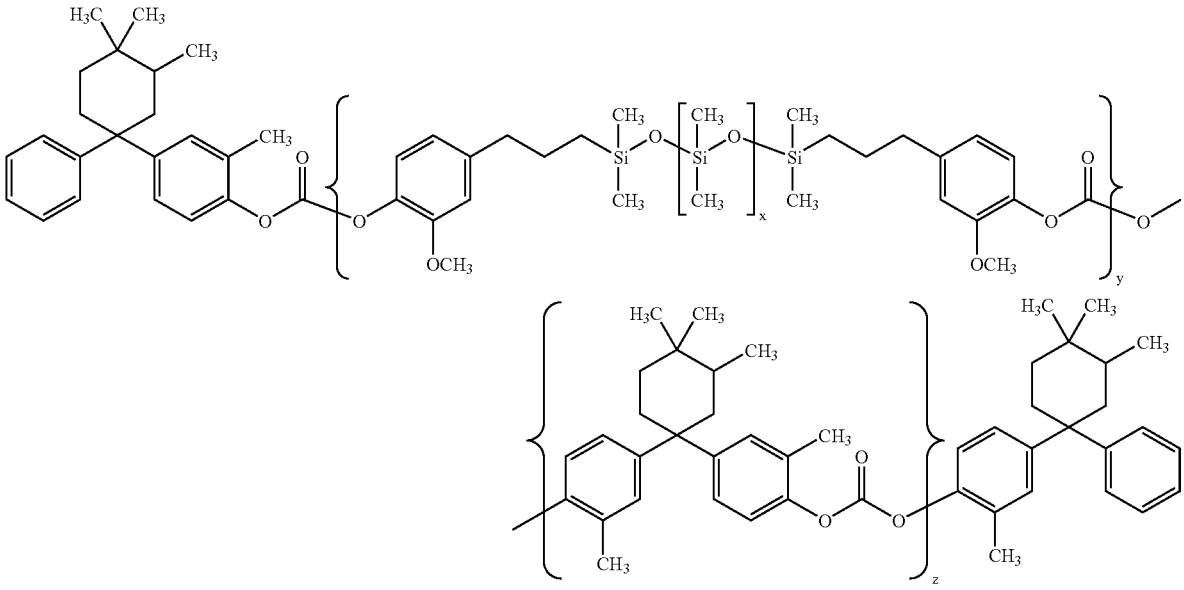

wherein x is an integer between about 40 and about 50 while y and z are integers representing a number of the respective repeating units, and mixtures thereof, and an adhesion promoter; and an optional overcoat layer on the at least one imaging layer.

An embodiment further embodiment provides an electrophotographic imaging member comprising: a flexible substrate with a conducting layer; at least one imaging layer positioned on a first side of the substrate; an anticurl back coating positioned on a second side of the substrate opposite to the at least one imaging layer, wherein the anticurl back coating has at least one layer and a thickness of from about 5 to about 80 microns and further comprises a low surface energy modified polycarbonate polymer having a molecular weight of between about 20,000 and about 200,000, the polymer being formed and selected from the group consisting of modified Bisphenol A polycarbonate of poly(4,4'-isopropylidene diphenyl carbonate) having a small fraction of polydimethyl siloxane in the polymer back bone and having the following formula (I):

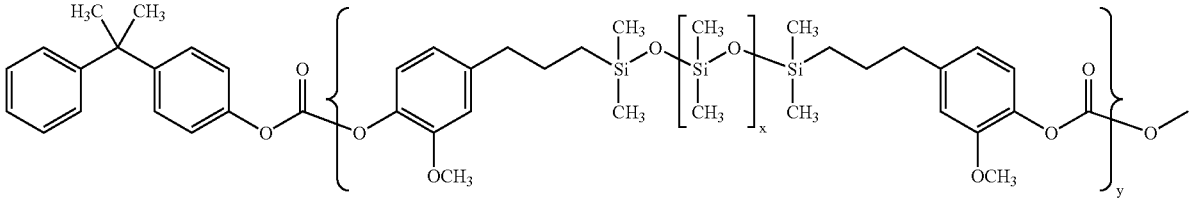

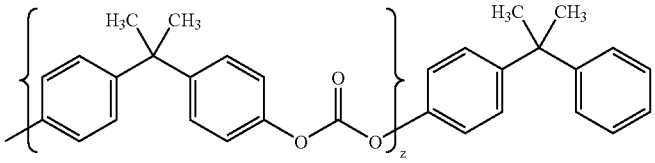

wherein x is an integer between about 40 and about 50 while y and z are integers representing a number of the respective repeating units, a modified Bisphenol Z polycarbonate of poly(4,4'-diphenyl-1,1'-cyclohexane carbonate) having a small fraction of polydimethyl siloxane in the polymer back bone and having the following formula (II):

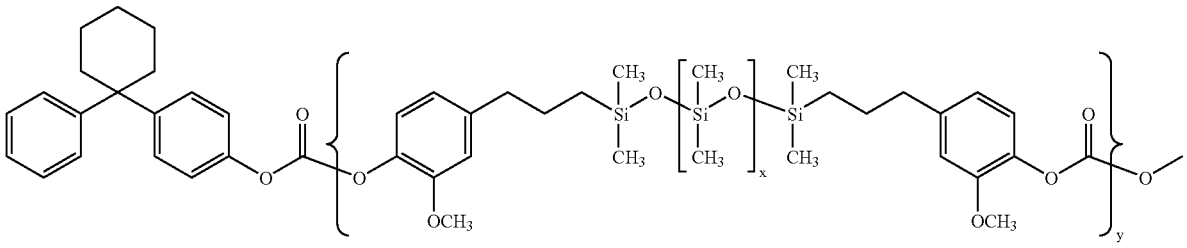

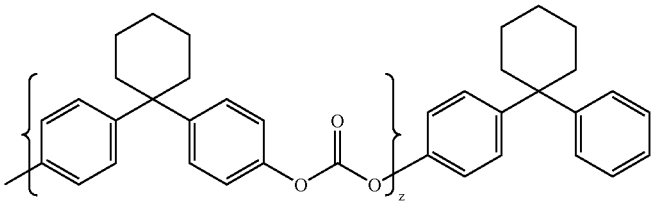

wherein x is an integer between about 40 and about 50 while y and z are integers representing a number of the respective repeating units, a modified Bisphenol C polycarbonate derived from the modification of poly(4,4'-isopropylidene diphenyl carbonate) having a small fraction of polydimethyl siloxane in the polymer back bone and having the following formula (III):

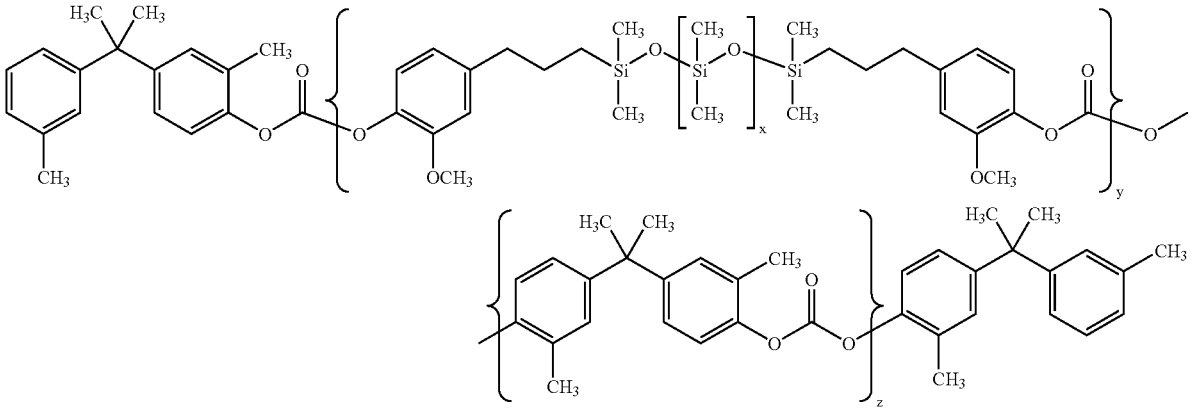

wherein x is an integer between about 40 and about 50 while y and z are integers representing a number of the respective repeating units, a modification of the modified Bisphenol Z polycarbonate of poly(4,4'-diphenyl-1,1'-cyclohexane carbonate) having a small fraction of polydimethyl siloxane in the polymer back bone and having the following formula (IV):

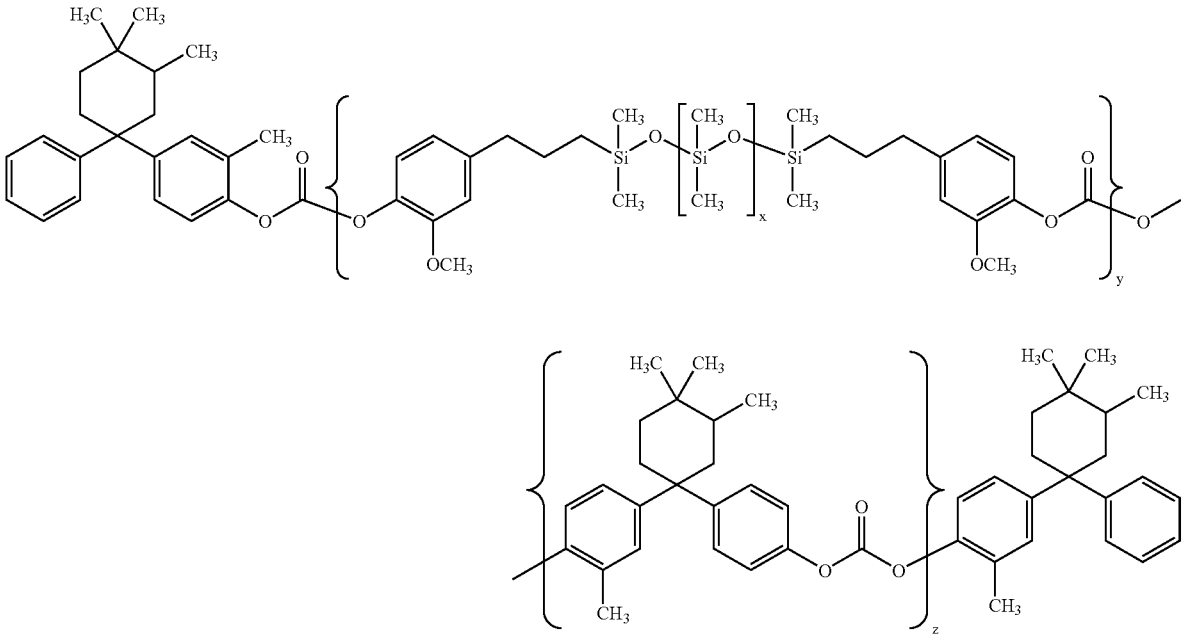

wherein x is an integer between about 40 and about 50 while y and z are integers representing a number of the respective repeating units, and mixtures thereof, an adhesion promoter, and a second low surface energy polymer having a molecular weight of between about 20,000 and about 200,000 and a formula selected from the group consisting of formula (V):

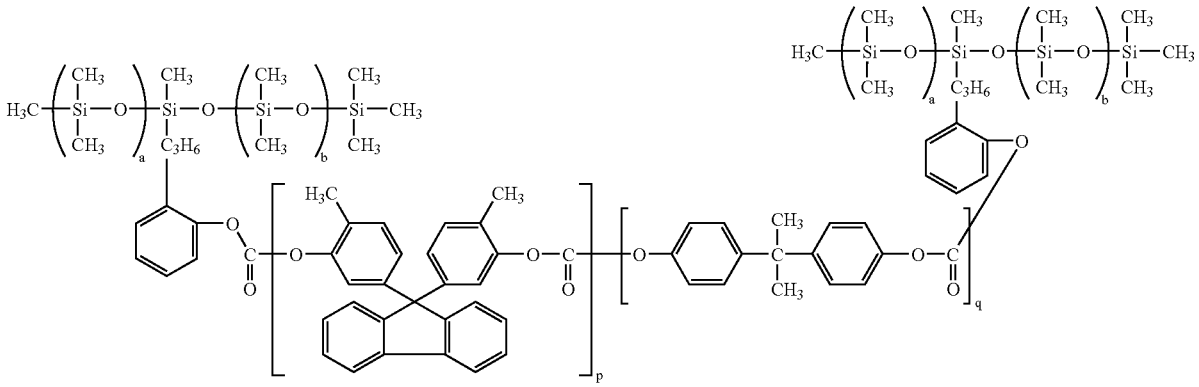
wherein a, b, p and q are integers representing a number of repeating units; formula (VI):
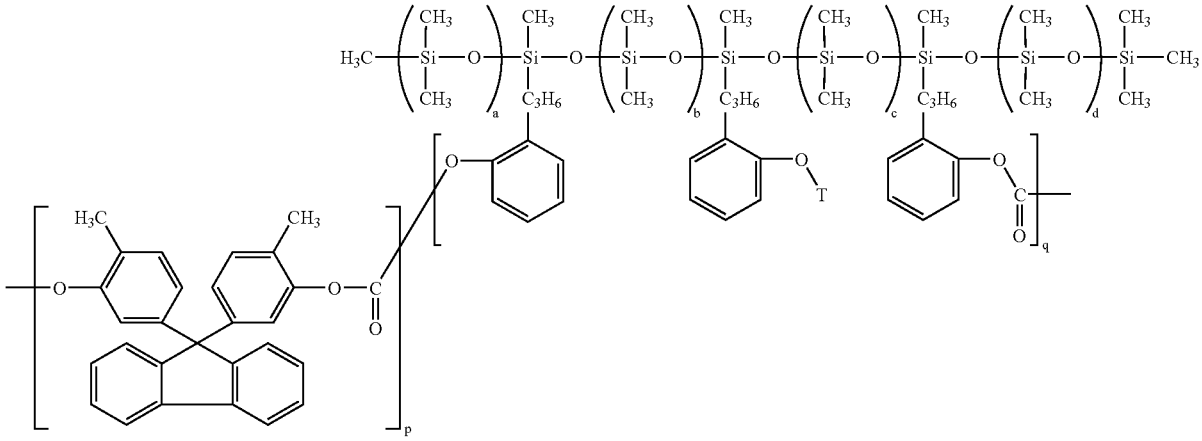
wherein a, b, c, d, p and q are integers representing a number of repeating units; formula (VII):
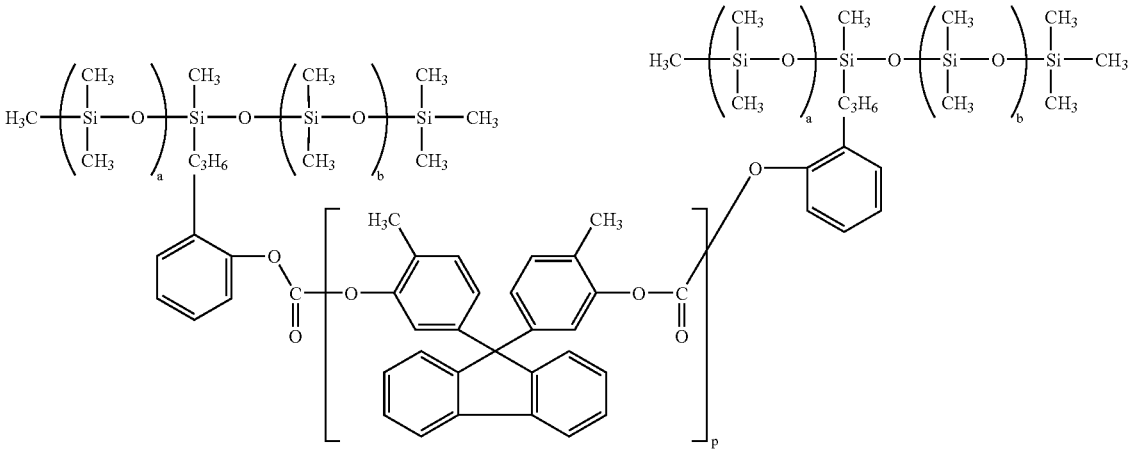
wherein a, b and p are integers representing the number of repeating units; formula (VIII):

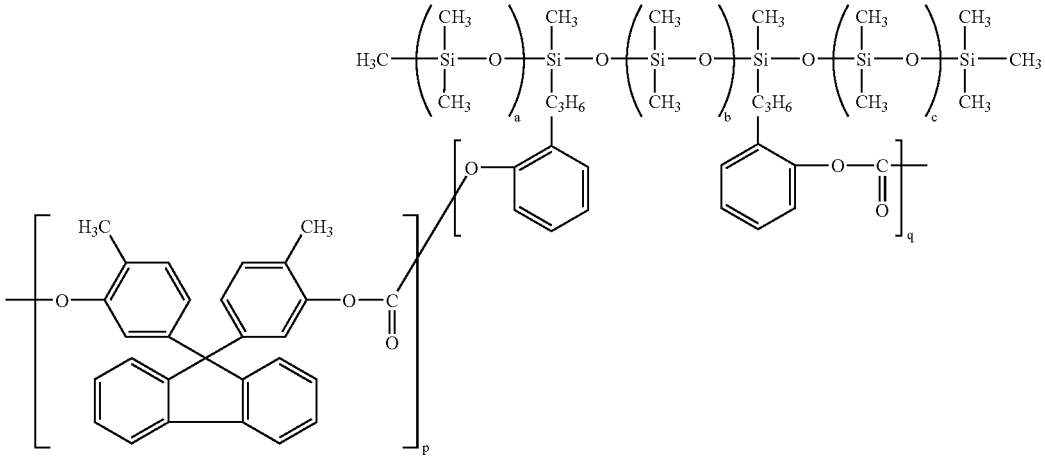
wherein a, b, c, p and q are integers representing the number of repeating units; formula (IX):
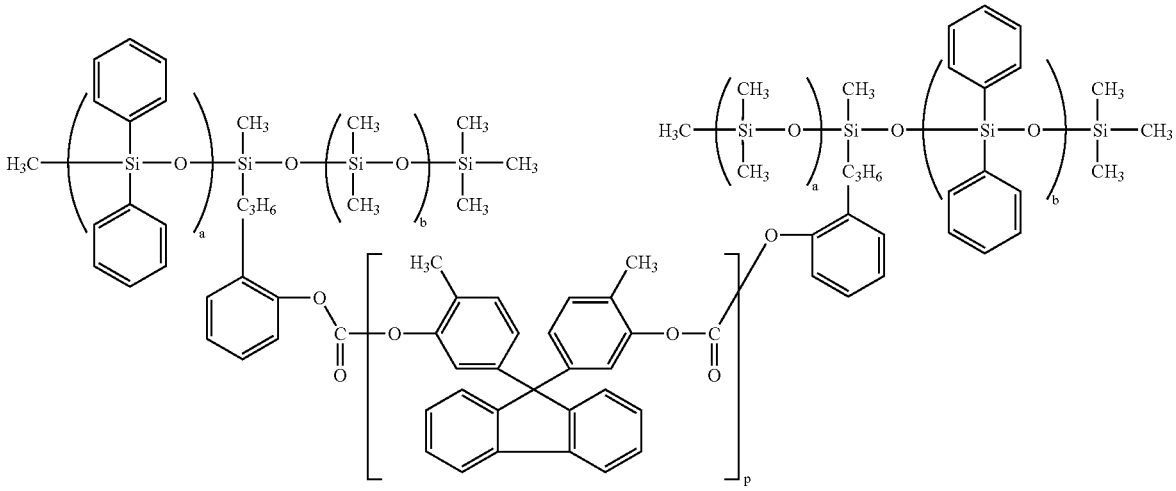
wherein the polymer has an polyalkyl and polyaryl siloxane main chain, and wherein a, b and p are integers representing the number of repeating units; formula (X):
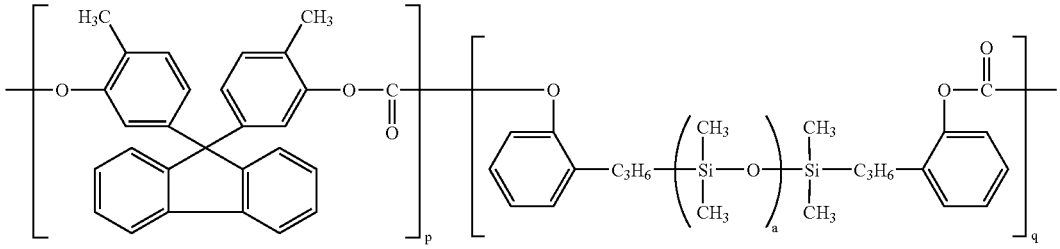
wherein a, p and q are integers representing the number of repeating units; and formula (XI):

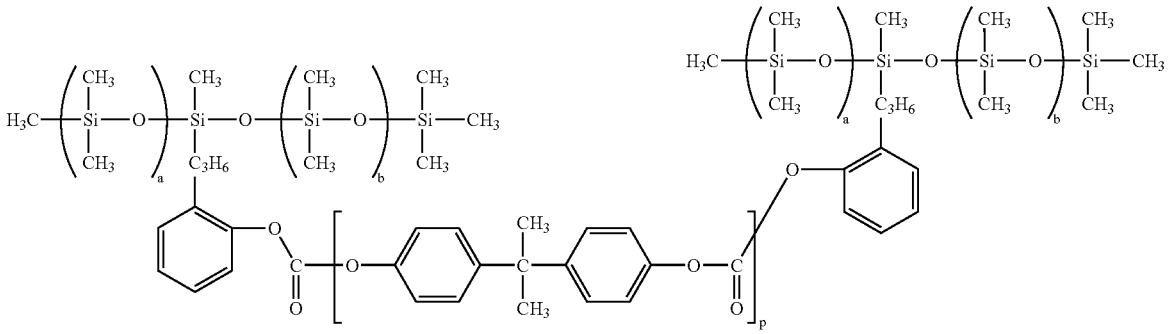

where a, b and p are integers representing the number of repeating units, and mixtures thereof, and an adhesion promoter; and an optional overcoat layer on the at least one imaging layer.

Yet another embodiment, there is provided an electrophotographic imaging member comprising: a flexible substrate with a conducting layer; at least one imaging layer positioned on a first side of the substrate; an anticurl back coating positioned on a second side of the substrate opposite to the at least one imaging layer, wherein the anticurl back coating has an outer exposed layer and an inner layer and the inner layer comprises a bisphenol type polycarbonate having a molecular weight of between about 20,000 and about 200,000 and being selected from the group consisting of a bisphenol A polycarbonate of poly(4,4'-isopropylidene diphenyl) carbonate having the following formula (A):

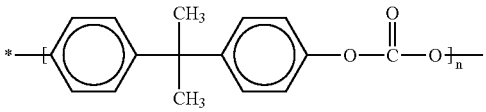

wherein n indicates each respective degree of polymerization, a modified bisphenol A polycarbonate of poly(4,4'-isopropylidene diphenyl) carbonate having the following formula (B):

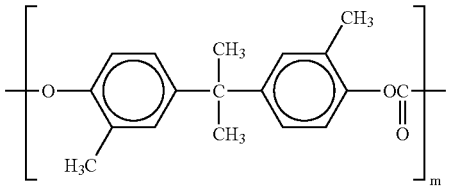

wherein m indicates each respective degree of polymerization, a bisphenol Z polycarbonate of poly(4,4'-diphenyl-1,1'-cyclohexane) carbonate having the following formula (C):

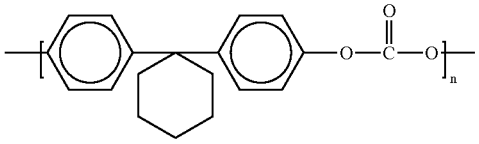

wherein n indicates each respective degree of polymerization, a modified bisphenol Z polycarbonate of poly(4,4'-diphenyl-1,1'-cyclohexane) carbonate having the following formula (D):

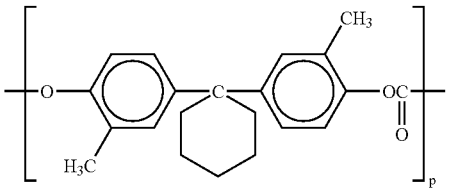

wherein p indicates each respective degree of polymerization, a phthalate-bisphenol A polycarbonate having the following formula (E):

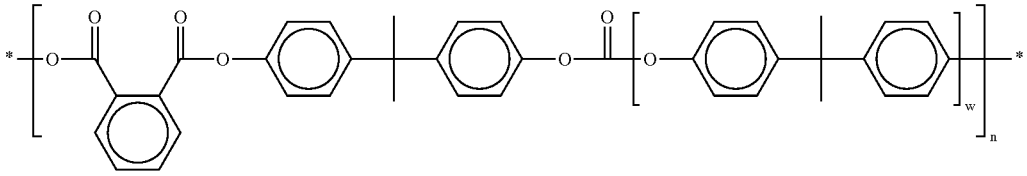

wherein w is an integer from about 1 to about 20 and n is the degree of polymerization, and mixtures thereof, and an adhesion promoter; and the outer exposed layer comprises a low surface energy modified polycarbonate polymer, the polymer being formed and selected from the group consisting of modified Bisphenol A polycarbonate of poly(4,4'-isopropylidene diphenyl carbonate) having a small fraction of polydimethyl siloxane in the polymer back bone and having the following formula (I):

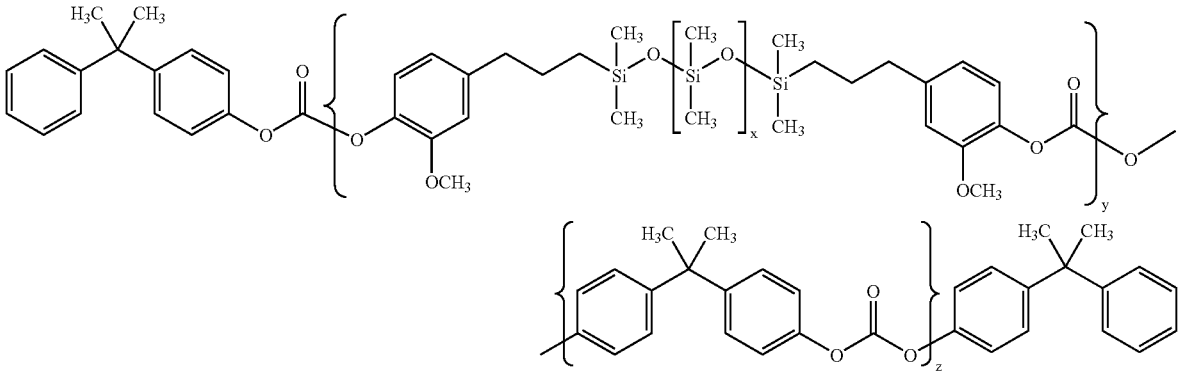

wherein x is an integer between about 40 and about 50 while y and z are integers representing a number of the respective repeating units, a modified Bisphenol Z polycarbonate of poly(4,4'-diphenyl-1,1'-cyclohexane carbonate) having a small fraction of polydimethyl siloxane in the polymer back bone and having the following formula (II):

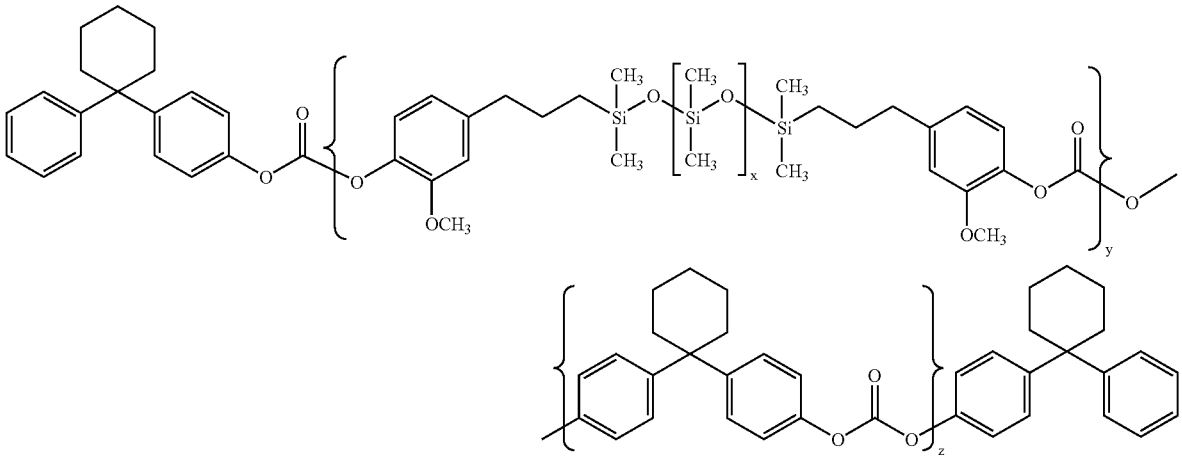

wherein x is an integer between about 40 and about 50 while y and z are integers representing a number of the respective repeating units, a modified Bisphenol C polycarbonate derived from the modification of poly(4,4'-isopropylidene diphenyl carbonate) having a small fraction of polydimethyl siloxane in the polymer back bone and having the following formula (III):

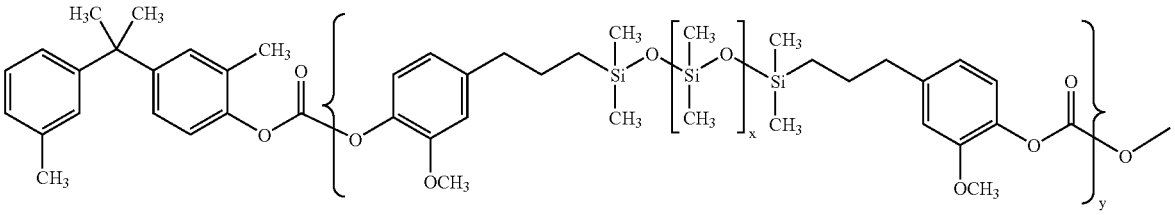

-continued

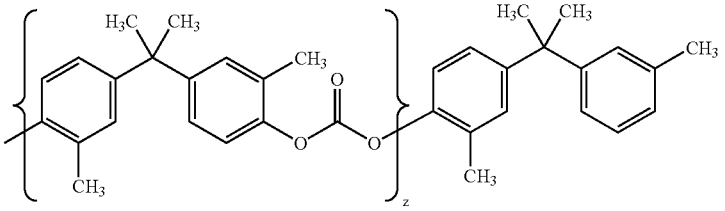

wherein x is an integer between about 40 and about 50 while y and z are integers representing a number of the respective repeating units, a modification of the modified Bisphenol Z polycarbonate of poly(4,4'-diphenyl-1,1'-cyclohexane carbonate) having a small fraction of polydimethyl siloxane in the polymer back bone and having the following formula (IV):

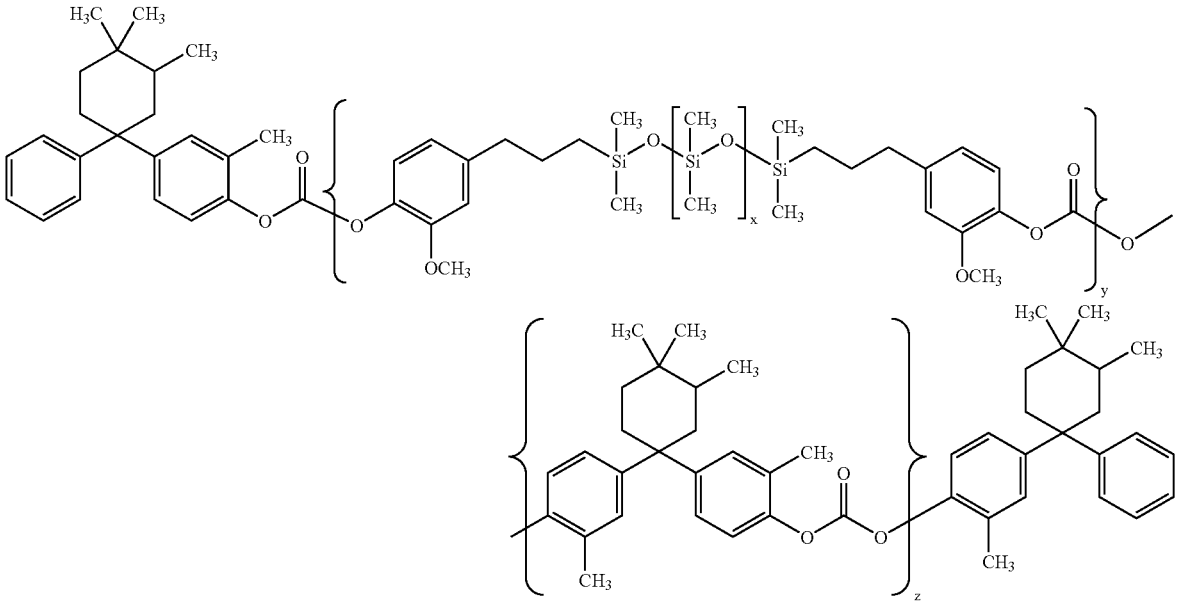

wherein x is an integer between about 40 and about 50 while y and z are integers representing a number of the respective repeating units, and mixtures thereof; and an optional overcoat layer on the at least one imaging layer.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
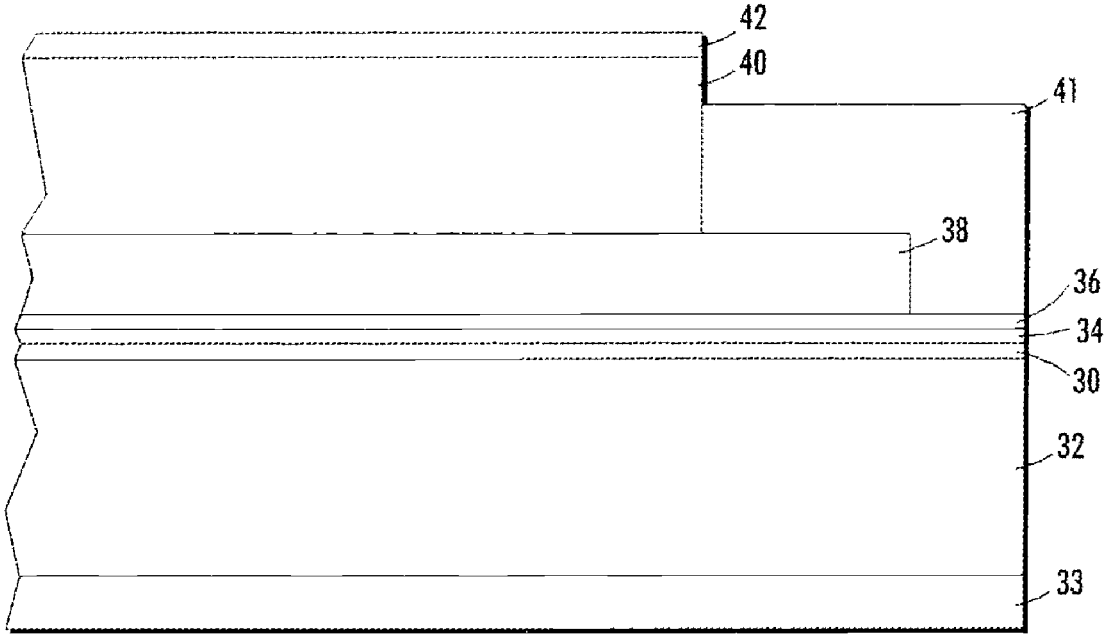
FIG. 1 is a cross-sectional view of a typical conventional multilayered electrophotographic imaging member modified to contain embodiments of the present disclosure.

As stated above, the present embodiments relate generally to the preparation of an improved electrostatographic imaging member having low contact friction surfaces to ease sliding mechanical interaction and suppressing abrasion/wear failure. The embodiments propose particular configurations of imaging members to resolve physical/mechanical associated problems and effect imaging member service life extension. In summary, the embodiments provide: (1) slippery CTL formulation, (2) addition of a low surface energy protective overcoating layer, and (3) a low friction ACBC design.

In accordance to a first CTL embodiment, there is provided a negatively charged electrophotographic imaging member comprising a substrate, a CGL disposed on one side of the substrate; at least one CTL disposed onto the CGL, and an ACBC disposed on the opposite side of the substrate to balance the curl and render the imaging member with proper flatness. The outermost exposed top CTL has an effective slippery surface formulated to comprise of a charge transport compound and a low surface energy polymer binder of modified polycarbonate polymer, the polymer being formed and selected from the group consisting of modified bisphenol A polycarbonate of poly(4,4'-isopropylidene diphenyl carbonate) having a small fraction of polydimethyl siloxane in the polymer back bone and having the following formula (I):

Formula (I)

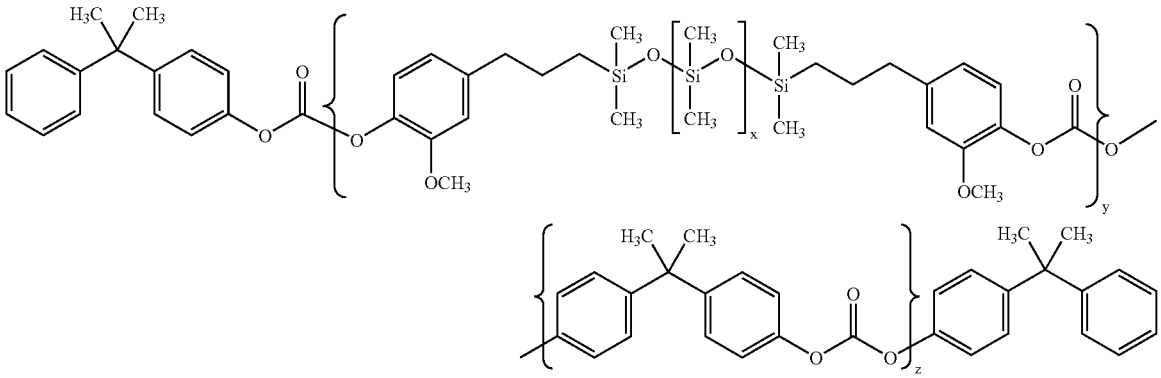

wherein x is an integer between about 40 and about 50 while y and z are integers representing a number of the respective repeating units; a modified bisphenol Z polycarbonate of poly(4,4'-diphenyl-1,1'-cyclohexane carbonate) having a small fraction of a short polydimethyl siloxane segment homogeneously inserted in the polymer back bone and having the following formula (II):

Formula (II)

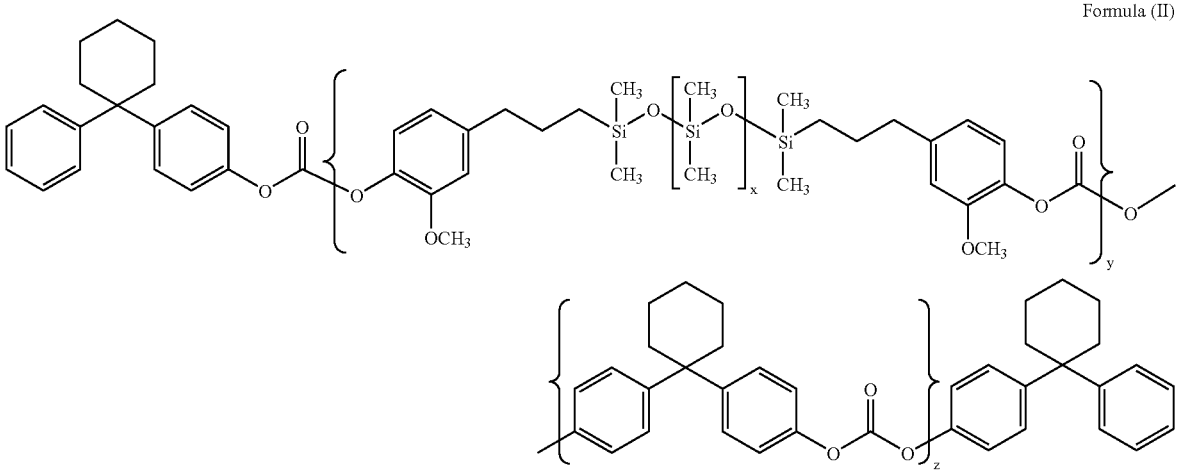

wherein x is an integer between about 40 and about 50 while y and z are integers representing a number of the respective repeating units; a modified bisphenol C polycarbonate derived from the modification of poly(4,4'-isopropylidene diphenyl carbonate) having a small fraction of polydimethyl siloxane in the polymer back bone and having the following formula (III):

Formula (III)

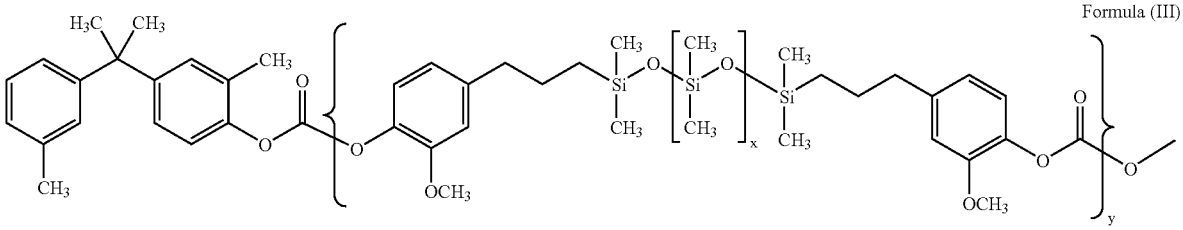

-continued

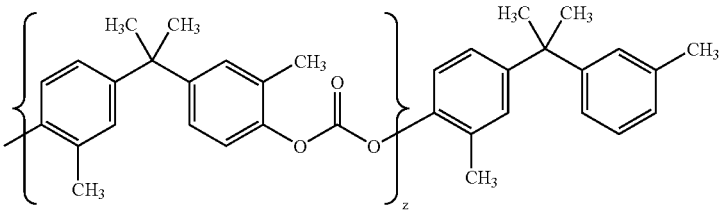

wherein x is an integer between about 40 and about 50 while y and z are integers representing a number of the respective repeating units; and a modification of the modified bisphenol Z polycarbonate of poly(4,4'-diphenyl-1,1'-cyclohexane carbonate) of formula (II), having a small fraction of polydimethyl siloxane in the polymer back bone, to give the following formula (IV):

Formula (IV)

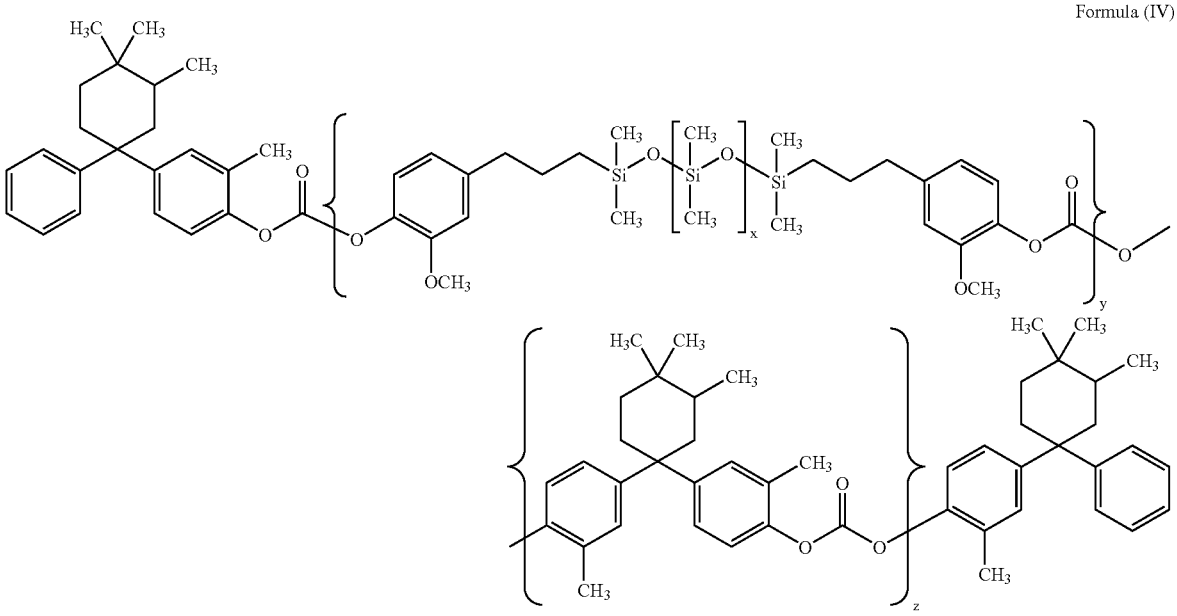

wherein x is an integer between about 40 and about 50 while y and z are integers representing a number of the respective repeating units, and mixtures thereof. The weight average molecular weight of the low surface energy bisphenol type polycarbonates of formulas (I) to (IV) is between about 20,000 and about 200,000.

In a second CTL embodiment, there is provided an electrophotographic imaging member comprising a substrate, a CGL disposed on the substrate, at least one CTL disposed on the CGL, and a curl balancing ACBC to render the imaging member with proper flatness. The outermost exposed top CTL has a slippery surface formulated to comprise a charge transport compound and a binder consisting of a polymer blending of a conventional bisphenol type polycarbonate and a low surface energy modified polycarbonate which is formed from a group comprising of the modification of various types of bisphenol polycarbonates, having a small fraction of polydimethyl siloxane in the polymer back bone, according to the descriptive formulas (I), (II), (III), or (IV) given above. The conventional bisphenol type polycarbonates for the CTL embodiment disclosure application have a molecular weight (Mw) of between about 20,000 and about 200,000; they are, for example, bisphenol A polycarbonate of poly(4,4'-isopropylidene diphenyl) carbonate, bisphenol Z polycarbonate of poly(4,4'-diphenyl-1,1'-cyclohexane) carbonate, and phthalate-bisphenol A polycarbonate.

The weight ratio of the low surface energy polycarbonate to the conventional bisphenol type polycarbonate, based on the polymer blend alone in the CTL, is in the range of from about 5:95 to about 95:5.

In a third CTL embodiment, there is provided an electrophotographic imaging member comprising a substrate; a CGL disposed on the substrate, at least one CTL disposed on the CGL, and a curl balancing ACBC to render the imaging member with proper flatness. The outermost exposed top CTL has a slippery surface formulated to comprise a charge transport compound and a low surface energy binder of a modified bisphenol type polycarbonate of the above formulas (I), (II), (III), or (IV) by following the same procedure and using the same materials/compositions of those described in the first CTL embodiment above, except that a Polyhedral Oligomeric Silsesquioxane (POSS) additive is incorporated in the resulting slippery CTL.

POSS is nanoscopic size particles of chemical structured hybrid intermediate between that of a silica and silicones. As it is nanostructured in size, ranging from about 1 to about 3 nanometers, the dispersion of POSS in a polymer binder matrix to form a nano composite layer has been used to yield reinforcement to impact physical and mechanical robust function. The present disclosure shows that incorporation of from about 1 to about 10 weight percent of a particularly selected POSS, e.g., those containing a low surface energy pendant side group of polysiloxane (PDMS) and polytetrafluoroethylene (PTFE) to render slippery characteristic, into a polycarbonate layer, such as for example, the imaging member CTL, overcoat, or ACBC, not only effectively enhances the respective layer's hardness to improve abrasion/wear resistance, but also produces surface lubricity/contact friction reduction to ease cleaning blade sliding action and render surface abhesiveness to eliminate the propensity of imaging member surface filming formation. The POSS materials of interest for the present disclosure include, for example, Cyclohexenyl-POSS; CyclohexenylethylCyclopenty-POSS; TriSilanol Phenyl-POSS; OctaIsobutyl-POSS; Phenyllsooctyl POSS; IsooctylPhenyl POSS; IsobutylPhenyl POSS Poly(dimethyl-co-methyl-co-methylethylsiloxy POSS) siloxane; Poly(dimethyl-co-hydrido-co-methylpropyl POSS) siloxane; Methacrylfluoror(3)-POSS; and Cyclohexenyl-POSS; Poly(dimethyl-co-methyl-co-methylethylsiloxy POSS) siloxane; Poly(dimethyl-co-hydrido-co-methylpropyl POSS) siloxane; Fluoro(13)DisilanolIsobutyl-POSS; and the like.

Other slippery POSS include poly(dimethyl-co-methylhydrido-co-methylpropyl polyhedral oligomeric silsesquioxane)siloxane, fluoro(13)disilanolisobutyl-polyhedral oligomeric silsesquioxane, poly(dimethyl-co-methylvinyl-co-methylethylsiloxy-polyhedral oligomeric silsesquioxane) siloxane, trisfluoro(13)cylcopentyl-polyhedral oligomeric silsesquioxane, fluoro(13)disilanolcyclopentyl-polyhedral oligomeric silsesquioxane, fluoro(13)disilanolisobutyl-polyhedral oligomeric silsesquioxane, fluoro(13)disilanolcyclopentyl-polyhedral oligomeric silsesquioxane, and the like.

Since the anatomy of a POSS nanostructured chemical is based according to that, shown below, it does therefore have a wide variety of molecular structures:

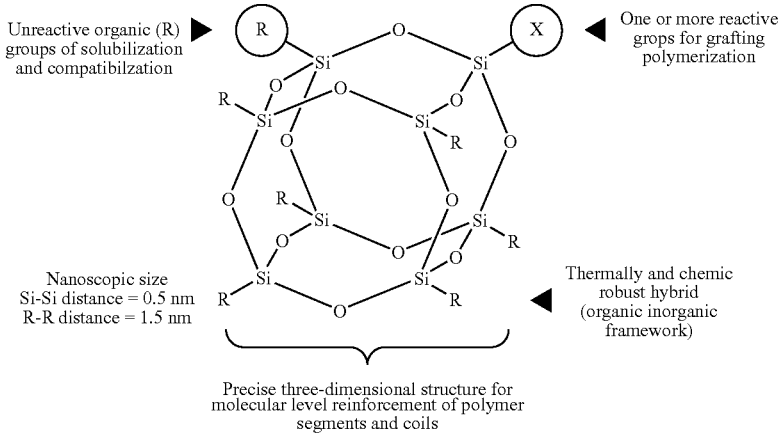

However, for reasons of simplicity, a selected few exemplary of POSS species are shown, in the following, as representative examples:

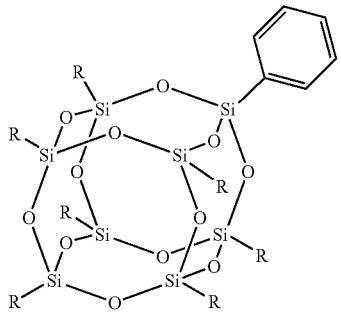

R = i-octyl

-continued

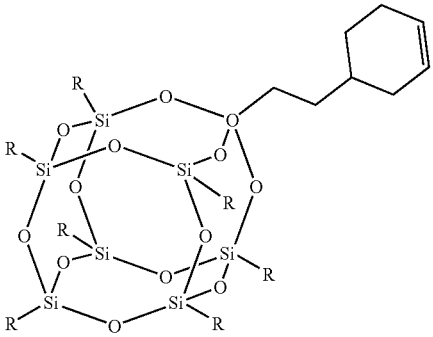

R = cyclopentyl

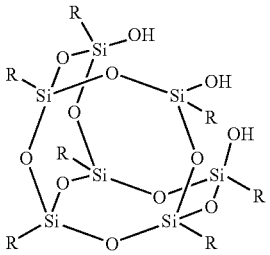

R = t-butyl, cyclopentyl, cyclohexyl, phenyl

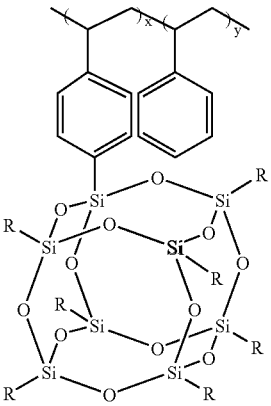

R = phenyl

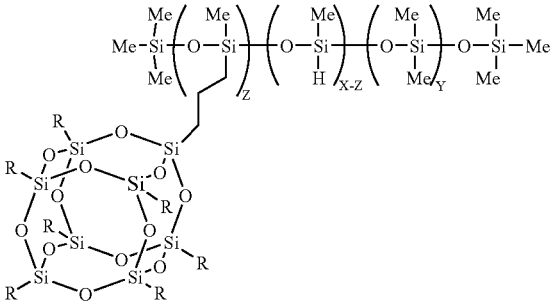

R = t-butyl, cyclopentyl, cyclohexyl, phenyl

-continued

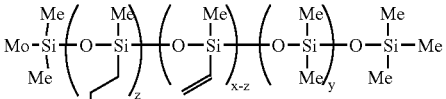

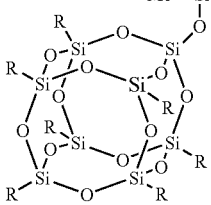

R = t-butyl, cyclopentyl, cyclohexyl, phenyl

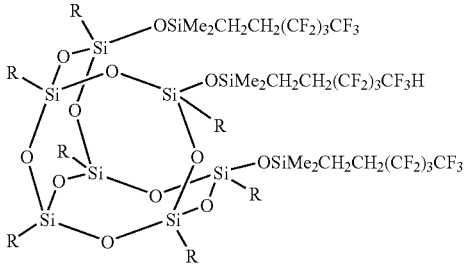

R = t-butyl, cylopentyl

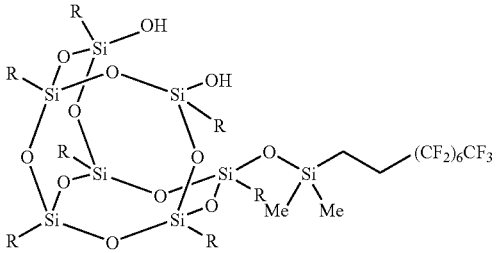

R = cyclopentyl

In a fourth CTL embodiment, there is provided an electrophotographic imaging member comprising a substrate, a CGL disposed on the substrate; at least one CTL disposed on the CGL, and a curl balancing ACBC to render the imaging member with proper flatness. The outermost exposed top CTL has a slippery surface formulated to comprise a charge transport compound and a binder consisting of polymer blending of a conventional polycarbonate and a low surface energy polymer binder of modified bisphenol type polycarbonate of the formulas (I), (II), (III), or (IV) by following the same procedures and using the same materials/composition as described in the second CTL embodiment above, with the exception that a POSS additive is incorporated in the resulting slippery CTL.

In a fifth CTL embodiment, there is provided an electrophotographic imaging member comprising a substrate, a CGL disposed on the substrate, at least one CTL disposed on the CGL, and a curl balancing ACBC to render the imaging member with proper flatness. The exposed outermost top CTL has a slippery surface formulated to comprise a charge transport compound and a binder consisting of polymer blending of two types of low surface energy polycarbonate—the first one is a low surface energy modified bisphenol type polycarbonate as described in above formulas (I), (II), (III), or (IV) and the second polymer is a low surface energy polymer, such as those shown in the following formulas (V) to (XI), comprising a polyalkyl siloxane or a polyalkyl-polyaryl siloxane having a polycarbonate pendant group:

Formula (V)
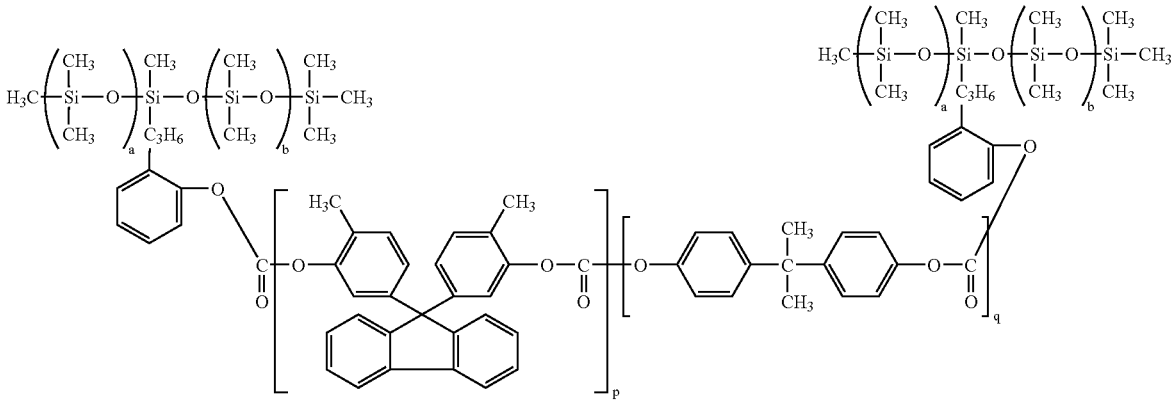
wherein a, b, p and q are integers representing a number of repeating units;
Formula (VI)
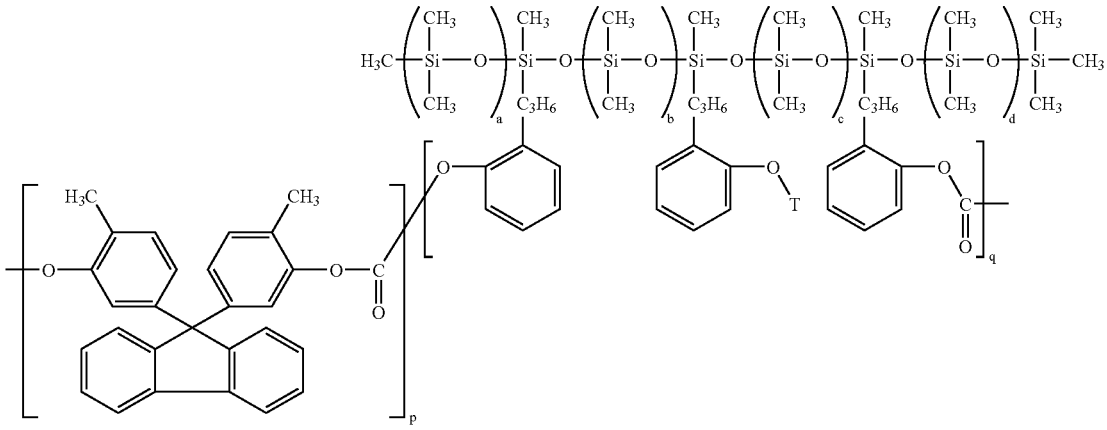
wherein a, b, c, d, p and q are integers representing a number of repeating units;
Formula (VII)
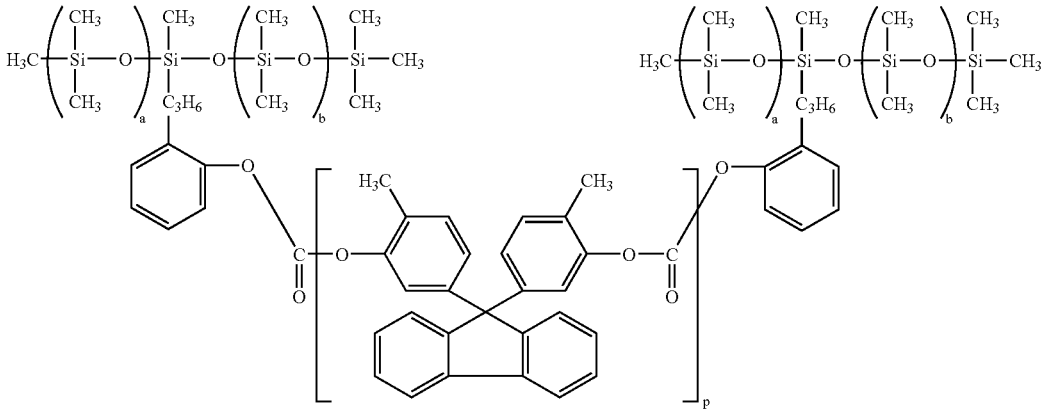
wherein a, b and p are integers representing the number of repeating units;

Formula (VIII)
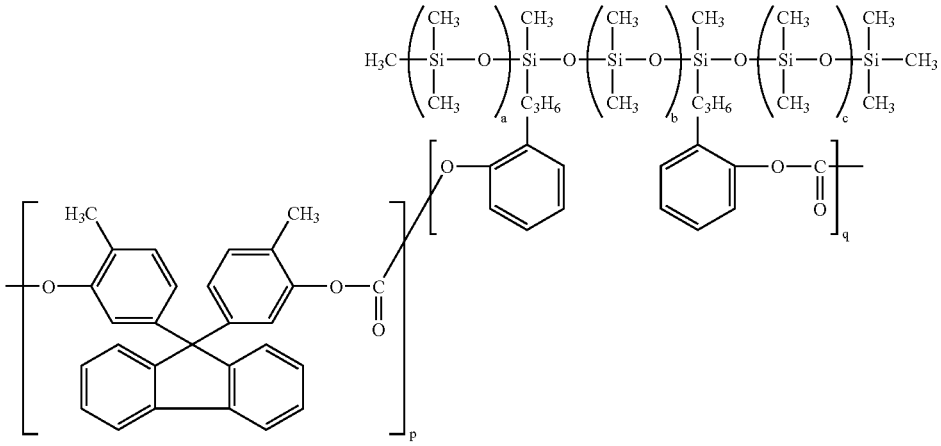
wherein a, b, c, p and q are integers representing the number of repeating units;
Formula (IX)
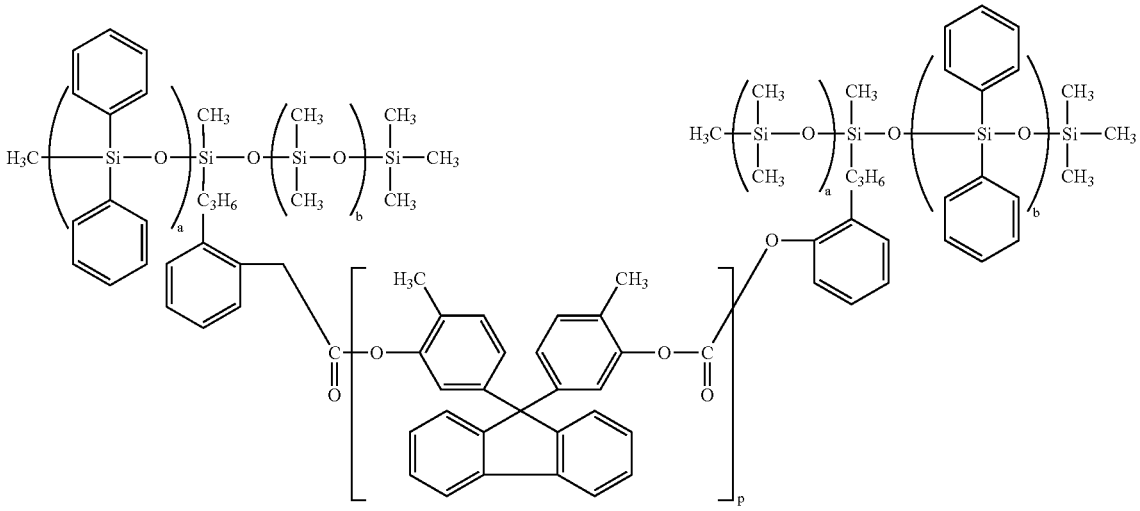
wherein the polymer has an polyalkyl and polyaryl siloxane main chain, and wherein a, b and p are integers representing the number of repeating units;
Formula (X)
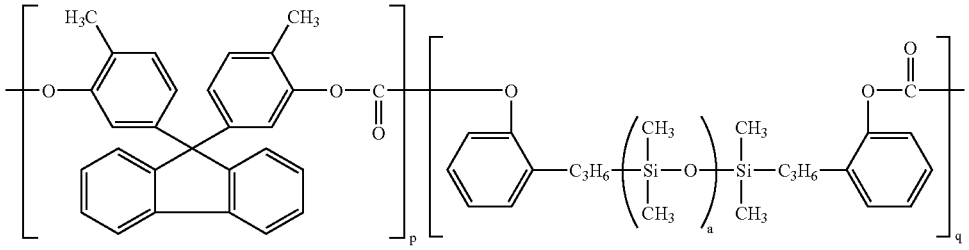
wherein a, p and q are integers representing the number of repeating units; and Formula (XI)

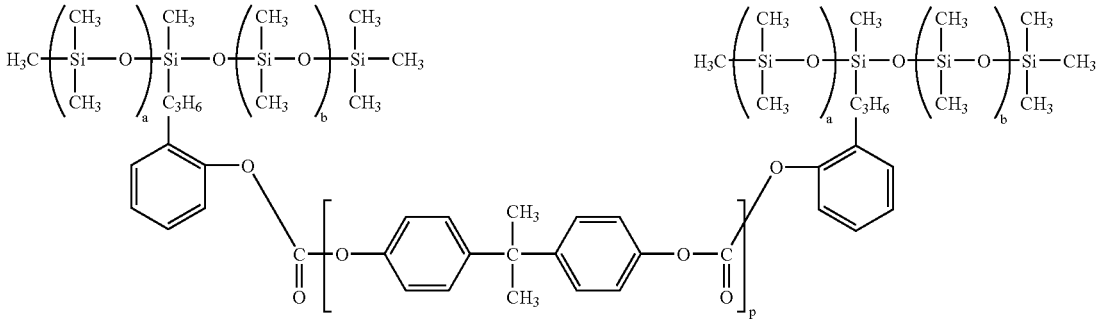

where a, b and p are integers representing the number of repeating units. The weight average molecular weight of the low surface energy polycarbonates of formulas (V) to (XI) is between about 20,000 and about 200,000.

The prepared slippery CTL contains a weight ratio of the first low surface energy polycarbonate to the second low surface energy polycarbonate, based on the polymer blend alone in the CTL, in the range of from about 5:95 to about 95:5.

In a sixth CTL embodiment, there is provided an electrophotographic imaging member comprising a substrate, a CGL disposed on the substrate, at least one CTL disposed on the CGL, and a curl balancing ACBC to render the imaging member with proper flatness. The exposed outermost top CTL has a slippery surface formulated to comprise a charge transport compound and a binder consisting of polymer blending of two types of low surface energy polycarbonate—the first one is a low surface energy modified polycarbonate of formulas (I), (II), (III), or (IV) and the second polymer is a low surface energy polymer such as those shown in the formulas (V) to (XI), comprising a polyalkyl siloxane or a polyalkyl-polyaryl siloxane having a polycarbonate pendant group, using the same procedures and same materials/compositions according that in the fifth CTL embodiment except that a POSS additive is incorporated into the resulting slippery CTL.

In a seventh CTL embodiment, there is provided an electrophotographic imaging member comprising a substrate, a CGL disposed on the substrate, at least one CTL disposed on the CGL, and a curl balancing ACBC to render the imaging member with proper flatness. The exposed outermost top CTL has a slippery surface formulated (without the use of low surface energy polymer) to comprise a charge transport compound, a conventional bisphenol type polycarbonate binder, and including one of the selected low surface energy lubricating POSS additives to enhance hardness and effect surface slipperiness.

The conventional bisphenol type polycarbonates for the seven CTL embodiment disclosure application have a molecular weight (Mw) of between about 20,000 and about 200,000; they are represented by the following molecular structures: (1) The bisphenol A polycarbonate of poly(4,4'-isopropylidene diphenyl) carbonate, as given in formula (A) below:

Formula (A)

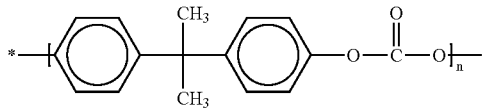

and an extended structure of the bisphenol A polycarbonate is given in below formula (B):

Formula (B)

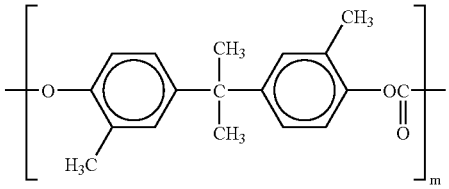

where n and m in formulas (A) and (B) indicate the respective degree of polymerization; (2) The bisphenol Z polycarbonate of poly(4,4'-diphenyl-1,1'-cyclohexane) carbonate, as given in formula (C) below:

Formula (C)

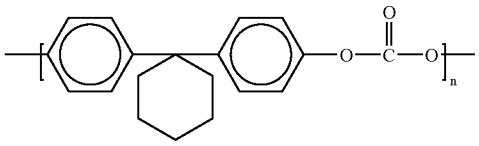

and an extended structure of the bisphenol Z polycarbonate is given in formula (D) as follows:

Formula (D)

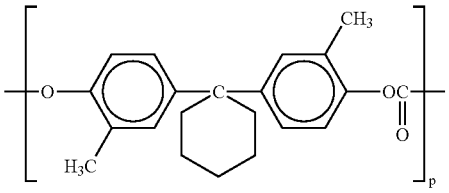

where n and p indicate each respective degree of polymerization; and (3) The phthalate-bisphenol A polycarbonate as represented by the structural formula (E) below:

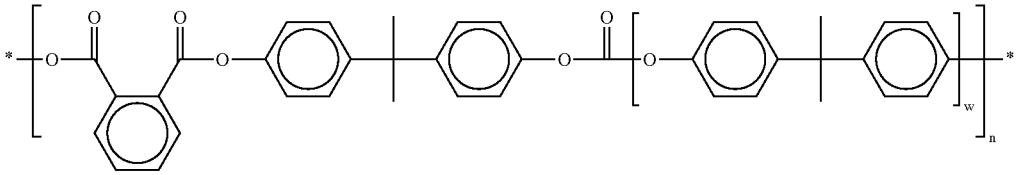

Formula (E)

wherein w is an integer from about 1 to about 20, and n is the degree of polymerization.

The selection of low surface energy POSS for use in addition is based on the specific lubricating POSS species containing either a polysiloxane (PDMS) or a polytetrafluoroethylene (PTFE) pendant group in its chemical structure, to impart slipperiness to the resulting CTL. The slippery CTL thus obtained has from about 1 to about 10 weight percent POSS, based on the total weight of the CTL.

According to the alternate aspects of the present disclosure, the single CTL of the imaging member may be formed to comprise dual layer CTL, subdivided into two discrete layers comprising a bottom layer disposed on the CGL and a slippery exposed outermost top layer coated over the bottom layer. The thickness of the dual layer CTL is the same as that of the single CTL which is from about 5 to about 100 micrometers and more particularly, from about 15 to about 40 micrometers. However, the thickness of the top layer is from about the same thickness as that of the bottom layer to about ⅕ of that of the bottom layer, and contains lower charge transport compound than that in the top layer. The embodiments of dual CTL imaging member are described as follows.

In an eighth CTL embodiment, the CTL is a dual layer CTL comprising a discrete bottom layer disposed on the CGL and a slippery top outer exposed layer coated on the bottom layer. Although the bottom layer in the dual CTL has the conventional material compositions, the slippery top layer is formulated to comprise a charge transport compound and a binder comprising a low surface energy modified bisphenol type polycarbonate which is formed and selected from the group consisting of the modification of the various types of bisphenol polycarbonates, having a small fraction of polydimethyl siloxane in the polymer back bone, according to the descriptive formulas (I), (II), (III), or (IV), and in accordance with the same material formulation disclosed in the first CTL embodiment, to render surface abhesiveness and slippery property to the top layer.

In a ninth CTL embodiment, the CTL is a dual layer CTL in which the bottom has the conventional material compositions while the slippery top layer that is formulated to comprise a charge transport compound and a binder of polymer blend comprising a conventional bisphenol type polycarbonate of formulas (A) to (E) and a low surface energy modified bisphenol type polycarbonate, which being formed from and selected from the group consisting of the modification of the various types of bisphenol polycarbonate of formulas (I), (II), (III), or (IV), in accordance with the same material formulation disclosed in the preceding second CTL embodiment, to impact surface slipperiness to the top layer.

In a tenth CTL embodiment, the CTL is a dual layer CTL comprising a bottom layer of the conventional material compositions and a slippery top layer that is formulated to comprise a charge transport compound and a binder comprising a low surface energy bisphenol type polycarbonate of the modification of the various types of bisphenol polycarbonates having the descriptive formulas (I), (II), (III), or (IV), and also including a POSS in accordance with the same material formulation disclosed in the preceding third CTL embodiment, to enhance hardness and render surface abhesiveness as well as slippery property to the top layer.

In an eleventh CTL embodiment, the CTL is a dual layer CTL comprising a bottom layer of the conventional material compositions and a slippery top layer that is formulated to comprise a charge transport compound and a binder comprising a polymer blending of a conventional polycarbonate and a low surface energy polymer binder of modified bisphenol type polycarbonate of the formulas (I), (II), (III), or (IV) and also including a POSS in accordance with the same material formulation disclosed in the fourth CTL embodiment, to impact hardness enhancement as well as surface abhesiveness and as slippery property to the top layer.

In a twelfth CTL embodiment, the CTL is a dual layer CTL comprising a bottom layer of the conventional material compositions and a slippery top layer that is formulated to comprise a charge transport compound and a binder comprising a polymer blending of two types of low surface energy polycarbonate—the first one is a low surface energy modified polycarbonate as described in formulas (I), (II), (III), or (IV) and the second polymer is a low surface energy polymer having one of formulas (V) to (XI) and comprising a polyalkyl siloxane or a polyalkyl-polyaryl siloxane having a polycarbonate pendant group, in accordance with the material formulation disclosed in the fifth CTL embodiment, to render surface abhesiveness and slippery property to the top layer.

In a thirteenth CTL embodiment, the CTL is a dual layer CTL comprising a bottom layer of the conventional material compositions and a slippery top layer that is formulated to comprise a charge transport compound and a binder comprising a polymer blending of two types of low surface energy polycarbonate—the first one is a low surface energy modified polycarbonate as described in formulas (I), (II), (III), or (IV), and the second polymer being a low surface energy polymer having one of formulas (V) to (XI) and comprising a polyalkyl siloxane or a polyalkyl-polyaryl siloxane having a polycarbonate pendant group, and also including a POSS additive, in accordance with the material formulation disclosed in the preceding sixth CTL embodiment, to enhance hardness and render surface abhesiveness as well as slippery property to the top layer.

In a fourteenth CTL embodiment, the CTL is a dual layer CTL comprising a bottom layer of the conventional material compositions and a slippery top layer that is formulated to comprise a charge transport compound and a conventional bisphenol type polycarbonate of formulas (A) to (E) binder and also including one of the selected low surface energy POSS additive, in accordance with the material formulation disclosed in the preceding seventh CTL embodiment, to impart hardness and slipperiness to the resulting top layer. The selection of low surface energy POSS is based on the specific POSS species containing either a polysiloxane (PDMS) or a polytetrafluoroethylene (PTFE) pendant group in its chemical structure.

In accordance to the other aspects of present disclosure, the effort has also alternatively focused on formulating a physically/mechanically robust thin overcoat layer as an added-on layer over the traditional CTL to render effective protection and eliminate the service life failures associated with the CTL shortfalls of traditional electrophotographic imaging member.

In a first overcoat embodiment, there is provided an electrophotographic imaging member comprising a substrate, a CGL disposed on the substrate, at least one CTL on the CGL, a slippery overcoat layer disposed onto the CTL, and a curl balancing ACBC to render the imaging member with proper flatness. The slippery overcoat layer is comprised of a low surface energy modified bisphenol type polycarbonate polymer, according to those described in formulas (I), (II), (III), or (IV), and a POSS additive. The thickness of the slippery overcoat is from about 1 to about 10 micrometers and is preferably from about 2 to about 6 micrometers; the slippery overcoat contains between about none and about 10 weight percent of a charge transport compound.

In a second overcoat embodiment, there is provided an electrophotographic imaging member comprising a substrate, a CGL disposed on the substrate, at least one CTL on the CGL, a slippery overcoat layer disposed onto the CTL, and a curl balancing ACBC to render the imaging member with proper flatness. The slippery overcoat layer is formulated to comprise the blending of two types of low surface energy polycarbonate—one is a low surface energy modified bisphenol type polycarbonate polymer according to those described in formulas (I), (II), (III), or (IV) and the second polymer is a low surface energy polymer, as those shown in the above formulas (V) to (XI), comprising a polyalkyl siloxane or a polyalkyl-polyaryl siloxane having a polycarbonate pendant group.

In a third overcoat embodiment, there is provided an electrophotographic imaging member comprising a substrate, a CGL disposed on the substrate, at least one CTL on the CGL, a slippery overcoat layer disposed onto the CTL, and a curl balancing ACBC to render the imaging member with proper flatness. The slippery overcoat layer is comprised of blending the very same types of the two low surface energy bisphenol type polycarbonates of formulas (I) to (IV) and formulas (V) to (XI) described in the above embodiment, except with the inclusion of a POSS additive.

In a fourth overcoat embodiment, there is provided an electrophotographic imaging member comprising a substrate, a CGL disposed on the substrate, at least one CTL on the CGL, a slippery overcoat layer disposed onto the CTL, and a curl balancing ACBC to render the imaging member with proper flatness. The slippery overcoat layer is formulated (without the use of a low surface energy polycarbonate) to comprise a particularly selected high molecular weight bisphenol type polycarbonate as described in preceding formulas (A) to (E) (but having ultra high molecular weight), an ozone suppression oligomeric liquid, and a lubricating slip agent to render slippery surface.

The selection of a high molecular weight bisphenol type polycarbonate for use in overcoat formulation of this disclosure is particularly focused on a specific ultra high molecular weight (Mw) polycarbonate, which is required to have at least 200,000 (or in particular embodiments at least 230,000 or further at least 250,000) in Mw to ensure and achieve mechanically robust overcoat function. The ultra high molecular weight bisphenol type polycarbonates that are suitable and selected for the fourth overcoat embodiment disclosure application are those of formulas (A) through (E) above.

The ozone suppressing oligomeric liquid is: (1) a diethylene glycol bis(allyl carbonate) represented by formula (1):

Formula (1)

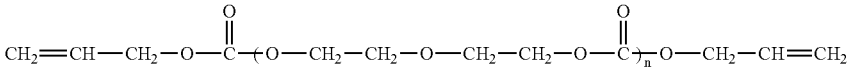

wherein n is an integer from about 1 to about 6; (2) a bis(allyl carbonate) of Bisphenol A shown as formula (2) below:

Formula (2)

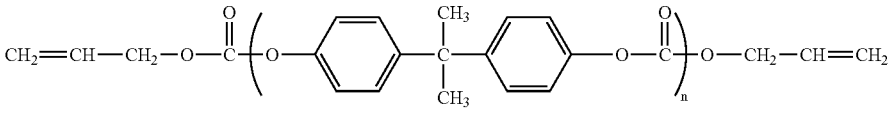

wherein n is an integer from about 1 to about 6. In a specific embodiment, n=1 and the liquid carbonate is a monomer bis(allyl carbonate) of bisphenol A; and/or (3) a polystyrene represented by formula (3) below:

Formula (3)

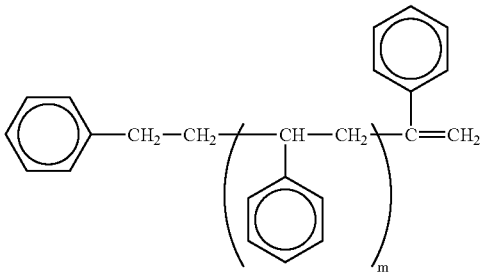

wherein m is the degree of polymerization and m is an integer from about 3 to about 10.

The resulting imaging member having the protective overcoat of this disclosure effectively minimizes the ozone species attacks which is emitted from the corona effluents by the charging devices to thereby extend service life of the imaging member. The mechanism imparting the prevention/suppression of polymer chain scission degradation in the overcoat against ozone attack (through incorporation of a vinyl (or allyl) containing liquid oligomer given above) can be illustrated with reference to the chemical reaction below:

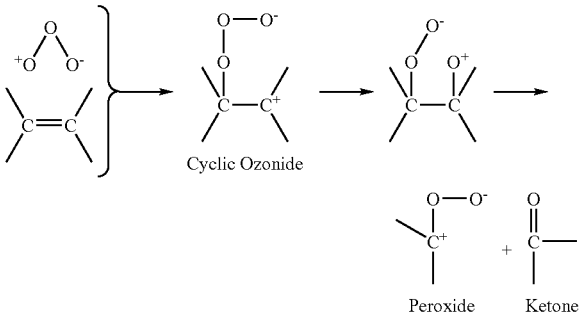

The addition of the slip agent for overcoat surface energy reduction and lubrication is a liquid polyester modified polysiloxane, as represented by formula (4) below:

FORMULA (4)

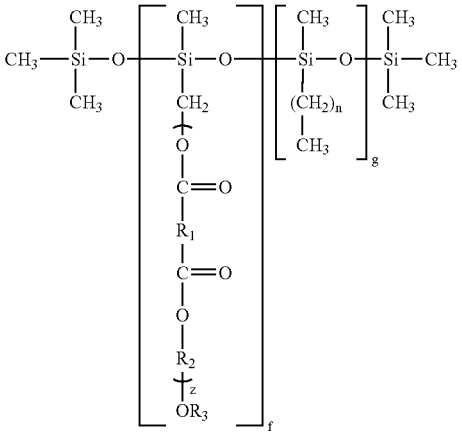

wherein $R_1$ and $R_2$ are independently selected from alkylene groups containing from 1 to 10 carbon atoms; $R_3$ is hydrogen or alkyl having 1 to 3 carbon atoms; n is an integer from 0 to 10; f and g are independently integers from 5 to 500; and z is an integer from 1 to 30. The slip agent lowers the resulting overcoat's surface energy to give slippery surface and render abhesiveness.

In a fifth overcoat embodiment, there is provided an electrophotographic imaging member comprising a substrate, a CGL disposed on the substrate, at least one CTL on the CGL, a slippery overcoat layer disposed onto the CTL, and a curl balancing ACBC to render the imaging member with proper flatness. The slippery overcoat layer is comprised of the very exact same material compositions of ultra high molecular weight bisphenol type polycarbonate, ozone suppression oligomeric liquid, and a lubricating slip agent as described in the fourth overcoat embodiment above, but also incorporates a POSS additive in the overcoat layer.

A typical ACBC coating or layer is required to have a thickness that is adequately sufficient for balancing the curl and rendering the imaging member with desirable flatness. In accordance to further aspects of the present embodiments, there is provided an ACBC having improved surface slipperiness to suppress abrasion/wear damage and eliminate cyclic imaging member belt ACBC tribo-electrical charge-up belt drive problem in the filed.

In a first ACBC embodiment, there is provided an imaging member comprising a substrate, a CGL disposed on the substrate, at least one CTL on the CGL, and a slippery ACBC disposed on the substrate on a side opposite to the CTL to render the imaging member desired flatness. The slippery ACBC is a single layer which is comprised of a low surface energy modified bisphenol type polycarbonate polymer, according to those described in formulas (I), (II), (III), or (IV), an adhesion promoter, and a POSS additive.

In a second ACBC embodiment, the slippery ACBC of the imaging member is comprised of polymer blending of two types of low surface energy bisphenol type polycarbonate polymers, in which the first low surface energy polymer is a modified polycarbonate polymer, according to those described in formulas (I), (II), (III), or (IV), and the second low surface energy polymer is one of formulas (V) to (XI), comprising a polyalkyl siloxane or a polyalkyl-polyaryl siloxane having a polycarbonate pendant group, and an adhesion promoter.

In a third ACBC embodiment, the slippery ACBC is comprised of polymer blending of the very same two types of low surface energy polymers as above (e.g., the first a low surface energy polymer is a modified polycarbonate polymer having formulas (I), (II), (III), or (IV) and the second polymer is a low surface energy polymer, as those of formulas (V) to (XI), comprising a polyalkyl siloxane or a polyalkyl-polyaryl siloxane having a polycarbonate pendant group), an adhesion promoter, and also a POSS additive.

In a fourth ACBC embodiment, the slippery ACBC is formulated to comprise the conventional bisphenol type polycarbonate of formulas (A) to (E), an adhesion promoter, an ozone suppression agent of formulas (1) to (3) and a lubricating slip agent of formula (4) as described above, and also with the additional incorporation of a POSS. The conventional bisphenol type polycarbonate of formulas (A) to (E) used for the fourth ACBC embodiment application, having a molecular weight of between about 20,000 and about 200,000, are the same polycarbonates as those used in CTL formulation described in the preceding seventh CTL embodiment.

In the further aspects of this disclosure, the single ACBC of the imaging member may instead be a dual layer ACBC consisting of two subdivided discrete layers: the inner layer and the slippery outer layer. The inner layer is disposed directly over the substrate support and the slippery outer layer is coated onto the inner layer. A typical single ACBC having a thickness of from about 5 to about 80 micrometers and from about 10 to about 20 micrometers is found to be sufficient for balancing the curl and rendering the imaging member flat. For dual layer ACBC design, the resulting slippery outer layer has a thickness of from about the same as that of the inner layer to about ⅕ the thickness of inner layer and gives a slippery/abhesive surface.

In a fifth ACBC embodiment, the inner layer of the dual ACBC comprises the conventional bisphenol type polycarbonate and an adhesion promoter, while the slippery outer layer is formulated to comprise of a low surface energy modified bisphenol type polycarbonate polymer, according to those described in formulas (I), (II), (III), or (IV) and a POSS additive, in accordance with the first ACBC embodiment except no adhesion promoter.

In a sixth ACBC embodiment, the inner layer of the dual ACBC comprises the conventional bisphenol type polycarbonate and an adhesion promoter, while the slippery outer layer is formulated by polymer blending of the two very same types of low surface energy polycarbonates (e.g., a first low surface energy modified polycarbonate polymer of formulas (I), (II), (III), or (IV), and a second low surface energy polymer, as those shown in formulas (V) to (XI), comprising a polyalkyl siloxane or a polyalkyl-polyaryl siloxane having a polycarbonate pendant group low surface) in accordance with the preceding second ACBC embodiment except no adhesion promoter.

In a seventh ACBC embodiment, the inner layer of the dual ACBC comprises a base layer of the conventional bisphenol type polycarbonate layer and an adhesion promoter, while the slippery outer layer is formulated to comprise a polymer blending of the very same two types of low surface energy bisphenol type polycarbonates (e.g., a first low surface energy modified polycarbonate polymer of formulas (I), (II), (III), or (IV), and a second low surface energy polymer, as those shown in formulas (V) to (XI), comprising a polyalkyl siloxane or a polyalkyl-polyaryl siloxane having a polycarbonate pendant group low surface) in accordance with the preceding third ACBC embodiment except no adhesion promoter, but also including a POSS additive.

In an eighth ACBC embodiment, the inner layer of the dual ACBC comprises a base layer of the conventional bisphenol type polycarbonate layer and an adhesion promoter, while the slippery outer layer is formulated to comprise of a conventional bisphenol type polycarbonate of formulas (A) to (E), an adhesion promoter, an ozone suppression agent of formulas (1) to (3) and a slip agent of formula (4) according to the exact same material compositions as described in the fourth ACBC embodiment above, except with the inclusion of a POSS additive and no addition of adhesion promoter.

In further aspects, there is provided an image forming apparatus for forming images on a recording medium comprising a flexible imaging member belt having a charge retentive surface for receiving an electrostatic latent image thereon, wherein the imaging member comprises a substrate, a CGL disposed on the substrate, at least one CTL disposed on the CGL, and an ACBC disposed onto the substrate on a side opposite to the CTL to maintain imaging member flatness. The top outermost exposed layer is either a slippery CTL layer or an added-on slippery protective overcoat of the present embodiments disposed onto the CTL, while the lower outermost layer is a slippery ACBC of the present embodiments. The image forming apparatus further includes a development component for applying a toner developer material to the charge-retentive surface, a transfer component for applying the developed toner image from the charge-retentive surface to a copy substrate, and a fusing component for fusing the developed image onto the receiving copy substrate. The slippery CTL, slippery overcoat, and slippery ACBC for achieving surface contact friction reduction for effective physical/mechanical function enhancement are each formulated to comprise one or a blend of two low surface energy modified polycarbonate polymers being formed from a group comprising a modified bisphenol type polycarbonate. Alternatively, the low friction property of the CTL, overcoat, and ACBC layers of the present disclosure may each respectively be achieved by simply formulating the layer with the utilization of a conventional bisphenol type polycarbonate plus a slip agent and a selected low surface energy POSS to render its surface abhesiveness and slipperiness. In addition, all the slippery layers of the present embodiments may further be formulated to give a hardness enhanced nano composite material matrix by incorporation of a selected POSS additive. Furthermore, the slippery layers may also include an ozone suppression compound and a slip agent to maximize its physical/mechanical functions.

The exemplary embodiments of this disclosure are more particularly described below with reference to the drawings. Although specific terms are used in the following description for clarity, these terms are intended to refer only to the particular structure of the various embodiments selected for illustration in the drawings and not to define or limit the scope of the disclosure. The same reference numerals are used to identify the same structure in different figures unless specified otherwise. The structures in the figures are not drawn according to their relative proportions and the drawings should not be interpreted as limiting the disclosure in size or location. It is understood that other embodiments may be utilized and structural and operational changes may be made without departing from the scope of the present disclosure.

A typical negatively charged flexible electrophotographic imaging member is illustrated in FIG. 1. The substrate 32 has an optional conductive ground plane 30. An optional hole blocking layer 34 can also be applied, as well as an optional adhesive layer 36. The CGL 38 is located between the substrate 32 and the CTL 40 of present disclosure. An optional ground strip layer 41 operatively connects the CGL 38 and the CTL 40 to the conductive ground plane 30. An optional overcoat layer 42 of present disclosure, if needed, may be added on to protect the CTL. To maintain imaging member flatness, an ACBC 33 of the present disclosure is applied to the side of the substrate 32 opposite to the electrically active layers.

The optional ground strip layer 41, applied to one edge of the imaging member is to promote electrical continuity of the CTL 40 and CGL 38 with the conductive ground plane 30 through the hole blocking layer 34. A conductive ground plane layer 30, which is typically a thin metallic layer, for example a 10 nanometer thick titanium coating, may be deposited over the substrate 32 by vacuum deposition or sputtering process. The layers 34, 36, 38, 40 and 42 may be separately and sequentially deposited, onto the surface of conductive ground plane 30 of substrate 32, as wet coating layer of solutions comprising a solvent, with each layer being dried before deposition of the next. The ACBC 33 is also solution coated, but is applied to the backside (the side opposite to all the other layers) of substrate 32, to render the imaging member flatness.

Figure 2:
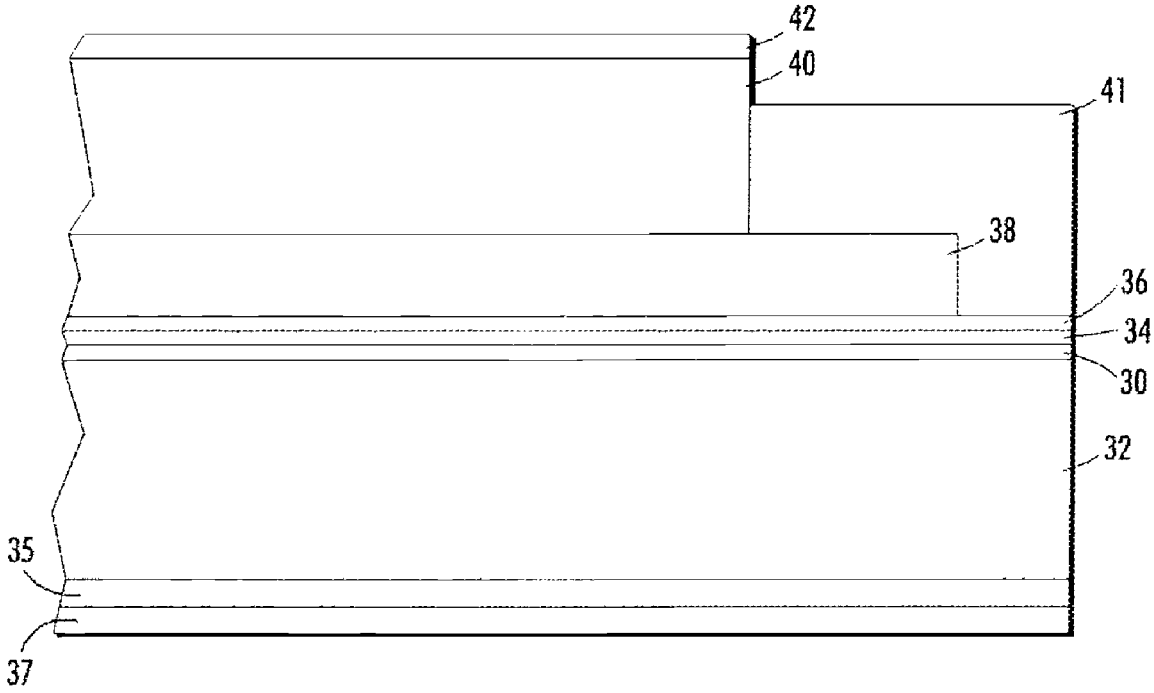
FIG. 2 is a cross-sectional view of another multilayered electrophotographic imaging member configuration modified according to the embodiments of the present disclosure.

An imaging member containing a dual ACBC of the present disclosure is illustrated in FIG. 2. The inner layer or sublayer 35 coated directly onto the substrate 32 is coated over by the outer layer or sublayer 37. The layers are defined in reference to the substrate 32; thus, the outer layer is the outermost layer and is the layer exposed to the machine environment.

Figure 3:
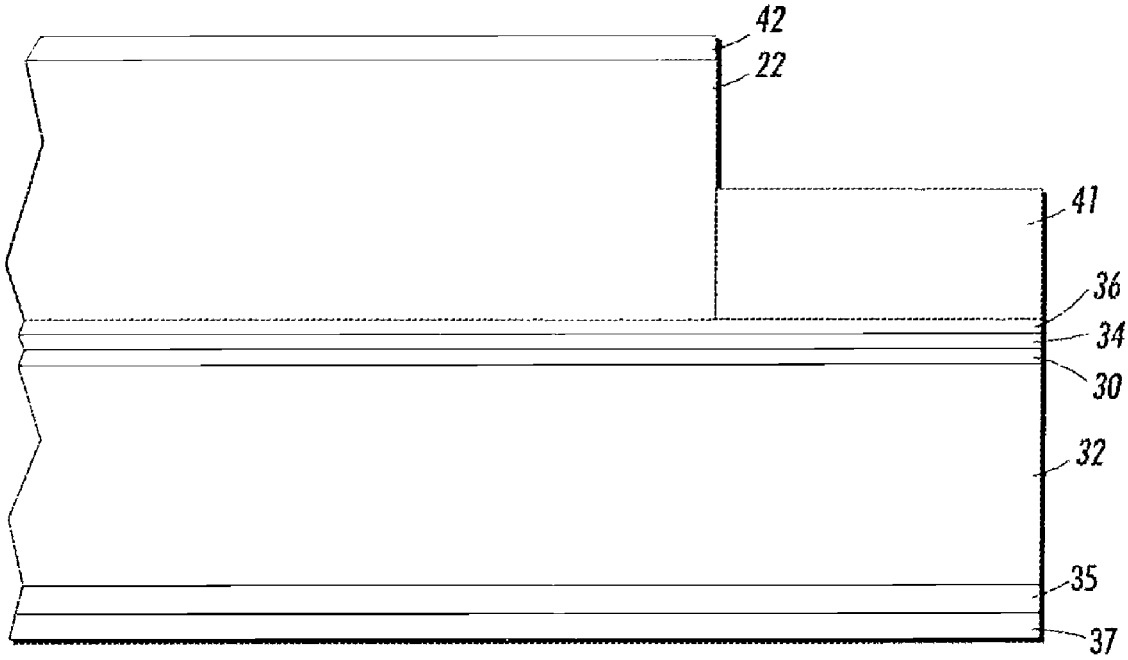
FIG. 3 is a cross-sectional view of an alternate multilayered electrophotographic imaging member configuration modified according to the description of further embodiments of the present disclosure.

As an alternative to the discrete CTL 40 and CGL 38 according to the illustrations in FIGS. 1 and 2, a simplified single imaging layer 22 of present disclosure, as shown in FIG. 3, having both charge generating and charge transporting capabilities, may be employed. The single imaging layer 22 may comprise a single electrophotographically active layer capable of retaining an electrostatic charge in the dark during electrostatic charging, imagewise exposure and image development, as disclosed, for example, in U.S. Pat. No. 6,756,169, the disclosure of which is fully incorporated herein by reference. The single layer incorporates both photogenerating material and charge transport component as described in reference to each separate layer below.

The Substrate

The photoreceptor support substrate 32 may be opaque or substantially transparent, and may comprise any suitable organic or inorganic material having the requisite mechanical properties. The substrate may comprise the same material as that in the electrically conductive surface, or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and or oxides.

The substrate can also be formulated entirely of an electrically conductive material, or it can be an insulating material including inorganic or organic polymeric materials, such as, MYLAR, a commercially available biaxially oriented polyethylene terephthalate from DuPont, or polyethylene naphthalate available as KADALEX 2000, with a conductive layer comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations. The substrate may have a number of many different configurations, such as, for example, a plate, a drum, a scroll, an endless flexible belt, and the like. In one embodiment, the substrate is in the form of a seamed flexible belt.

The thickness of the substrate depends on numerous factors, including flexibility, mechanical performance, and economic considerations. The thickness of the support substrate may range from about 50 micrometers to about 3,000 micrometers. In embodiments of flexible photoreceptor belt preparation, the thickness of substrate is from about 50 micrometers to about 200 micrometers for optimum flexibility and to effect minimum induced photoreceptor surface bending stress when a photoreceptor belt is cycled around small diameter rollers in a machine belt support module, for example, 19 millimeter diameter rollers.

An exemplary substrate support is not soluble in any of the solvents used in each coating layer solution, is optically transparent, and is thermally stable up to a high temperature of about 150° C. A typical substrate support used for imaging member fabrication has a thermal contraction coefficient ranging from about $1\times10^{-5}$/° C. to about $3\times10^{-5}$/° C. and a Young's Modulus of between about $5\times10^{-5}$ psi ($3.5\times10^{-4}$ Kg/cm$^2$) and about $7\times10^{-5}$ psi ($4.9\times10^{-4}$ Kg/cm$^2$).

The Conductive Layer

The conductive ground plane layer 30 may vary in thickness depending on the optical transparency and flexibility desired for the electrophotographic imaging member. When a photoreceptor flexible belt is desired, the thickness of the conductive layer on the support substrate typically ranges from about 2 nanometers to about 75 nanometers to enable adequate light transmission for proper back erase, and in embodiments from about 10 nanometers to about 20 nanometers for an optimum combination of electrical conductivity, flexibility, and light transmission. Generally, for rear erase exposure, a conductive layer light transparency of at least about 15 percent is desirable. The conductive layer need not be limited to metals. The conductive layer may be an electrically conductive metal layer which may be formed, for example, on the substrate by any suitable coating technique, such as a vacuum depositing or sputtering technique. Typical metals suitable for use as conductive layer include aluminum, zirconium, niobium, tantalum, vanadium, hafnium, titanium, nickel, stainless steel, chromium, tungsten, molybdenum, combinations thereof, and the like. Where the entire substrate is an electrically conductive metal, the outer surface thereof can perform the function of an electrically conductive layer and a separate electrical conductive layer may be omitted. Other examples of conductive layers may be combinations of materials such as conductive indium tin oxide as a transparent layer for light having a wavelength between about 4000 Angstroms and about 9000 Angstroms or a conductive carbon black dispersed in a plastic binder as an opaque conductive layer.

The Hole Blocking Layer

A hole blocking layer 34 may then be applied to the substrate or to the conductive layer, where present. Any suitable positive charge (hole) blocking layer capable of forming an effective barrier to the injection of holes from the adjacent conductive layer 30 into the photoconductive or photogenerating layer may be utilized. The charge (hole) blocking layer may include polymers, such as, polyvinylbutyral, epoxy resins, polyesters, polysiloxanes, polyamides, polyurethanes, HEMA, hydroxylpropyl cellulose, polyphosphazine, and the like, or may comprise nitrogen containing siloxanes or silanes, or nitrogen containing titanium or zirconium compounds, such as, titanate and zirconate. The hole blocking layer may have a thickness in wide range of from about 5 nanometers to about 10 micrometers depending on the type of material chosen for use in a photoreceptor design. Typical hole blocking layer materials include, for example, trimethoxysilyl propylene diamine, hydrolyzed trimethoxysilyl propyl ethylene diamine, N-beta-(aminoethyl) gamma-aminopropyl trimethoxy silane, isopropyl 4-aminobenzene sulfonyl di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, (gamma-aminobutyl)methyl diethoxysilane which has the formula [H2N(CH2)4] CH3Si(OCH3)2, and (gamma-aminopropyl)methyl diethoxysilane, which has the formula [H2N(CH2)3]CH33Si (OCH3)2, and combinations thereof, as disclosed, for example, in U.S. Pat. Nos. 4,338,387; 4,286,033; and 4,291,110, incorporated herein by reference in their entireties. A hole blocking layer comprises a reaction product between a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low RH. Other suitable charge blocking layer polymer compositions are also described in U.S. Pat. No. 5,244,762 which is incorporated herein by reference in its entirety. These include vinyl hydroxyl ester and vinyl hydroxy amide polymers wherein the hydroxyl groups have been partially modified to benzoate and acetate esters which modified polymers are then blended with other unmodified vinyl hydroxy ester and amide unmodified polymers. An example of such a blend is a 30 mole percent benzoate ester of poly(2-hydroxyethyl methacrylate) blended with the parent polymer poly(2-hydroxyethyl methacrylate). Still other suitable charge blocking layer polymer compositions are described in U.S. Pat. No. 4,988,597, which is incorporated herein by reference in its entirety. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of these U.S. patents are incorporated herein by reference in their entireties.

The hole blocking layer can be continuous or substantially continuous and may have a thickness of less than about 10 micrometers because greater thicknesses may lead to undesirably high residual voltage. In aspects of the exemplary embodiment, a blocking layer of from about 0.005 micrometers to about 2 micrometers gives optimum electrical performance. The blocking layer may be applied by any suitable conventional technique, such as, spraying, dip coating, draw bar coating, gravure coating, silk screening, air knife coating, reverse roll coating, vacuum deposition, chemical treatment, and the like. For convenience in obtaining thin layers, the blocking layer may be applied in the form of a dilute solution, with the solvent being removed after deposition of the coating by conventional techniques, such as, by vacuum, heating, and the like. Generally, a weight ratio of blocking layer material and solvent of between about 0.05:100 to about 5:100 is satisfactory for spray coating.

The Adhesive Interface Layer

An optional separate adhesive interface layer 36 may be provided. The adhesive interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-1200, VITEL PE-2200, VITEL PE-2200D, and VITEL PE-2222, all from Bostik, 49,000 polyester from Rohm Haas, polyvinyl butyral, and the like. The adhesive interface layer may be applied directly to the hole blocking layer. Thus, the adhesive interface layer in some embodiments is in direct contiguous contact with both the underlying hole blocking layer and the overlying charge generating layer to enhance adhesion bonding to provide linkage. In yet other embodiments, the adhesive interface layer is entirely omitted.

Any suitable solvent or solvent mixtures may be employed to form a coating solution of the polyester for the adhesive interface layer. Typical solvents include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited wet coating may be effected by any suitable conventional process, such as oven drying, infra red radiation drying, air drying, and the like.

The adhesive interface layer may have a thickness of from about 0.01 micrometers to about 900 micrometers after drying. In embodiments, the dried thickness is from about 0.03 micrometers to about 1 micrometer.

The Charge Generating Layer

Any suitable charge generating layer (CGL) 38 including a photogenerating or photoconductive material, which may be in the form of particles and dispersed in a film forming binder, such as an inactive resin, may be utilized. Examples of photogenerating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example, in U.S. Pat. No. 4,587,189, the entire disclosure thereof being incorporated herein by reference. Multi-photogenerating layer compositions may be utilized where a photoconductive layer enhances or reduces the properties of the photogenerating layer. Other suitable photogenerating materials known in the art may also be utilized, if desired. The photogenerating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245, the entire disclosure thereof being incorporated herein by reference Any suitable inactive resin materials may be employed as a binder in the photogenerating layer, including those described, for example, in U.S. Pat. No. 3,121,006, the entire disclosure thereof being incorporated herein by reference. Typical organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like.

An exemplary film forming polymer binder is PCZ-400 (poly(4,4'-dihydroxy-diphenyl-1-1-cyclohexane) which has a MW of 40,000 and is available from Mitsubishi Gas Chemical Corporation.

The photogenerating material can be present in the resinous binder composition in various amounts. Generally, from about 5 percent by volume to about 90 percent by volume of the photogenerating material is dispersed in about 10 percent by volume to about 95 percent by volume of the resinous binder, and more specifically from about 20 percent by volume to about 30 percent by volume of the photo generating material is dispersed in about 70 percent by volume to about 80 percent by volume of the resinous binder composition.

The photogenerating layer containing the photogenerating material and the resinous binder material generally ranges in thickness of from about 0.1 micrometer to about 5 micrometers, for example, from about 0.3 micrometers to about 3 micrometers when dry. The photogenerating layer thickness is generally related to binder content. Higher binder content compositions generally employ thicker layers for photogeneration.

The Ground Strip Layer

Other layers such as conventional ground strip layer 41 comprising, for example, conductive particles dispersed in a film forming binder may be applied to one edge of the imaging member to promote electrical continuity with the conductive layer through the hole blocking layer. The ground strip layer 41 may include any suitable film forming polymer binder and electrically conductive particles and is co-extrusion along during the application of charge transport layer 40 coating. Typical ground strip materials include those enumerated in U.S. Pat. No. 4,664,995, the entire disclosure of which is incorporated by reference herein. The ground strip layer may have a thickness from about 7 micrometers to about 42 micrometers, for example, from about 14 micrometers to about 23 micrometers.

The Charge Transport Layer

The charge transport layer (CTL) 40 is thereafter applied over the CGL and may include any suitable transparent organic polymer or non-polymeric material capable of supporting the injection of photogenerated holes or electrons from the CGL and capable of allowing the transport of these holes/electrons through the CTL to selectively discharge the surface charge on the imaging member surface. In one embodiment, the CTL not only serves to transport holes, but also protects the CGL from abrasion or chemical attack and may therefore extend the service life of the imaging member. The CTL can be a substantially non-photoconductive material, but one which supports the injection of photogenerated holes from the charge generation layer. The CTL is normally transparent in a wavelength region in which the electrophotographic imaging member is to be used when exposure is effected therethrough to ensure that most of the incident radiation is utilized by the underlying CGL. The CTL should exhibit excellent optical transparency with negligible light absorption and neither charge generation nor discharge if any, when exposed to a wavelength of light useful in xerography, e.g., 400 to 900 nanometers. In the case when the photoreceptor is prepared with the use of a transparent substrate and also a transparent conductive layer, image wise exposure or erase may be accomplished through the substrate with all light passing through the back side of the substrate. In this case, the materials of the CTL need not transmit light in the wavelength region of use if the CGL is sandwiched between the substrate and the CTL. The CTL in conjunction with the CGL is an insulator to the extent that an electrostatic charge placed on the CTL is not conducted in the absence of illumination. The CTL should trap minimal charges as they pass through it during the printing process.

The CTL may include any suitable charge transport component or activating compound useful as an additive molecularly dispersed in an electrically inactive polymeric material to form a solid solution and thereby making this material electrically active. The charge transport component may be added to a film forming polymeric material which is otherwise incapable of supporting the injection of photo generated holes from the generation material and incapable of allowing the transport of these holes therethrough. This converts the electrically inactive polymeric material to a material capable of supporting the injection of photogenerated holes from the CGL and capable of allowing the transport of these holes through the CTL in order to discharge the surface charge on the CTL. The charge transport component typically comprises small molecules of an organic compound which cooperate to transport charge between molecules and ultimately to the surface of the CTL.

Any suitable inactive resin binder soluble in methylene chloride, chlorobenzene, or other suitable solvent may be employed in the CTL. Exemplary binders include polycarbonates, polyesters, polyvinyl butyrals, polystyrene, polyvinyl formals, and combinations thereof. The polymer binder used for the CTLs may be, for example, selected from the group consisting of bisphenol type polycarbonates, poly(vinyl carbazole), polystyrene, polyester, polyarylate, polyacrylate, polyether, polysulfone, combinations thereof, and the like. However, polycarbonates include poly(4,4'-isopropylidene diphenyl carbonate), poly(4,4'-diphenyl-1,1'-cyclohexane carbonate), and combinations thereof are the binder resin used for CTL preparation. The molecular weight of the polycarbonate binder can be for example, from about 20,000 to about 200,000. One exemplary of conventional film forming binder of this type is a bisphenol A polycarbonate, which is available from Bayer AG as MAKROLON and comprises poly(4,4'-isopropylidene diphenyl) carbonate having a weight average molecular weight of about 120,000.

The conventional bisphenol type polycarbonates that are typically utilized for the traditional CTL application have a molecular weight (Mw) of between about 20,000 and about 200,000, namely: (1) The bisphenol A polycarbonate of poly (4,4'-isopropylidene diphenyl) carbonate, as given in formula (A) below:

Formula (A)

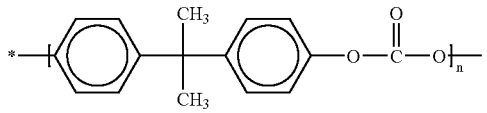

and an extended structure of the bisphenol A polycarbonate is given in below formula (B):

Formula (B)

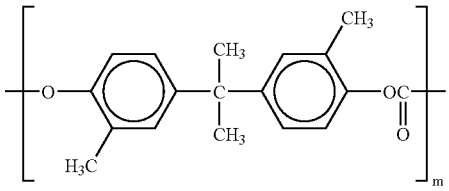

where n and m in formulas (A) and (B) indicate the respective degree of polymerization; (2) The bisphenol Z polycarbonate of poly(4,4'-diphenyl-1,1'-cyclohexane) carbonate, as given in formula (C) below:

Formula (C)

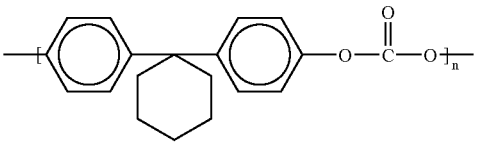

and an extended structure of bisphenol Z polycarbonate is given in formula (D) as follows:

Formula (D)

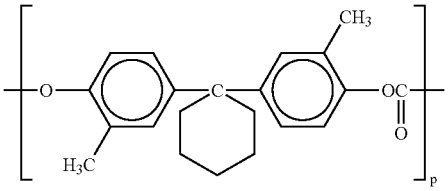

where n and p indicate each respective degree of polymerization; and (3) The phthalate-bisphenol A polycarbonate as represented by the structural formula (E) below:

Formula (E)

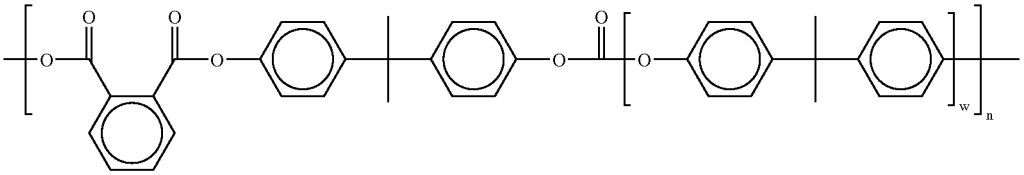

wherein w is an integer from about 1 to about 20, and n is the degree of polymerization.

Exemplary charge transport components include aromatic polyamines, such as aryl diamines and aryl triamines. Exemplary aromatic diamines include N,N'-diphenyl-N,N'-bis(alkylphenyl)-1,1'-biphenyl-4,4'-diamines, such as m-TBD, which has the formula (N,N'-diphenyl-N,N'-bis[3-methylphenyl]-[1,1'-biphenyl]-4,4'-diamine); N,N'-diphenyl-N,N'-bis(chlorophenyl)-1,1'-biphenyl-4,4'-diamine; and N,N'-bis-(4-methylphenyl)-N,N'-bis(4-ethylphenyl)-1,1'-(3,3'-dimethylbiphenyl)-4,4'-diamine (Ae-16), N,N'-bis(3,4-dimethylphenyl)-4,4'-biphenyl amine (Ae-18), and combinations thereof. Other suitable charge transport components include pyrazolines, such as 1-[lepidyl-(2)]-3-(p-diethylaminophenyl)-5-(p-diethylaminophenyl)pyrazoline, as described, for example, in U.S. Pat. Nos. 4,315,982, 4,278,746, 3,837,851, and 6,214,514, substituted fluorene charge transport molecules, such as 9-(4'-dimethylaminobenzylidene)fluorene, as described in U.S. Pat. Nos. 4,245,021 and 6,214,514, oxadiazole transport molecules, such as 2,5-bis(4-diethylaminophenyl)-1,3,4-oxadiazole, pyrazoline, imidazole, triazole, as described, for example in U.S. Pat. No. 3,895,944, hydrazones, such as p-diethylaminobenzaldehyde (diphenylhydrazone), as described, for example in U.S. Pat. Nos. 4,150,987 4,256,821, 4,297,426, 4,338,388, 4,385,106, 4,387,147, 4,399,207, 4,399,208, 6,124,514, and tri-substituted methanes, such as alkyl-bis(N,N-dialkylaminoaryl) methanes, as described, for example, in U.S. Pat. No. 3,820,989. The disclosures of all of these patents are incorporated herein be reference in their entireties.

The concentration of the charge transport component in the CTL may be from about 5 weight % to about 60 weight % based on the weight of the dried CTL. The concentration or composition of the charge transport component may vary through the CTL, as disclosed, for example, in U.S. Pat. Nos. 6,933,089, and 7,018,756, the disclosures of which are incorporated herein by reference in their entireties. In one exemplary embodiment, the CTL comprises from about 10 to about 60 weight % of N,N'-diphenyl-N,N'-bis(3-methylphenyl)-1,1'-biphenyl-4,4'-diamine. In a more specific embodiment, the CTL comprises from about 30 to about 50 weight % N,N'-diphenyl-N,N'-bis(3-methylphenyl)-1,1'-biphenyl-4,4'-diamine.

In specific, the CTL is a solid solution including a charge transport component, such as N,N'-diphenyl-N,N'-bis(3-methylphenyl)-1,1'-biphenyl-4,4'-diamine, molecularly dissolved in a polycarbonate binder, the binder being either a poly(4,4'-isopropylidene diphenyl carbonate) or a poly(4,4'-diphenyl-1,1'-cyclohexane carbonate). The CTL may have a Young's Modulus in the range of from about $2.0\times10^5$ psi ($1.7\times10^4$ Kg/cm$^2$) to about $4.5\times10^5$ psi ($3.2\times10^4$ Kg/cm$^2$), a glass transition temperature (Tg) of between about 50° C. and about 110° C. and a thermal contraction coefficient of between about $6\times10^{-5}$/° C. and about $8\times10^{-5}$/° C.

The CTL is an insulator to the extent that the electrostatic charge placed on the CTL is not conducted in the absence of illumination at a rate sufficient to prevent formation and retention of an electrostatic latent image thereon. In general, the ratio of the thickness of the CTL to the CGL is maintained from about 2:1 to about 200:1 and in some instances as great as about 400:1. The thickness of the CTL is from about 5 micrometers to about 100 micrometers, or more particularly from between about 15 micrometers and about 40 micrometers.

Under a normal machine functioning condition in the field, the outermost exposed CTL 40 of the imaging member is highly susceptible to mechanical failure and material degradation under a machine service environment as a result of constant mechanical interaction against cleaning blade, cleaning brush, dirt debris, carrier beads from developer, loose $CaCO_3$ particles from paper, and chemical attack from corona effluent species to exacerbate pre-mature development of abrasion/wear/scratch problem. Moreover, the CTL of typical imaging member belts is also found to be prone to early onset of surface filming formation that impacts copy print-out quality to thereby preventing the imaging member belt from reaching its service life target.

Therefore, imaging member having a physically/mechanically improved CTL design, having low surface energy characteristic, to impact service life extension of the imaging member in the field is formulated according to the present disclosure, and presented herein after.

In a first CTL embodiment of present disclosure, the slippery CTL 40 of the imaging member is formulated by entirely replacing the conventional bisphenol type polycarbonate binder with a low surface energy bisphenol type polycarbonate to give a slippery CTL having surface abhesiveness and contact friction reduction as well. The low surface energy polymer binder selected for present disclosure application is a modified bisphenol type polycarbonate polymer being formed from a group consisting of modified bisphenol A polycarbonate of poly(4,4'-isopropylidene diphenyl carbonate) having a small fraction of polydimethyl siloxane in the polymer back bone. The molecular structure of this low surface energy polycarbonate is presented in the following formula (I):

Formula (I)

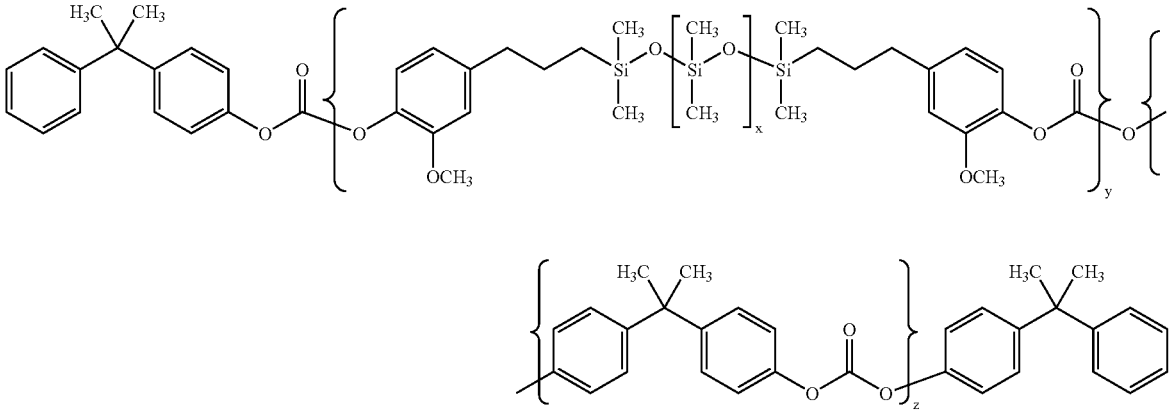

wherein x is an integer between about 40 and about 50 while y and z are integers representing a number of the respective repeating units.

Another low surface energy polycarbonate of interest is a modified bisphenol Z polycarbonate of poly(4,4'-diphenyl-1,1'-cyclohexane carbonate) having a small fraction of polydimethyl siloxane in the polymer back bone and having the following formula (II):

Formula (II)

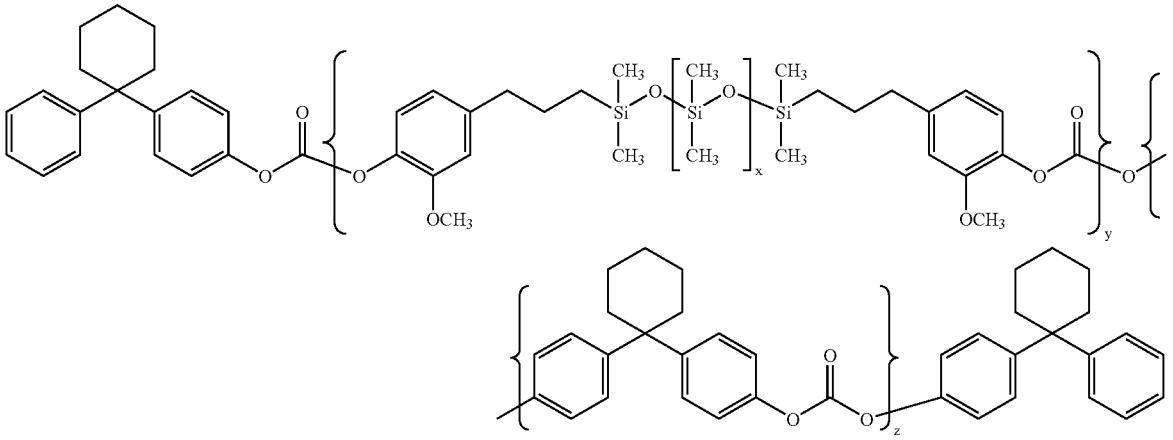

wherein x is an integer between about 40 and about 50 while y and z are integers representing a number of the respective repeating units.

A third low surface energy polycarbonate viable for disclosure application is a modified bisphenol C polycarbonate derived from the modification of poly(4,4'-isopropylidene diphenyl carbonate) having a small fraction of polydimethyl siloxane in the polymer back bone and having the following formula (III):

Formula (III)

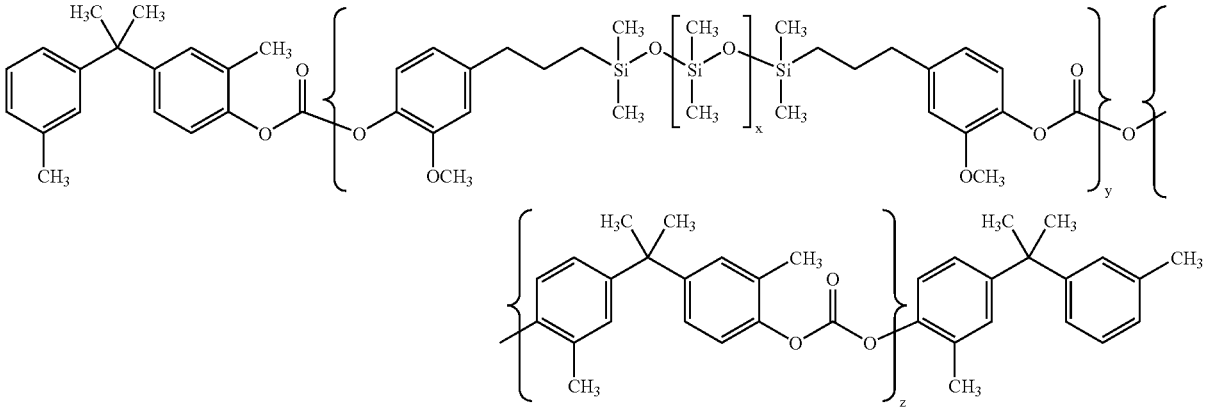

wherein x is an integer between about 40 and about 50 while y and z are integers representing a number of the respective repeating units.

A fourth low surface energy that is also suitable for use is a modification of the modified bisphenol Z polycarbonate of poly(4,4'-diphenyl-1,1'-cyclohexane carbonate) having a small fraction of polydimethyl siloxane in the polymer back bone and having the following formula (IV):

Formula (IV)

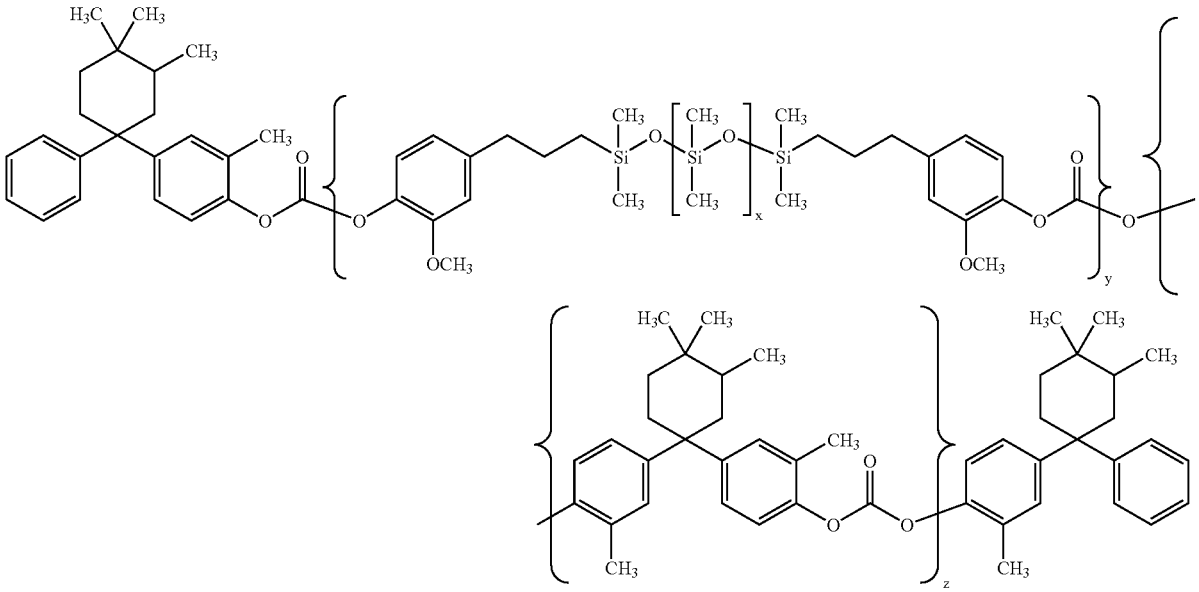

wherein x is an integer between about 40 and about 50 while y and z are integers representing a number of the respective repeating units, and mixtures thereof. The weight average molecular weight of the low surface energy bisphenol type polycarbonates of formulas (I) to (IV) is between about 20,000 and about 200,000.

In a second CTL embodiment of present disclosure, the slippery CTL 40 of the imaging member is formulated by only partial replacement of, from about 5 to about 95 weight percent, the conventional bisphenol type polycarbonate binder with the low surface energy bisphenol A polycarbonate, according to the formulas (I), (II), (III), or (IV) description above, to give a slippery CTL having a polymer blended binder consisting of the conventional bisphenol type polycarbonate and the low surface energy bisphenol A polycarbonate. The conventional bisphenol type polycarbonates for the seven CTL application have a molecular weight (Mw) of between about 20,000 and about 200,000.

One exemplary of conventional film forming bisphenol type polycarbonate employed to mix with the low surface energy polycarbonate to form the polymer blending binder of the disclosed CTL is a bisphenol A polycarbonate, which is available from Bayer AG as MAKROLON and comprises poly(4,4'-isopropylidene diphenyl) carbonate having a weight average molecular weight of about 120,000. The molecular structure of bisphenol A polycarbonate is given in formula (A) below:

Formula (A)

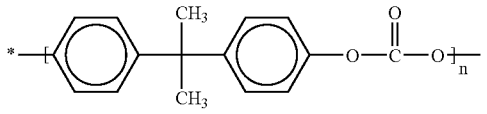

and an extended structure of this bisphenol A polycarbonate is shown in formula (B):

Formula (B)

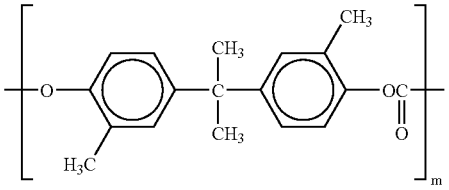

where n and m in formulas (A) and (B) indicate each respective degree of polymerization.

The other exemplary of conventional film forming bisphenol type polycarbonate binder is the bisphenol Z polycarbonate of poly(4,4'-diphenyl-1,1'-cyclohexane) carbonate. The molecular structure of poly(4,4'-diphenyl-1,1'-cyclohexane) carbonate, having a molecular weight of about between about 20,000 and about 200,000, is given in formula (C) below:

Formula (C)

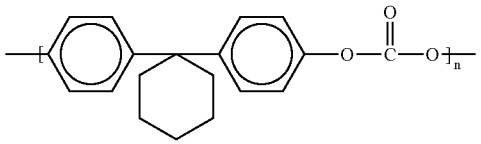

and an extended structure of bisphenol Z polycarbonate is given in formula (D) as follows:

Formula (D)

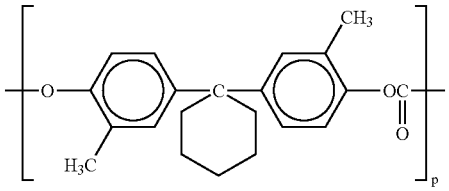

where n and p indicate each respective degree of polymerization.

In yet another conventional film-forming bisphenol type polycarbonate, it is a phthalate-bisphenol A polycarbonate as represented by the structural formula (E) below:

Formula (E)

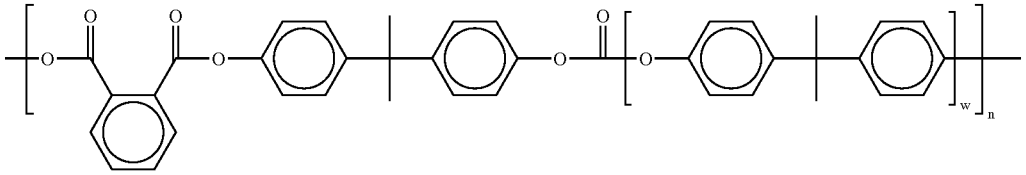

wherein w is an integer from about 1 to about 20, and n is the degree of polymerization.

The resulting CTL thus formulated according to the above descriptions of second CTL embodiment has the desired surface abhesiveness and contact friction reduction.

In a third CTL embodiment of present disclosure, the slippery CTL 40 of the imaging member is formulated by entirely replacing the conventional bisphenol type polycarbonate of formulas (A) to (E) binder with the low surface energy bisphenol type polycarbonate according to the formulas (I), (II), (III), or (IV) according to the descriptions in the first CTL embodiment above, and additionally incorporating from about 1 to about 10 weight percent of a POSS to give a hardness enhanced slippery CTL having surface abhesiveness and contact friction reduction.

In a fourth CTL embodiment of present disclosure, the slippery CTL 40 of the imaging member is formulated by only partially replacing the conventional bisphenol type polycarbonate of formulas (A) to (E) binder with a low surface energy bisphenol type polycarbonate of formulas (I), (II), (III), or (IV), in accordance with the second CTL embodiment description above except with the additional incorporation of a POSS additive to give a hardness enhanced slippery CTL having desired surface abhesiveness and contact friction reduction.

In a fifth CTL embodiment of present disclosure, the slippery CTL 40 of the imaging member is formulated by entirely replacing the conventional bisphenol type polycarbonate binder with a polymer blend comprising two types of low surface energy polycarbonates, in which the first low surface energy bisphenol type polycarbonate is a bisphenol type polycarbonate, according to those described in formulas (I), (II), (III), or (IV) above, and the second low surface energy polycarbonate is as those shown in formulas (V) to (XI) below, comprising a polyalkyl siloxane or a polyalkyl-polyaryl siloxane having a polycarbonate pendant group:

Formula (V)
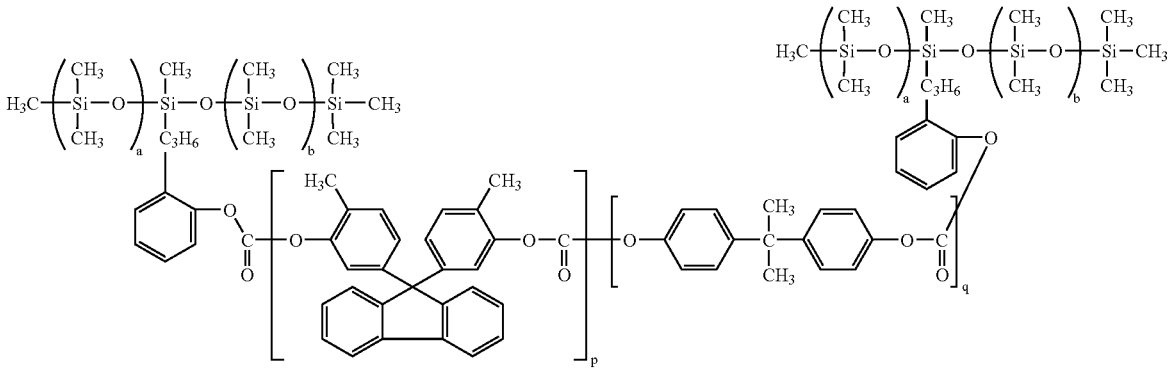
wherein a, b, p and q are integers representing a number of repeating units;
Formula (VI)
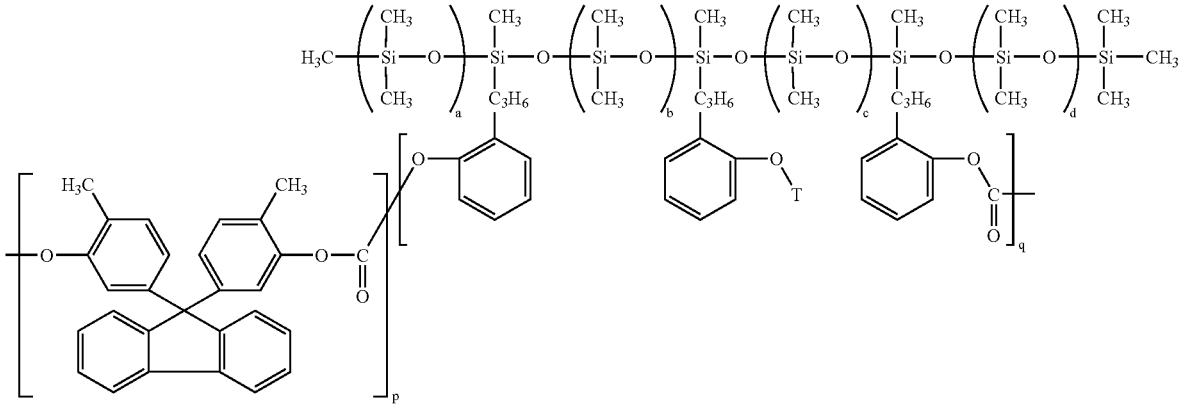
wherein a, b, c, d, p and q are integers representing a number of repeating units;
Formula (VII)
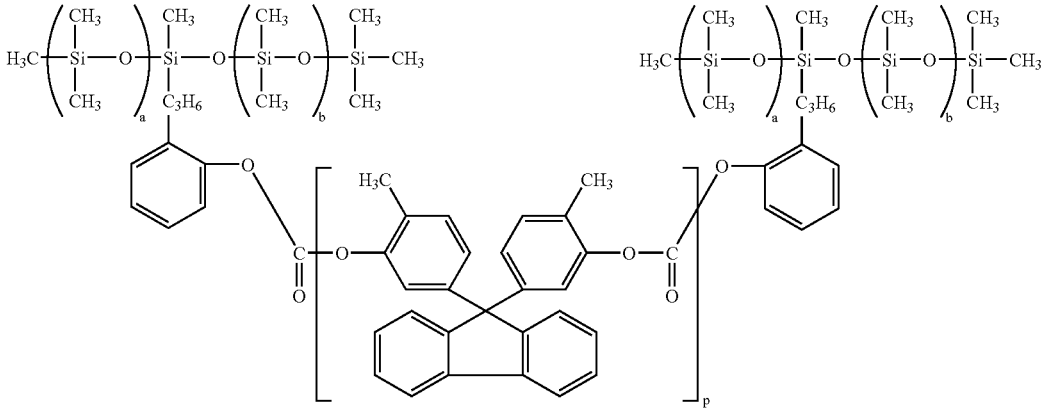
wherein a, b and p are integers representing the number of repeating units;

Formula (VIII)
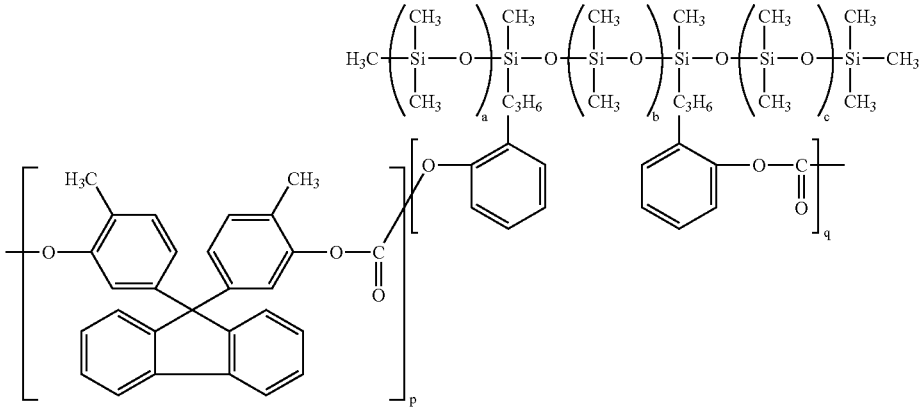
wherein a, b, c, p and q are integers representing the number of repeating units;
Formula (IX)
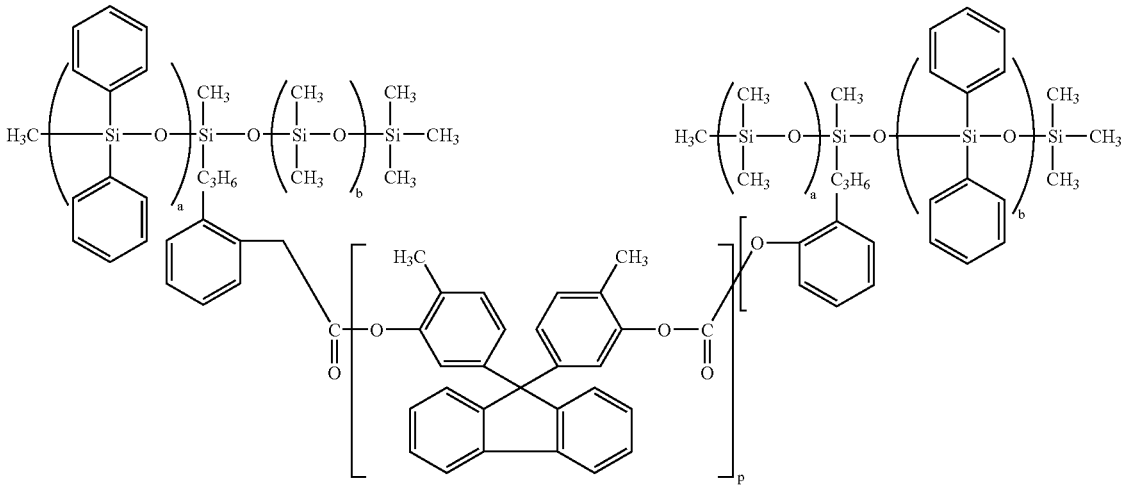
wherein the polymer has an polyalkyl and polyaryl siloxane main chain, and wherein a, b and p are integers representing the number of repeating units;
Formula (X)
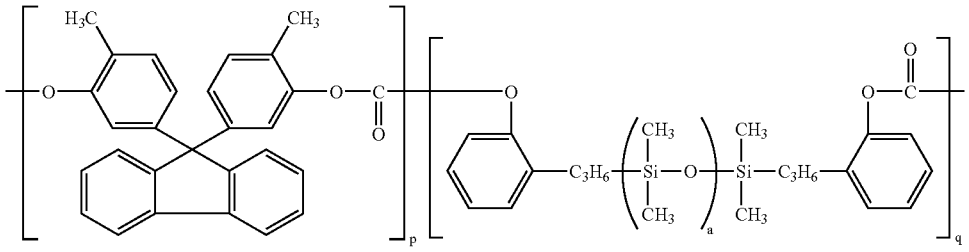
wherein a, p and q are integers representing the number of repeating units; and Formula (XI)

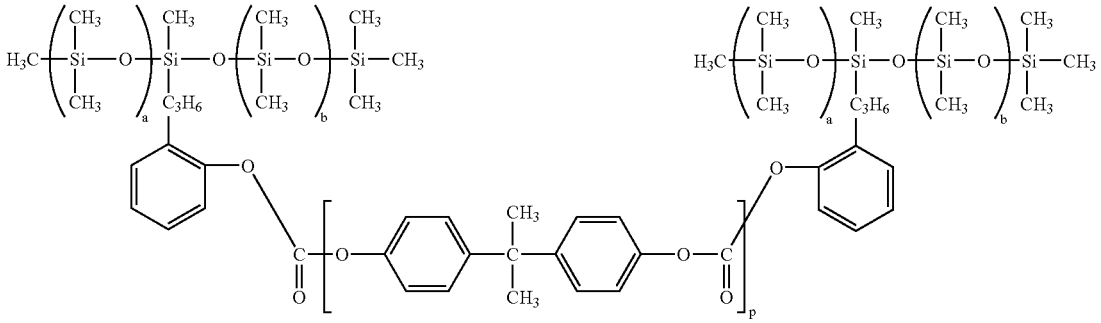

where a, b and p are integers representing the number of repeating units. The weight average molecular weight of the low surface energy polycarbonates of formulas (V) to (XI) is between about 20,000 and about 200,000.

The two low surface energy polymers blended binder in the reformulated slippery CTL 40 of this disclosure comprise a weight ratio of the first low surface energy polycarbonate to the second low surface energy polycarbonate in a range of from about 5:95 to about 95:5 to produce a slippery CTL having surface abhesiveness and contact friction reduction.

In a sixth CTL embodiment of present disclosure, the slippery CTL 40 of the imaging member is formulated by entirely replacing the conventional bisphenol type polycarbonate binder with a polymer blend consisting of two types of a low surface energy bisphenol type polycarbonates, in which the first low surface energy polymer is a modified bisphenol type polycarbonate polymer of formulas (I), (II), (III) or (IV), and the second low surface energy polymer is comprising a polyalkyl siloxane or a polyalkyl-polyaryl siloxane having a polycarbonate pendant group, according to those exact same formulations/compositions described in the above fifth CTL embodiment, but additionally including a POSS additive. The resulting CTL is a hardness enhanced slippery CTL having surface abhesiveness and contact friction reduction.

In a seventh CTL embodiment of present disclosure, the slippery CTL 40 of the imaging member is prepared, without utilizing the novel low surface energy polycarbonate, but by simply incorporating a specifically selected lubricating POSS additive containing low surface energy PDMS or PTFE pendant group (as shown below) into the material mixture matrix of charge transport compound and conventional bisphenol type polycarbonate of formulas (A) to (E) CTL to yield a slippery CTL having surface abhesiveness and contact friction reduction. The molecular structures of the conventional bisphenol type polycarbonates of formulas (A) to (E) and the respective Mw for the CTL application are the exact same polycarbonates described in detail according to the preceding second CTL embodiment; they have a molecular weight (Mw) of between about 20,000 and about 200,000.

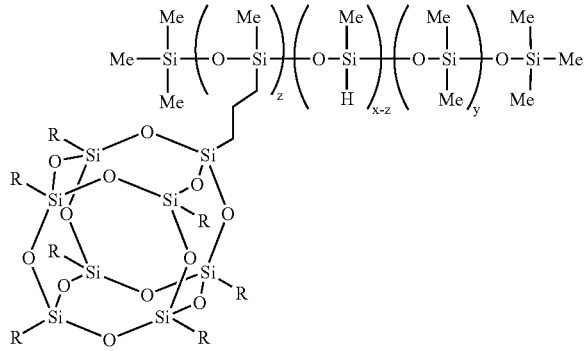

R = t-butyl, cyclopentyl, cyclohexyl, phenyl

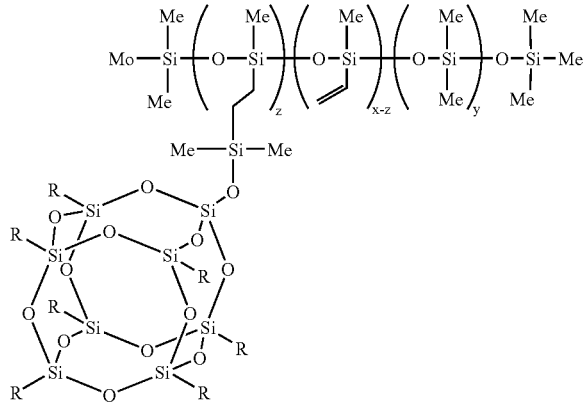

R = t-butyl, cyclopentyl, cyclohexyl, phenyl

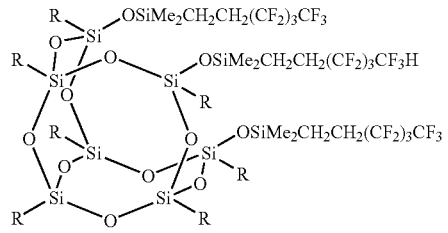

R = t-butyl, cyclopentyl

-continued

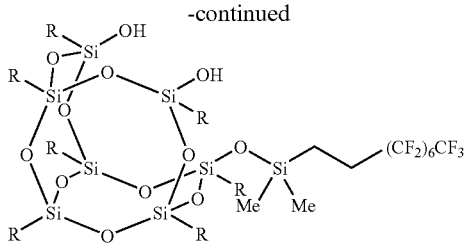

R = cyclopentyl

The typical thickness of the slippery CTL 40 can be from about 5 micrometers to about 100 micrometers; nonetheless, it is may also be from between about 15 micrometers and about 40 micrometers. However, the single layer CTL 40 may be designed to comprise of dual layer CTL or multiple layers. For multi-layered CTL, it will have different concentration of charge transporting components, in descending order, from the bottom layer to the top layer and with the slippery CTL disposed as the outermost exposed top layer. In the embodiments of imaging member having dual CTL, the exposed top slippery CTL layer has a thickness of from about equal to that of the bottom layer to about ⅕ of the thickness of the bottom layer.

In an eight CTL embodiment, the CTL is a dual layer CTL comprises a discrete bottom layer disposed on the BGL and a slippery outermost exposed top layer coated on the bottom layer. The bottom layer has the conventional material compositions, but the slippery top layer is formulated to comprise a charge transport compound and a binder consisting of a low surface energy modified bisphenol type polycarbonate which is formed from a group consisting of the modification of the various types of bisphenol polycarbonates, having a small fraction of polydimethyl siloxane in the polymer back bone as of the descriptive formulas (I), (II), (III) or (IV), according to the same material formulation disclosed in the preceding first CTL embodiment, to render surface abhesiveness and slippery property to the top layer.

In a ninth CTL embodiment, the CTL is a dual layer CTL. In the dual CTL, the bottom layer in the dual CTL has the conventional material compositions whereas the slippery top layer is formulated to comprise a charge transport compound and a binder of polymer blend comprising a conventional bisphenol type polycarbonate of formulas (A) to (E) and a low surface energy modified bisphenol type polycarbonate, which is formed from a group consisting of the modification of the various types of bisphenol polycarbonates of formulas (I), (II), (III) or (IV), according to the exact same material formulation disclosed in the preceding second CTL embodiment, to impact surface slipperiness to the top layer.

In a tenth CTL embodiment, the CTL is a dual layer CTL comprising a bottom layer of the conventional material compositions and a slippery top layer that is formulated to comprise a charge transport compound and a binder comprising a low surface energy polycarbonate of the modification of the various types of bisphenol polycarbonates having the descriptive formulas (I), (II), (III) or (IV), and additionally incorporating a POSS according to the very same material formulation disclosed in the preceding third CTL embodiment, to enhance hardness and render surface abhesiveness as well as slippery property to the top layer.

In an eleventh CTL embodiment, the CTL is a dual layer CTL comprising a bottom layer of the conventional material compositions and a slippery top layer that is formulated to comprise a charge transport compound and a binder consisting of polymer blending of a conventional bisphenol type polycarbonate of formulas (A) to (E) and a low surface energy polymer binder of modified bisphenol type polycarbonate of the formulas (I), (II), (III) or (IV), and plus the incorporation of a POSS according to the same material formulation disclosed in the preceding fourth CTL embodiment, to impact hardness enhancement as well as surface abhesiveness and as slippery property to the top layer.

In a twelfth CTL embodiment, the CTL is a dual layer CTL comprising a bottom layer of the conventional material compositions and a slippery top layer that is formulated to comprise a charge transport compound and a binder consisting of polymer blending of two types of low surface energy polycarbonate—the first one being a low surface energy modified polycarbonate as described in formulas (I), (II), (III) or (IV), and the second polymer being a low surface energy polymer, as those shown in formulas (V) to (IX), comprising a polyalkyl siloxane or a polyalkyl-polyaryl siloxane having a polycarbonate pendant group, according to the material formulation disclosed in the preceding fifth CTL embodiment, to render surface abhesiveness and slippery property to the top layer.

In a thirteenth CTL embodiment, the CTL is a dual layer CTL comprising a bottom layer of the conventional material compositions and a slippery top layer that is formulated to comprise a charge transport compound and a binder consisting of polymer blending of two types of low surface energy polycarbonate—the first one is a low surface energy modified bisphenol type polycarbonate as described in formulas (I), (II), (III), or (IV), while the second polymer is a low surface energy polymer, as those shown in formulas (V) to (IX), comprising a polyalkyl siloxane or a polyalkyl-polyaryl siloxane having a polycarbonate pendant group. This embodiment further includes a POSS additive, but is otherwise made in accordance with the material formulation disclosed in the preceding sixth CTL embodiment, to enhance hardness and render surface abhesiveness as well as slippery property to the top layer.

In a fourteenth CTL embodiment, the CTL is a dual layer CTL comprising a bottom layer of the conventional material compositions and a slippery top layer that is formulated (without the use of a low surface energy polycarbonate) to comprise a charge transport compound and a conventional bisphenol type polycarbonate of formulas (A) to (E) binder and further including one of the selected low surface energy POSS additives. The selection of low surface energy POSS is based on the specific lubricating POSS species containing either a polysiloxane (PDMS) or a polytetrafluoroethylene (PTFE) pendant group in its chemical structure to impact lubricity, according to the material formulation disclosed in the preceding seventh CTL embodiment, to impart hardness and slipperiness to the resulting top layer.

As an alternative to the use of two discretely separated layers of CTL 40 and CGL 38, a structurally simplified electrophotographic imaging member, as shown in FIG. 3, may be created by combining these two layers (with other layers remain unchanged) into a single imaging layer 22 having both charge transporting and charge generating capabilities which thereby eliminates the need of the two separate layers. The imaging layer 22 may comprise a single electrophotographically active layer capable of retaining an electrostatic charge in the dark during electrostatic charging, imagewise exposure and image development, as disclosed, for example, in U.S. Pat. No. 6,756,169. The single imaging layer 22 may include charge transport molecules in a binder consisting of a single film forming polymer or a blending of two film forming polymers according to those of the slippery CTL 40, and optionally, it may further include a photogenerating/photoconductive material, similar to those of the layer 38 described above. In accordance to the aspect of the present disclosure, the single layer 22 is formulated to give a slippery layer by following the exact same preparation method, material compositions, and details description of the preceding embodiments.

In an extended CTL embodiment, the outermost exposed top slippery CTL (either being a single or dual layer CTL) of the imaging member may further contain inorganic or organic fillers to enhance wear resistance. Inorganic fillers may include, but are not limited to, silica, metal oxides, metal carbonate, metal silicates, and the like. Examples of organic fillers include, but are not limited to, KEVLAR, stearates, fluorocarbon (PTFE) polymers such as POLYMIST and ZONYL, waxy polyethylene such as ACUMIST and ACRAWAX, fatty amides such as PETRAC erucamide, oleamide, and stearamide, and the like. Either micron-sized or nanosized inorganic or organic particles can be used in the fillers to achieve mechanical property reinforcement. Additionally, the disclosure also relates to the inclusion in the CTL of variable amounts of an antioxidant, such as a hindered phenol. Exemplary hindered phenols include octadecyl-3,5-di-tert-butyl-4-hydroxyhydrocinnamate, available as IRGANOX I-1010 from Ciba Specialty Chemicals. The hindered phenol may be present at up to about 10 weight percent based on the total weight of the dried CTL. Other suitable antioxidants are described, for example, in above-mentioned U.S. Pat. No. 7,018,756, which is hereby incorporated by reference.

The Overcoat Layer

Since the outermost exposed top CTL 40 of traditional design is highly susceptible to physical/mechanical failures during function, a robust overcoat layer 42 may optionally be utilized and coated directly over the CTL to provide protection and resolve the CTL associated shortcoming and issues. To achieve robust physical/mechanical function, the overcoat is formulated to comprise: (a) a slippery low surface energy polymer layer; (b) a nano composite layer containing from about 1 to about 10 weight percent of a POSS in a slippery low surface polymer matrix, (c) a slippery surface of conventional bisphenol type polycarbonate matrix containing a lubricating slip agent and an ozone suppressing agent, and (d) a slippery conventional bisphenol type polycarbonate matrix containing a lubricating slip agent, a selected low surface energy POSS, and an ozone suppressing agent. The thickness of the slippery overcoat is from about 1 to about 10 micrometers, or about 2 to about 6 micrometers, and contains between about none and about 10 weight percent of charge transport compound.

In a first overcoat embodiment of present disclosure, the overcoat 42 disposed onto the CTL 40 is formulated to comprise a low surface energy bisphenol type polycarbonate, according to the formulas (I), (II), (III), or (IV) description above and including from about 1 to about 10 weight percent of a POSS, based on the total weight of the overcoat, to give a hardness enhanced slippery overcoat having surface abhesiveness and contact friction reduction.

In a second overcoat embodiment of present disclosure, the overcoat 42 is formulated with a polymer blend consisting of two types of low surface energy polycarbonates, in which the first low surface energy polycarbonate is a bisphenol type polycarbonate, according to those described in formulas (I), (II), (III), or (IV) and the second low surface energy polycarbonate, as those shown in formulas (V) to (IX), is comprising a polyalkyl siloxane or a polyalkyl-polyaryl siloxane having a polycarbonate pendant group according to the description in the preceding CTL embodiments. The blending of these two low surface energy polymers in the formulated overcoat 42 of this disclosure is comprised of a weight ratio of the first polymer to the second polymer in a range of between 5:95 and about 95:5 to produce a slippery overcoat having surface abhesiveness and contact friction reduction.

In a third overcoat embodiment of present disclosure, the overcoat 42 is formulated with a polymer blend comprising the very same two types of a low surface energy bisphenol polycarbonates by following the exact same procedures and using exact same materials/compositions as described in the second overcoat embodiment above, but/and with the incorporation of about 1 to about 10 weight percent of a POSS additive based on the total weight of the overcoat. The prepared overcoat 42 is a hardness enhanced slippery layer and has surface abhesiveness and contact friction reduction.

In a fourth overcoat embodiment, the overcoat 42 having the slipperiness property (but without utilizing the low surface energy polymers) is prepared from a mixture of materials that comprises a conventional but particularly selected (ultra high molecular weight) bisphenol type polycarbonate, an ozone suppression oligomeric liquid, and an effective lubricating slip agent to render slippery surface. The ultra high molecular weight bisphenol polycarbonate, though being the very same ones of formulas (A) to (E) used for CTL binder application in the preceding second and seventh CTL embodiments, but with the exception that it is particularly chosen to have an ultra high molecular weight (Mw) of at least 200,000 (in a particular embodiment at least 230,000) to effect and ensure robust overcoat mechanical function. The ultra high Mw bisphenol type polycarbonates selected for the fourth overcoat embodiment disclosure application are those of formulas (A) through (E), as described above.

The ozone suppression oligomeric liquid employed for the overcoat application is: (a) a diethylene glycol bis(allyl carbonate) represented by Formula (1):

FORMULA (1)

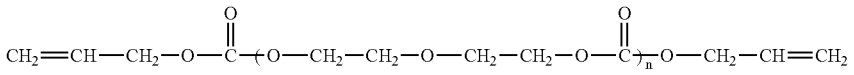

FORMULA (2)

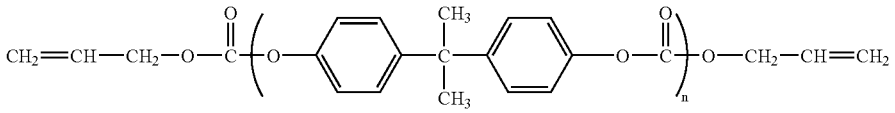

wherein n is an integer from about 1 to about 6; (b) a bis(allyl carbonate) of Bisphenol A shown as Formula (2) below: wherein n is an integer from about 1 to about 6. In a specific embodiment, n=1 and the liquid oligomer carbonate is bis (allyl carbonate) of bisphenol A; and/or (c) a polystyrene represented by Formula (3) below:

FORMULA (3)

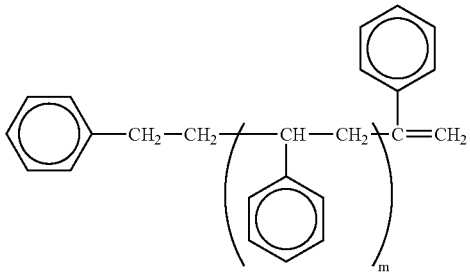

wherein m is the degree of polymerization and m is an integer from about 3 to about 10.

The slip agent to effect surface lubrication is a liquid polyester modified polysiloxane represented by Formula (4) below:

FORMULA (4)

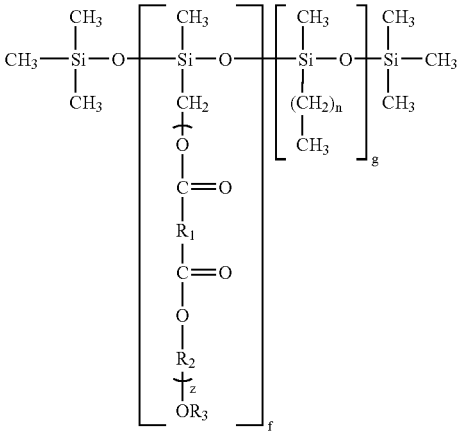

wherein $R_1$ and $R_2$ are independently selected from alkylene groups containing from 1 to 10 carbon atoms; $R_3$ is hydrogen or alkyl having 1 to 3 carbon atoms; n is an integer from 0 to 10; f and g are independently integers from 5 to 500; and z is an integer from 1 to 30.

The amount of each additive incorporated for preparation of the slippery overcoat 42 is between about 1 and about 10 weight percent ozone suppression compound and from about 0.1 to about 2 weight percent slip agent, respectively, based on the total weight of the prepared overcoat 42. As a consequence, the ozone suppression agent does minimizes polycarbonate degradation by chain scission, while the slip agent lowers the overcoat's surface energy to give slippery surface and render abhesiveness.

In a fifth overcoat embodiment, the slippery overcoat 42 (formulated without utilizing the low surface energy polymers) having enhanced hardness is prepared from a mixture of materials that comprises a conventional but particularly selected (ultra high molecular weight) bisphenol type polycarbonate, an ozone suppression oligomeric liquid, and an effective lubricating slip agent, in accordance to the same procedures and the same material of embodiment fourth above, except that a POSS additive is included in the overcoat 42 formulation. In particular embodiments, the POSS additive used in particular embodiments are those with low surface energy PDMS or containing PTFE for imparting maximum surface lubricity. The amount of POSS incorporation into the layer ranges from about 1 to about 10 weight percent based on the total weight of the prepared overcoat of this disclosure.

Additionally, further aspects of the disclosed embodiments also relate to the inclusion of between about 1 and about 10 weight percent in the overcoat 42 with nanoparticles dispersion, such as silica, metal oxides, ACUMIST (waxy polyethylene particles), PTFE, and the like. The nanoparticles is be used to further amplify and maximize the surface lubricity for added wear resistance of the outermost exposed overcoat layer.

The Anti-Curl Back Coating

Typical ACBC layer 33 is optically transparent—it transmits at least about 98 percent of incident light energy through the layer. The conventional ACBC is typically comprised of a film forming bisphenol type polycarbonate, generally the same one as that used in the CTL 40, and about 1 to 10 weight percent of a co-polyester adhesion promoter, based on the total weight of the ACBC, to give good adhesion bonding with the substrate 32. The ACBC 33 may generally have a Young's Modulus in the range of from about $2.0\times10^5$ psi ($1.7\times10^4$ Kg/cm$^2$) to about $4.5\times10^5$ psi ($3.2\times10^4$ Kg/cm$^2$), a glass transition temperature (Tg) of at least 90° C., and/or a thermal contraction coefficient of from about $6\times10^{-5}$ PC to about $8\times10^{-5}$/° C. to approximately match those properties of the CTL to provide adequate anti-curling result.

Typically, the film-forming polymer for the ACBC preparation is a bisphenol A polycarbonate, having a weight average molecular weight Mw of from about 20,000 to about 200,000 are suitable for use. Specifically, polycarbonates having a molecular weight (Mw) of from about 50,000 to about 120,000 are used for forming a coating solution having proper viscosity for easy ACBC application. Polycarbonate candidates suitable for use in the inner layer may include a bisphenol A polycarbonate of poly(4,4'-dipropylidene-diphenylene carbonate) with a Mw of from about 35,000 to about 40,000, available as LEXAN 145 from General Electric Company; poly(4,4'-isopropylidene-diphenylene carbonate) with a molecular weight of from about 40,000 to about 45,000, available as LEXAN 141 from the General Electric Company; and a polycarbonate resin having a molecular weight of from about 20,000 to about 50,000 available as MERLON from Mobay Chemical Company.

The slippery ACBC 33 of this disclosure may be formulated with the use of low surface energy polycarbonates having similar physical/mechanical/thermal properties to those of the conventional bisphenol type polycarbonates to achieve equivalent counter curling effect for imaging member flatness. The slippery ACBC 33 may also contain a co-polyester adhesion promoter to render adhesion bonding to substrate 32. The adhesion promoter may comprise from about 1 to about 10 and from about 2 to about 10 weight percent of layer, based on the total weight of the ACBC layer 33. The adhesion promoter may be any known in the art, such as for example, VITEL PE2200 which is available from Bostik, Inc. (Middleton, Mass.). VITEL PE2200 is a copolyester resin of terephthalic acid and isophthalic acid with ethylene glycol and dimethyl propanediol. A typical ACBC coating or layer 33 is of from about 5 to about 80 micrometers, and from about 10 to about 20 micrometers, in thickness is found to be adequately sufficient for balancing the curl and rendering the imaging member flat.

In a first ACBC embodiment, the slippery ACBC 33 of this disclosure is formulated to comprise a low surface energy bisphenol type polycarbonate, about 1 to about 10 weight percent of a copolyester adhesion promoter, and with about 1 to 10 weight percent of a POSS additive, all based on the total weight of the ACBC. Regarding the low surface energy polycarbonate of modified bisphenol type polycarbonate polymer, the polymer is formed and selected from the group consisting of modified bisphenol A polycarbonate of poly(4,4'-isopropylidene diphenyl carbonate) having a small fraction of polydimethyl siloxane in the polymer back bone and having the following formula (I):

Formula (I)

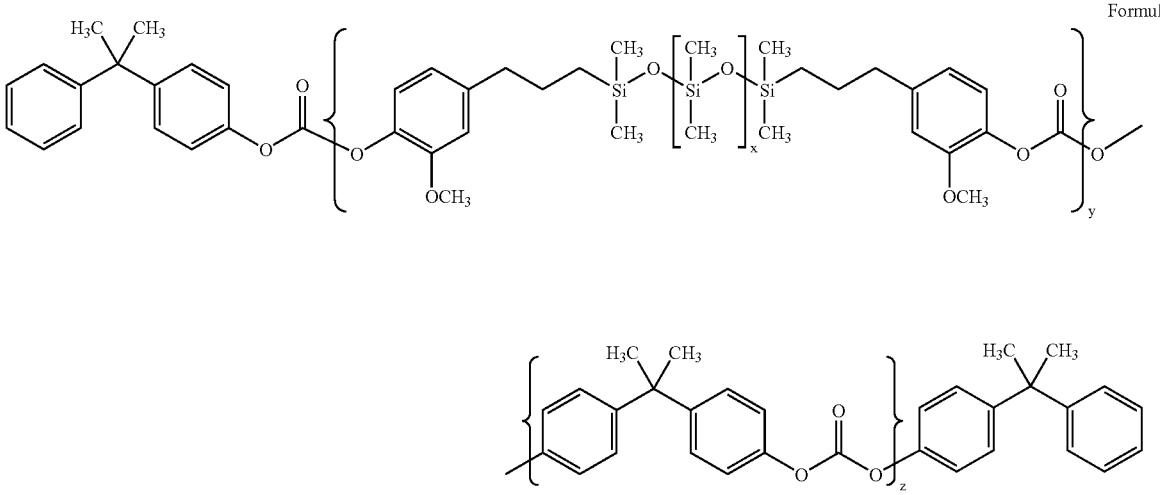

wherein x is an integer between about 40 and about 50 while y and z are integers representing a number of the respective repeating units; a modified bisphenol Z polycarbonate of poly(4,4'-diphenyl-1,1'-cyclohexane carbonate) having a small fraction of polydimethyl siloxane in the polymer back bone and having the following formula (II):

Formula (II)

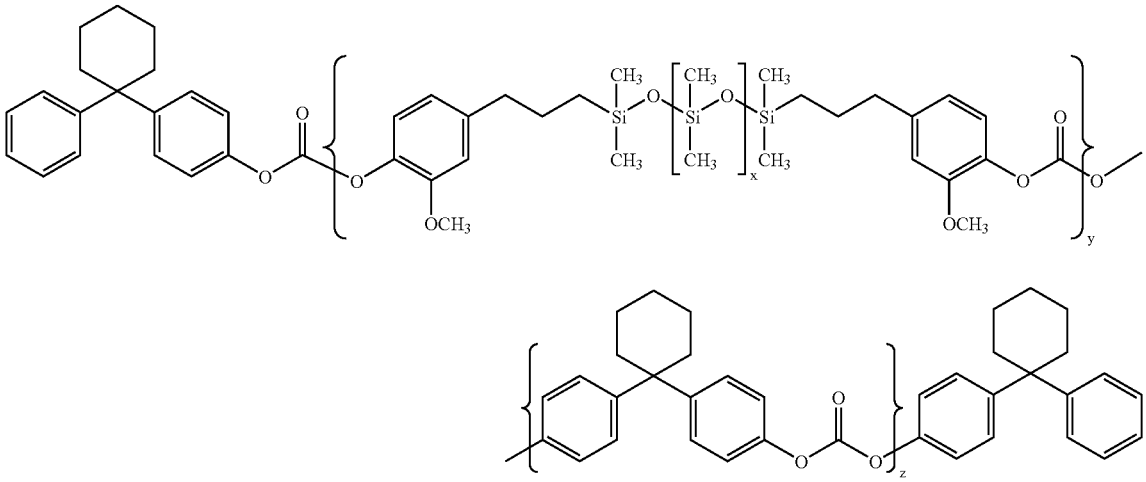

wherein x is an integer between about 40 and about 50 while y and z are integers representing a number of the respective repeating units; a modified bisphenol C polycarbonate derived from the modification of poly(4,4'-isopropylidene diphenyl carbonate) having a small fraction of polydimethyl siloxane in the polymer back bone and having the following formula (III):

Formula (III)

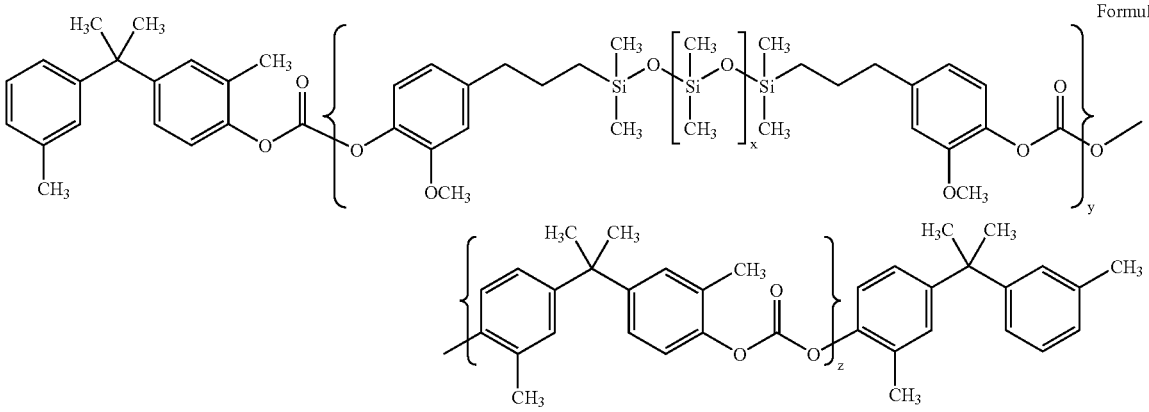

wherein x is an integer between about 40 and about 50 while y and z are integers representing a number of the respective repeating units; and a modification of the modified bisphenol Z polycarbonate of poly(4,4'-diphenyl-1,1'-cyclohexane carbonate) having a small fraction of polydimethyl siloxane in the polymer back bone and having the following formula (IV):

Formula (IV)

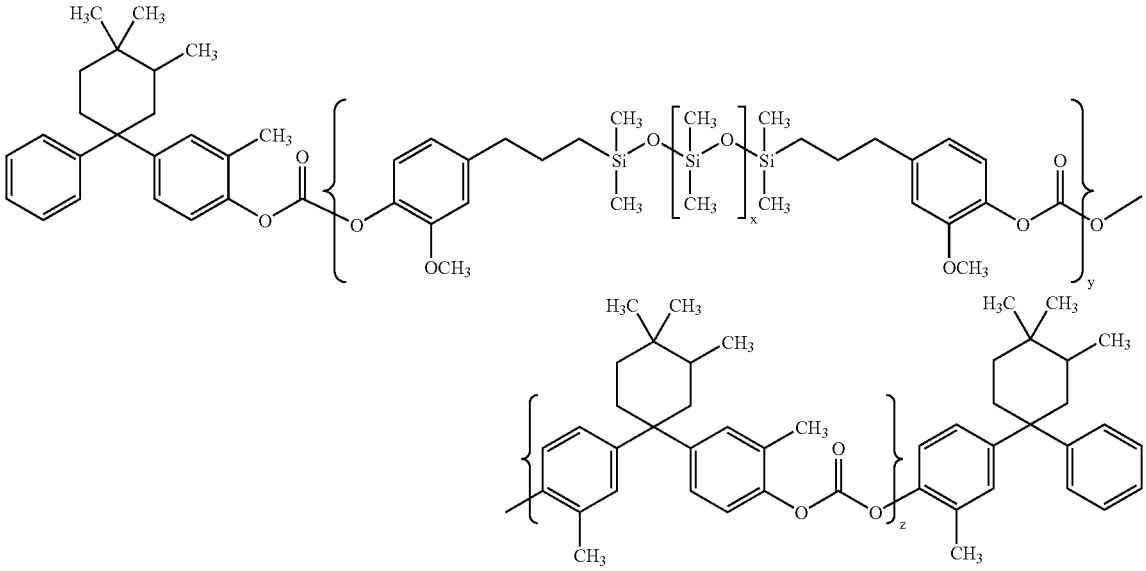

wherein x is an integer between about 40 and about 50 while y and z are integers representing a number of the respective repeating units, and mixtures thereof. The weight average molecular weight of the low surface energy bisphenol type polycarbonates of formulas (I) to (IV) is between about 20,000 and about 200,000.

In a second ACBC embodiment of present disclosure, the slippery ACBC 33 is formulated with a polymer blend consisting of the low surface energy modified polycarbonate polymer selected from the group consisting of formulas (I), formula (II), formula (III) and formula (IV) and a bisphenol type polycarbonate having a molecular weight of between about 20,000 and about 200,000 and being selected from the group consisting of a bisphenol A polycarbonate of poly(4,4'-isopropylidene diphenyl) carbonate having the following formula (A):

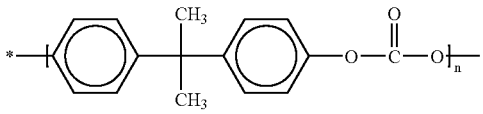

wherein n indicates each respective degree of polymerization, a modified bisphenol A polycarbonate of poly(4,4'-isopropylidene diphenyl) carbonate having the following formula (B):

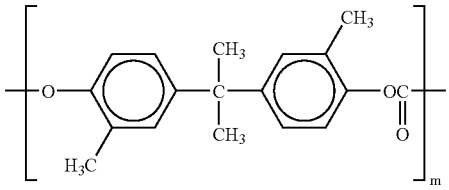

wherein m indicates each respective degree of polymerization, a bisphenol Z polycarbonate of poly(4,4'-diphenyl-1,1'-cyclohexane) carbonate having the following formula (C):

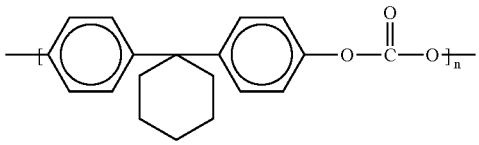

wherein n indicates each respective degree of polymerization, a modified bisphenol Z polycarbonate of poly(4,4'-diphenyl-1,1'-cyclohexane) carbonate having the following formula (D):

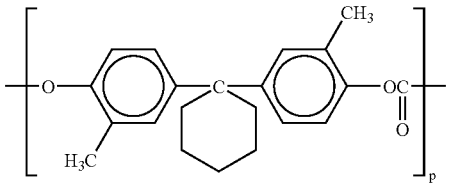

wherein p indicates each respective degree of polymerization, a phthalate-bisphenol A polycarbonate having the following formula (E):

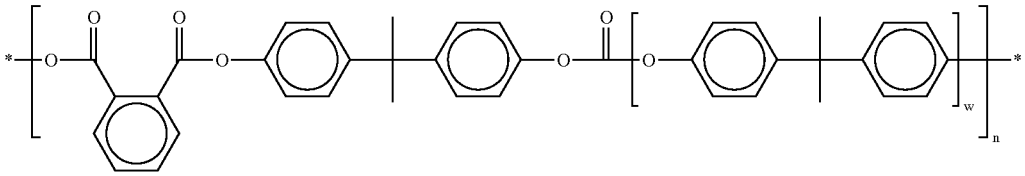

wherein w is an integer from about 1 to about 20 and n is the degree of polymerization, and mixtures thereof, an adhesion promoter, and a POSS additive.

In a third ACBC embodiment of present disclosure, the slippery ACBC 33 is formulated with a polymer blend consisting of two types of low surface energy polycarbonates, and a copolyester adhesion promoter. The first low surface energy polycarbonate is a bisphenol type polycarbonate, according to those described in formulas (I), (II), (III), or (IV) above, and the second low surface energy polycarbonate is one of those shown in formulas (V) to (IX), comprising a polyalkyl siloxane or a polyalkyl-polyaryl siloxane having a polycarbonate pendant group.

The blending of the two low surface energy polymers in the formulated slippery ACBC 33 of this disclosure, in particular, the slippery ACBC 33 is formulated with a polymer blend consisting of the low surface energy modified polycarbonate polymer selected from the group consisting of formulas (I), formula (II), formula (III) and formula (IV) and a bisphenol type polycarbonate according to those of formulas formula (A), (B), (C), (D), (E) or mixtures thereof, comprises a weight ratio of the first low surface energy polycarbonate to the second low surface energy polycarbonate in a range of from about 5:95 to about 95:5 to produce a slippery ACBC having surface abhesiveness and contact friction reduction.

In a fourth ACBC embodiment of present disclosure, the ACBC 33 is formulated with a polymer blend consisting of the very same two types of a low surface energy polycarbonates and a copolyester, by following the same procedures and same materials/compositions as described in the third ACBC embodiment, except that the ACBC layer further includes from about 1 to about 10 weight percent of a POSS additive based on the total weight of the overcoat. The prepared ACBC 33 is a hardness enhanced slippery layer and has surface abhesiveness and contact friction reduction.

In a fifth ACBC embodiment, the ACBC 33 of this disclosure (having the slipperiness property, but without utilizing the low surface energy polycarbonate) is formulated to comprise a conventional bisphenol type polycarbonate of formulas (A) to (E), a copolyester adhesion promoter, an ozone suppression oligomeric liquid of formulas (1) to (3), an effective lubricating slip agent of formula (4), and incorporation of a POSS to give a hardness enhanced slippery ACBC. The conventional bisphenol type polycarbonates that are suitable for ACBC disclosure application has molecular weight (Mw) of between about 20,000 and about 200,000 which are the very exact same ones of formulas (A) to (E) described for CTL binder application in the preceding second and seventh CTL embodiments. These conventional bisphenol type polycarbonates are those of formulas (A) through (E), as described above. The ozone suppression oligomeric liquid employed for the ACBC application are those of formulas (1) through (3), as described above. The slip agent employed for the ACBC application is a liquid polyester of modified low surface energy polysiloxane represented by formula (4), as described above.

The amount of each additive incorporated for creation of the slippery ACBC 33 of fifth ACBC embodiment above should have between about 1 and about 10 weight percent for ozone suppression compound, from about 0.1 to about 2 weight percent slip agent, about 1 to 10 weight percent copolyester, and about 1 to about 10 weight percent POSS, based on the total weight of the prepared ACBC 33. As a consequence, the ozone suppression agent minimizes polycarbonate degradation due to chain scission, while the slip agent lowers the ACBC surface energy to give slippery surface and render abhesiveness.

In alternative aspects of the present disclosure, the ACBC layer of the flexible electrophotographic imaging member is comprised of a dual layer ACBC, comprising an inner layer 35 and an outer layer 37, according to the illustration shown in FIG. 2, and with the outer layer 37 being the exposed bottom slippery ACBC. The total thickness of the dual layer ACBC is from about 5 to about 80 micrometers, or from about 10 to about 20 micrometers, in thickness to be adequately sufficient for balancing the curl and rendering the imaging member with desired flatness. Both the inner and the outer layers may have the same thickness, but may also have variances such that the outer exposed layer 37 is of from about equal to the inner layer to about ⅕ the thickness of the inner (top) layer 35. The inner layer 35 comprises a copolyester adhesion promoter and a film forming polymer which is different from the slippery outer layer 37. The film forming polymer in the inner layer 35 is generally the same polymer used in the CTL and is prepared in the same manners, using similar materials/compositions as that of the conventional ACBC. Typical film forming polymers suitable for the inner layer 35 include polycarbonate, polyester, polyarylate, polyacrylate, polyether, polysulfone, polystyrene, polyamide, and the like.

Although the inner layer 35 does require an adhesion promoter to enhance bonding of the inner layer to the substrate 32, an adhesion promoter may be omitted for the formation of the outer layer 37 in the event that it is fusion bonded to the inner layer 35. The adhesion promoter may comprise from about 1 to about 20 and from about 2 to about 10 weight percent of layer, based on the total weight of the inner ACBC layer 35. The adhesion promoter may be any known in the art, such as for example, VITEL PE2200 which is available from Bostik, Inc. (Middleton, Mass.). VITEL PE2200 is a copolyester resin of terephthalic acid and isophthalic acid with ethylene glycol and dimethyl propanediol.

In a sixth ACBC embodiment, the inner layer 35 of the dual layer ACBC is prepared to comprise a conventional bisphenol type polycarbonate and an adhesion promoter, while the outer layer 37 is formulated to comprise a low surface energy polycarbonate and a POSS additive. The inner layer 35 is prepared from a mixture of materials that includes a conventional film forming bisphenol type polycarbonate of formulas (A) to (E) and a copolyester adhesion promoter. The conventional bisphenol type polycarbonates that are suitable and selected for the inner layer 35 preparation are any one of formulas (A) to (E) used as CTL binder in the preceding second and seventh CTL embodiments. The conventional bisphenol type polycarbonates for the seven CTL application have a molecular weight (Mw) of between about 20,000 and about 200,000.

The slippery outer layer 37 is formulated with the use of a low surface energy bisphenol type polycarbonate according to those of formulas (I), (II), (II), or (IV) and including a POSS additive, an ozone suppression oligomeric liquid of formulas (1) to (3), and an effective lubricating slip agent of formula (4), in accordance with the preceding first ACBC embodiment, except that adhesion promoter is omitted. Since the outer layer is fusion bonded strongly to the inner layer (practically inseparable), no adhesion promoter addition is required in the outer layer 37. The resulting outer layer 37 is from about equal to the inner layer to about ⅕ the thickness of inner layer 35 and gives a slippery/abhesive surface.

In a seventh ACBC embodiment, the dual layer ACBC has an inner layer 35 comprising identical materials/composition as the inner layer of the sixth ACBC embodiment, while the outer layer 37 is formulated to comprise a polymer blend consisting of the low surface energy modified polycarbonate polymer selected from the group consisting of formulas (I), formula (II), formula (III) and formula (IV) and a bisphenol type polycarbonate of formulas (A), (B), (C), (D), or (E), and a POSS additive in the exact same compositions as those described in the preceding second ACBC embodiment. The composition of the polymer blend in the outer layer has a weight ratio of the low surface energy polymer to the bisphenol type polycarbonate in the range of from about 5:95 to about 95:5. The prepared outer layer ACBC 37, with no adhesion promoter addition, bonds strongly to the inner layer 35 and has a slippery surface.

In an eighth ACBC embodiment, dual layer ACBC has an inner layer 35 comprising identical materials/composition as the inner layer of the sixth ACBC embodiment, while the outer layer 37 is formulated to comprise a polymer blend of two types of low surface energy polycarbonates, in which the first low surface energy polycarbonate is a bisphenol type polycarbonate of formulas (I), (II), (III) or (IV) and the second low surface energy polycarbonate is selected from the formulas (V) to (XI), in accordance with the same manner as the preceding third ACBC embodiment, except that adhesion promoter is omitted since it is fusion bonded to the inner layer. The composition of the polymer blend in the outer layer has a weight ratio of the first low surface energy polymer to the second low surface energy polymer in the range of from about 5:95 to about 95:5. The prepared outer layer ACBC 37, with no adhesion promoter addition, has a slippery and abhesive surface.

In a ninth ACBC embodiment, the inner layer 35 of the dual layer ACBC has the same materials/compositions as the inner layer of the sixth ACBC embodiment above, while the outer layer 37 (fusion bonded to the inner layer 35) is formulated to comprise a blending of the two very same low surface energy polymers of formulas (I), (II), (III), or (IV) and formulas (V) to (IX), in accordance with the above fourth ACBC embodiment, except that the adhesion promoter is omitted and contains from about 1 to about 10 weight percent of a POSS additive is incorporated in the outer layer. The formulated outer layer ACBC 37 has enhanced hardness and gives a slippery and abhesive surface.

In an tenth ACBC embodiment, the dual layer ACBC has an inner layer 35 comprising the same materials/composition to the inner layer of the sixth ACBC embodiment above, while the slippery outer layer 37 (fusion bonded to the inner layer 35) is formulated to comprise a conventional bisphenol type polycarbonate of formulas (A) to (E), an ozone suppression oligomeric liquid of formulas (1) to (3), an effective lubricating slip agent of formula (4), and plus the incorporation of a POSS to give a hardness enhanced slippery top ACBC 37 in the same manner and material compositions as described in the preceding fifth ACBC embodiment, except that low surface energy polycarbonate and adhesion promoter are excluded from the formulation.

In the extended ACBC embodiments, the slippery ACBC formulated according to the present disclosure may further include other additive materials, such as a PTFE particulates or silica dispersion to further maximize its abrasion/wear resistance. In these embodiments, the additive materials may be either included in a slippery single layer ACBC 33 or be included in the slippery outer layer 37 of the dual ACBC layer.

For the preparation of a physically/mechanically improved flexible electrographic imaging member, a slippery single dielectric layer overlying the conductive layer of a substrate support may be used to replace all the active photoconductive layers. Any suitable, conventional, flexible, electrically insulating, thermoplastic dielectric polymer matrix material may be used in the dielectric layer of the electrographic imaging member. If required, the flexible electrographic belts may use the single slippery ACBC coating, or dual layer ACBC comprising a slippery top layer and a conventional inner layer, of this disclosure to provide belt flatness as well as robust mechanical function where cycling durability is important.

An imaging member according to the present disclosure may be used for imaging by depositing a uniform electrostatic charge on the imaging member, exposing the imaging member to activating radiation in image configuration to form an electrostatic latent image, and developing the latent image with electrostatically attractable marking particles to form a toner image in conformance to the latent image.

The development of the present disclosure will further be illustrated in the following non-limiting working examples. The examples set forth herein below are illustrative of different compositions and conditions that can be used in practicing the invention. All proportions are by weight unless otherwise indicated. It will be apparent, however, that the innovative description can be practiced with many types of compositions and can have many different uses in accordance with the disclosures above and as pointed out hereinafter.

EXAMPLES

Control Example

A conventional flexible electrophotographic imaging member web was prepared by providing a 0.02 micrometer thick titanium layer coated on a substrate of a biaxially oriented polyethylene naphthalate substrate (KADALEX, available from DuPont Teijin Films) having a thickness of 3.5 mils (89 micrometers). The titanized KADALEX substrate was extrusion coated with a blocking layer solution containing a mixture of 6.5 grams of gamma aminopropyltriethoxy silane, 39.4 grams of distilled water, 2.08 grams of acetic acid, 752.2 grams of 200 proof denatured alcohol and 200 grams of heptane. This wet coating layer was then allowed to dry for 5 minutes at 135° C. in a forced air oven to remove the solvents from the coating and form a crosslinked silane blocking layer. The resulting blocking layer had an average dry thickness of 0.04 micrometers as measured with an ellipsometer.

An adhesive interface layer was then extrusion coated by applying to the blocking layer a wet coating containing 5 percent by weight based on the total weight of the solution of polyester adhesive (MOR-ESTER 49,000, available from Morton International, Inc.) in a 70:30 (v/v) mixture of tetrahydrofuran/cyclohexanone. The resulting adhesive interface layer, after passing through an oven, had a dry thickness of 0.095 micrometers.

The adhesive interface layer was thereafter coated over with a charge generating layer. The charge generating layer dispersion was prepared by adding 1.5 gram of polystyrene-co-4-vinyl pyridine and 44.33 gm of toluene into a 4 ounce glass bottle. 1.5 grams of hydroxygallium phthalocyanine Type V and 300 grams of ⅛-inch (3.2 millimeters) diameter stainless steel shot were added to the solution. This mixture was then placed on a ball mill for about 8 to about 20 hours. The resulting slurry was thereafter coated onto the adhesive interface by extrusion application process to form a layer having a wet thickness of 0.25 mils. However, a strip of about 10 millimeters wide along one edge of the substrate web stock bearing the blocking layer and the adhesive layer was deliberately left uncoated by the charge generating layer to facilitate adequate electrical contact by a ground strip layer to be applied later. The wet charge generating layer was dried at 125° C. for 2 minutes in a forced air oven to form a dry charge generating layer having a thickness of 0.4 micrometers.

This coated web stock was simultaneously coated over with a charge transport layer (CTL) and a ground strip layer by co-extrusion of the coating materials. The charge transport layer was prepared by combining MAKROLON 5705, a bisphenol A polycarbonate thermoplastic having a molecular weight of about 120,000, commercially available from Farbensabricken Bayer A. G., with a charge transport compound N,N'-diphenyl-N,N'-bis(3-methylphenyl)-[1,1'-biphenyl]-4,4'-diamine in an amber glass bottle in a weight ratio of 1:1 (or 50 weight percent of each).

The resulting mixture was dissolved to give 15 percent by weight solid in methylene chloride. This solution was applied on the charge generating layer by extrusion to form a coating which upon drying in a forced air oven gave a single layer CTL of 29 micrometers in thickness.

The strip, about 10 millimeters wide, of the adhesive layer left uncoated by the charge generating layer, was coated with a ground strip layer during the co-extrusion process. The ground strip layer coating mixture was prepared by combining 23.81 grams of polycarbonate resin (MAKROLON 5705, available from Bayer A.G.) and 332 grams of methylene chloride in a carboy container. The container was covered tightly and placed on a roll mill for about 24 hours until the polycarbonate was dissolved in the methylene chloride. The resulting solution was mixed for 15-30 minutes with about 93.89 grams of graphite dispersion (12.3 percent by weight solids) of 9.41 parts by weight of graphite, 2.87 parts by weight of ethyl cellulose and 87.7 parts by weight of solvent (Acheson Graphite dispersion RW22790, available from Acheson Colloids Company) with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion with the charge transport layer, to the electrophotographic imaging member web to form an electrically conductive ground strip layer having a dried thickness of about 19 micrometers.

The imaging member web stock containing all of the above layers was then coated with a conventional anti curl back coating (ACBC) to the back side, opposite to the side bearing the imaging layers, of the substrate. A conventionally known ACBC was prepared by combining 88.2 grams of polycarbonate resin (MAKROLON 5705), 7.12 grams VITEL PE-2200 copolyester (available from Bostik, Inc. Middleton, Mass.) and 1,071 grams of methylene chloride in a carboy container to form a coating solution containing 8.9 weight percent solids. The container was covered tightly and placed on a roll mill for about 24 hours until the polycarbonate and polyester were dissolved in the methylene chloride to form the ACBC solution. The ACBC solution contained 8 weight percent adhesion promoter and 92 weight percent film forming polymer. The ACBC solution was then applied to the rear surface of an imaging member prepared according to the Imaging Member Preparation by extrusion coating and dried to a maximum temperature of 125° C. in a forced air oven for 3 minutes to produce a dried ACBC layer having a thickness of 17 micrometers and flatten the imaging member.

Disclosure Example I

A first flexible electrophotographic imaging member web was of present disclosure prepared by following the same procedures and using the very exact same materials as those described in the Control Example, but with the exception that the bisphenol A polycarbonate MAKROLON 5705 ) in the single layer ACBC was replaced with a low surface energy polycarbonate (LEXAN 1414T, available from SABIC Innovative Plastics). The low surface energy polycarbonate is a modified bisphenol A polycarbonate of poly(4,4'-isopropylidene diphenyl carbonate), as described in formula (I) below, and contains a small fraction of about 6 weight percent of polydimethyl siloxane (PDMS) in the polymer back bone.

Formula (1)

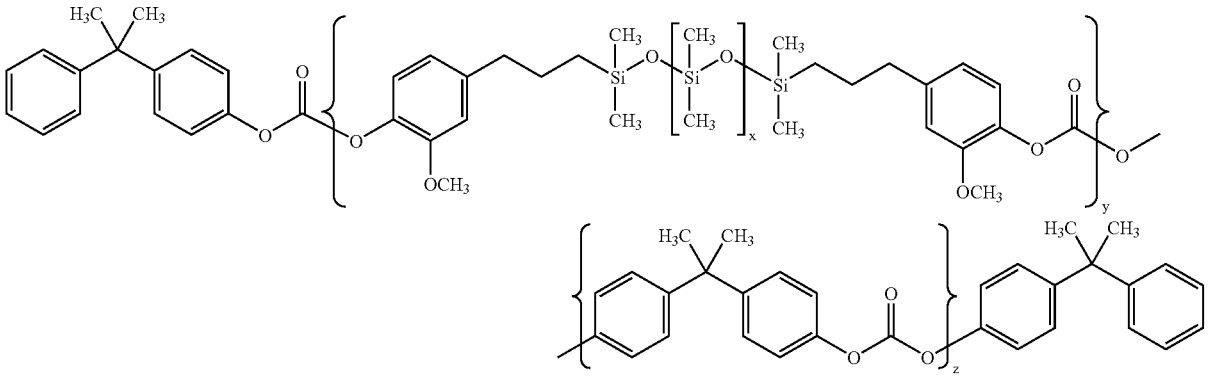

wherein x is an integer between about 40 and about 50 while y and z are integers representing a number of the respective repeating units. The prepared single layer ACBC comprising 92 weight percent low surface energy LEXAN 1414T and 8 weight percent copolyester, based on the total weight of the ACBC, was 17 micrometers in thickness, optically clear, and had a slippery surface to the touch.

Disclosure Example II

A second flexible electrophotographic imaging member web of present disclosure was prepared by following the same procedures and using the very same materials as those described in the Control Example, except that half of the MAKROLON 5705in the single layer ACBC was replaced with the low surface energy polycarbonate of LEXAN 1414T. The prepared single layer ACBC, comprising 92 weight percent of half low surface energy LEXAN 1414T and half MAKROLON polymer blending and 8 weight percent copolyester based on the total weight of the ACBC, was 17 micrometers in thickness, optically clear, and had an abhesive slippery surface.

Disclosure Example III

A third flexible electrophotographic imaging member web of present disclosure was prepared by following the same procedures and using the very same materials as those described in the Disclosure Example II, but with the exception that the polymer blend in the singer layer ACBC was comprised of equal parts of two low surface energy polymers consisting of LEXAN 1414T and a polyalkyl-polyaryl siloxane containing polycarbonate (MGC4, available from Mitsubishi Chemicals). The resulting single layer ACBC, comprising 92 weight percent of the low surface energy polymer blend and 8 weight percent copolyester based on the total weight of the ACBC, was 17 micrometers in thickness, optically clear, and had a very slippery abhesive surface.

Disclosure Example IV

A fourth flexible electrophotographic imaging member web of present disclosure was prepared by following the very exact same procedures and using the very same materials as those described in the Disclosure Example II, but with the exception that the slippery single layer ACBC was reformulated to incorporate 8 weight percent Phenyllsooctyl POSS (available form Hybrid Plastics), 8 weight percent ozone suppression agent of monomer bis(allyl carbonate) of bisphenol A of formula (2) (HIRI, available from PPG), and 0.8 weight percent of a slip agent of liquid polyester modified polysiloxane of formula (4) (BYK 310, available from BYK-Chemie USA), based on the total weight of the single layer ACBC. The resulting single layer ACBC, was 17 micrometers in thickness, optically clear, enhanced in hardness, and very slippery and abhesive on its surface.

Disclosure Example V

A fifth flexible electrophotographic imaging member web of present disclosure was prepared by following the same procedures and using the very same materials as those described in the Control Example I, but with the exception that it had a dual layer ACBC consisting of a 14.5 micrometer thick inner layer of the exact same material compositions as that of the single layer ACBC of Control Example and a slippery 14.5 micrometer thick outer exposed layer disposed over the inner layer. The slippery outer exposed layer of present disclosure was formulated to solely contain the low surface energy polycarbonate of LEXAN 1414T without the copolyester adhesion since it was fusion bonded to the inner layer.

Disclosure Example VI

A sixth flexible electrophotographic imaging member web of present disclosure was prepared by following the same procedures and using the very same materials as those described in the Disclosure Example V, but with the exception that the slippery outer exposed layer of the dual layer ACBC was formulated to consist of a polymer blend of two low surface energy polymers having equal parts of LEXAN 1414T and MGC4. The slippery 14.5 micrometer thick outer exposed layer of present disclosure thus prepared did not include the copolyester adhesion since it was fusion bonded to the inner layer.

Physical, Mechanical, and Ozone Resistance Assessments

The ACBC of the control and ACBC of all the electrophotographic imaging member webs of Disclosure Examples I to VI were tested for each respective scratch resistance, surface contact friction, abhesiveness, and surface energy. For scratch resistance, each imaging member was laid down (with its ACBC surface facing upwardly) on a flat platform; a phonographic needle is then sliding over the coating layer surface, at 4 inches/second speed, to induce a surface scratch under a control 6-gm load. The scratch tested coating layers were then each analyzed for the depth of scratch damage by a surface profilometer.

The surface contact friction measurement was conducted by sliding an elastomeric polyurethane (PUR) over the ACBC surface of each imaging member and the coefficient of surface contact friction was thus obtained by dividing the force required to slide the blade over the ACBC by the normal force acted on the ACBC by the blade.

For surface abhesivness determination, a one inch width Scotch Masking Tape (available from 3M Company) was laid over the ACBC of each imaging member by rolling a 5 lbs weight over the tape and then a 1800 tape peel test was carried out to give a peel strength of force per inch width that was required to peel the tape off from the ACBC of each imagine member. And, each ACBC surface energy was determined by liquid wetting contact angle measurement method.

The results thus obtained are listed in Table 1 below; they show that phenylIsooctyl POSS incorporation into the ACBC of the imaging member could yield added scratch resistance improvement to the prepared ACBC. Even though the presence of low surface energy polymer in the ACBC did produce only limited scratch resistance, nonetheless the resulting slippery ACBC did provide highly effective surface contact friction reduction as well as surface abhesiveness, as demonstrated by the relative ease of 180° tape peeling off from the slippery ACBC of all the disclosure imaging members (with the slip agent added ACBC gave the synergistic outcomes as reflected in friction reduction and surface slipperiness enhancement), than that seen for the control ACBC counterpart of Control Example.

TABLE 1

| WORKING EXAMPLE ID | Scratch Depth (micron) | Coeff. of Friction against PUR | 180° Tape Peel (gms/cm) | Surface Energy (dynes/cm) |
|---|---|---|---|---|
| Control Ex | 0.51 | 2.9 | 235 | 32 |
| Disclosure I | 0.48 | 1.2 | 50 | 22 |
| Disclosure II | 0.46 | 1.7 | 62 | 24 |
| DisclosureIII | 0.45 | 1.6 | 58 | 23 |
| Disclosure IV | 0.43 | 1.1 | 47 | 21 |
| Disclosure V | 0.48 | 1.2 | 50 | 22 |
| DisclosureVI | 0.45 | 1.6 | 58 | 23 |

The ACBC of imaging member of Disclosure Example IV (containing the ozone suppression agent bis(allyl carbonate) of bisphenol A) was cut to give two separate samples; one of which was subjected to extended corona effluents exposure emitted from a scorotron charge device while the other was not exposed to serve as a control. The polycarbonate molecular weight analysis results obtained for the exposed ACBC and the control ACBC showed absolute protection of polycarbonate degradation against ozone attack was effected by the ozone suppression presence in the ACBC. In addition, the imaging member webs of Control Example and Disclosure Example II were cut to give two 2,808 mm×440 mm rectangular sheets and then ultrasonically welded into two separate seamed imaging member belts. The welded imaging member belts were each subsequently cyclic testing run in an iGen3 machine and continuously monitored for each respective tribo-electrical charging as a functional of cycle in belt. The results thus obtained showed that the imaging member belt having the slippery ACBC of present disclosure was highly effectual to cut the tribo-electrical charging up by about 60% from that of the standard ACBC control imaging member belt.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. An electrophotographic imaging member comprising:

a flexible substrate with a conducting layer;

at least one imaging layer positioned on a first side of the substrate;

an anticurl back coating positioned on a second side of the substrate opposite to the at least one imaging layer, wherein the anticurl back coating has at least one layer and a thickness of from about 5 to about 80 microns and further comprises a low surface energy modified polycarbonate polymer having a weight average molecular weight of between about 20,000 and about 200,000, the polymer being formed and selected from the group consisting of:

a modified Bisphenol C polycarbonate of poly(4,4'-isopropylidene di-(2-methylphenyl)carbonate) having a small fraction of polydimethyl siloxane in the polymer back bone and having the following formula (III):

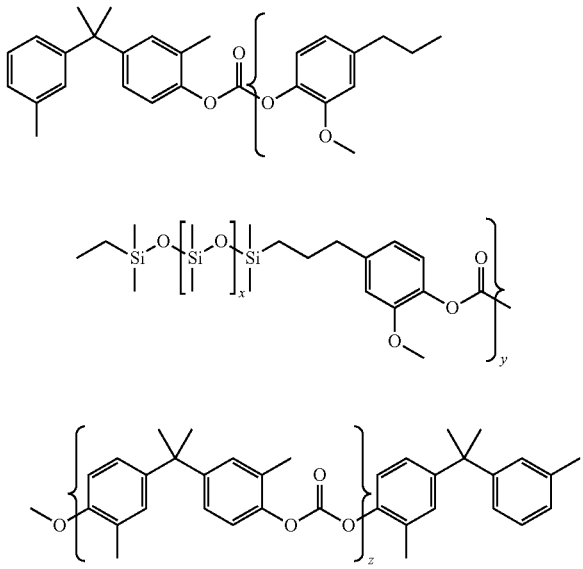

wherein x is an integer between about 40 and about 50 while y and z are integers representing a number of the respective repeating units, a modification of the modified Bisphenol Z polycarbonate of poly(4,4'-diphenyl-1,1'-cyclohexane carbonate) having a small fraction of polydimethyl siloxane in the polymer back bone and having the following formula (IV):

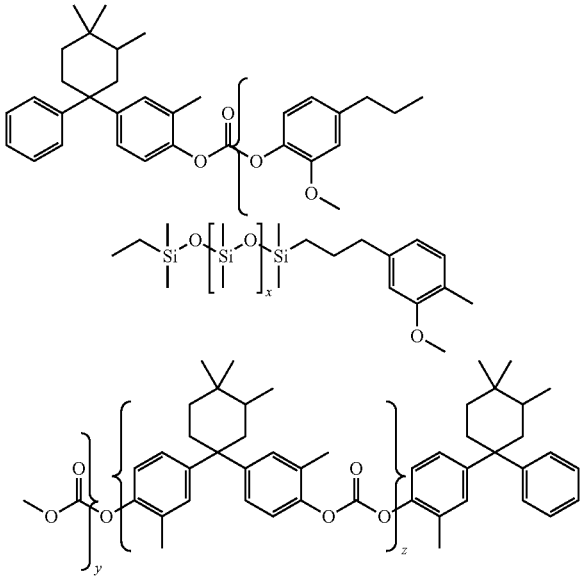

wherein x is an integer between about 40 and about 50 while y and z are integers representing a number of the respective repeating units, and mixtures thereof, and an adhesion promoter; and an optional overcoat layer on the at least one imaging layer.

2. The electrophotographic imaging member of claim 1, wherein the anticurl back coating further includes a blend consisting of the low surface energy modified polycarbonate polymer selected from the group consisting of formula (III) and formula (IV) and a bisphenol type polycarbonate having a weight average molecular weight of between about 20,000 and about 200,000 being selected from the group consisting of:

(a) a bisphenol A polycarbonate of poly(4,4'-isopropylidene diphenyl) carbonate having the following formula (A):

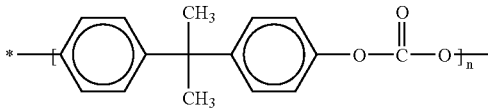

wherein n indicates each respective degree of polymerization, (b) a modified bisphenol A polycarbonate of poly(4,4'-isopropylidene diphenyl) carbonate having the following formula (B):

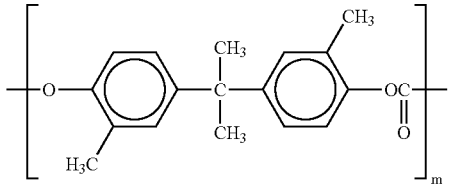

wherein m indicates each respective degree of polymerization, (c) a bisphenol Z polycarbonate of poly(4,4'-diphenyl-1,1'-cyclohexane) carbonate having the following formula (C):

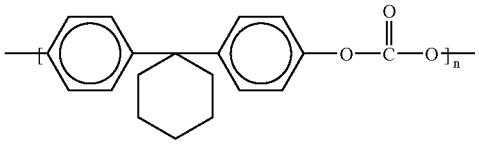

wherein n indicates each respective degree of polymerization, (d) a modified bisphenol Z polycarbonate of poly(4,4'-diphenyl-1,1'-cyclohexane) carbonate having the following formula (D):

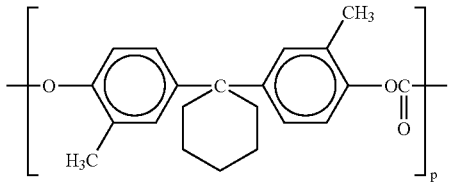

wherein p indicates each respective degree of polymerization, (e) a phthalate-bisphenol A polycarbonate having the following formula (E):

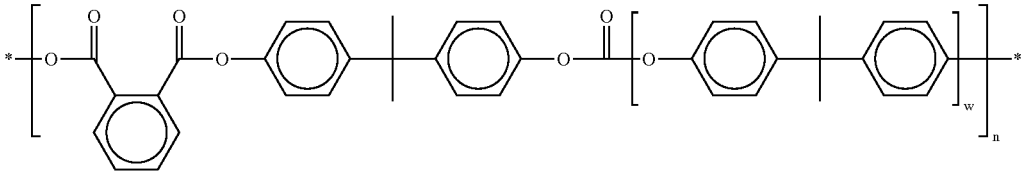

wherein w is an integer from about 1 to about 20 and n is the degree of polymerization, and mixtures thereof.

3. The electrophotographic imaging member of claim 2, wherein the anticurl back coating further includes a polyhedral oligomeric silsesquioxane.

4. The electrophotographic imaging member of claim 1, wherein the anticurl back coating further includes a blend comprising the low surface energy modified polycarbonate polymer selected from the group consisting of formula (III) and formula (IV) and a second low surface energy polymer having a weight average molecular weight of between about 20,000 and about 200,000 having a formula selected from the group consisting of:

formula (V):
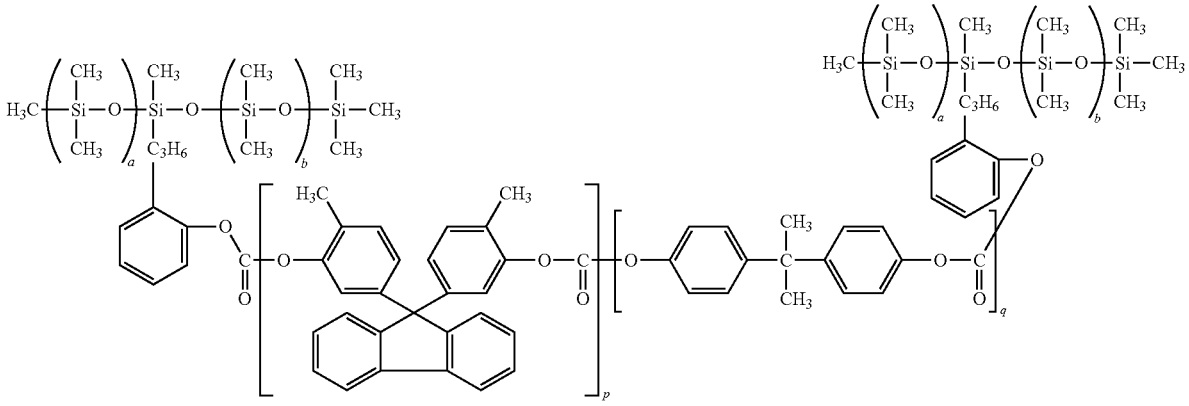
wherein a, b, p and q are integers representing a number of repeating units,
formula (VII):
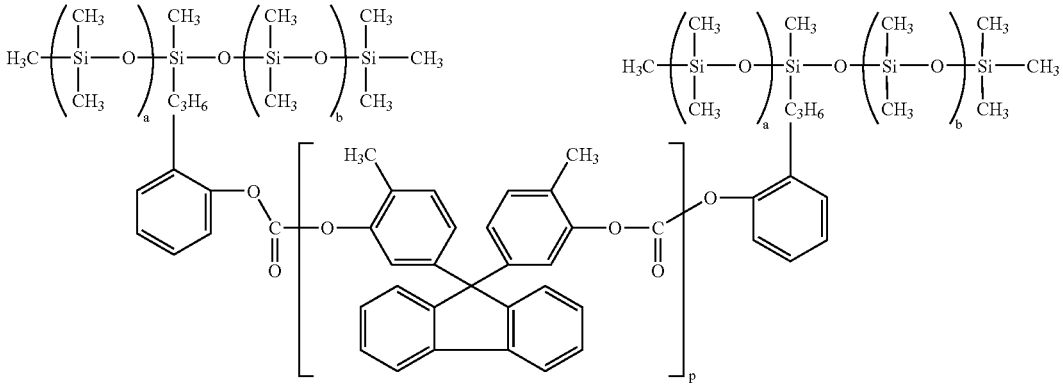
wherein a, b and p are integers representing the number of repeating units,
formula (VIII):
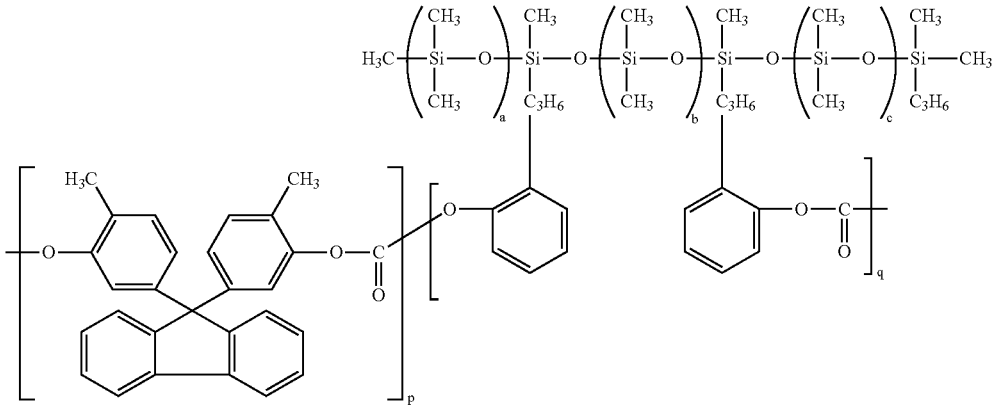
wherein a, b, c, p and q are integers representing the number of repeating units, formula (IX):

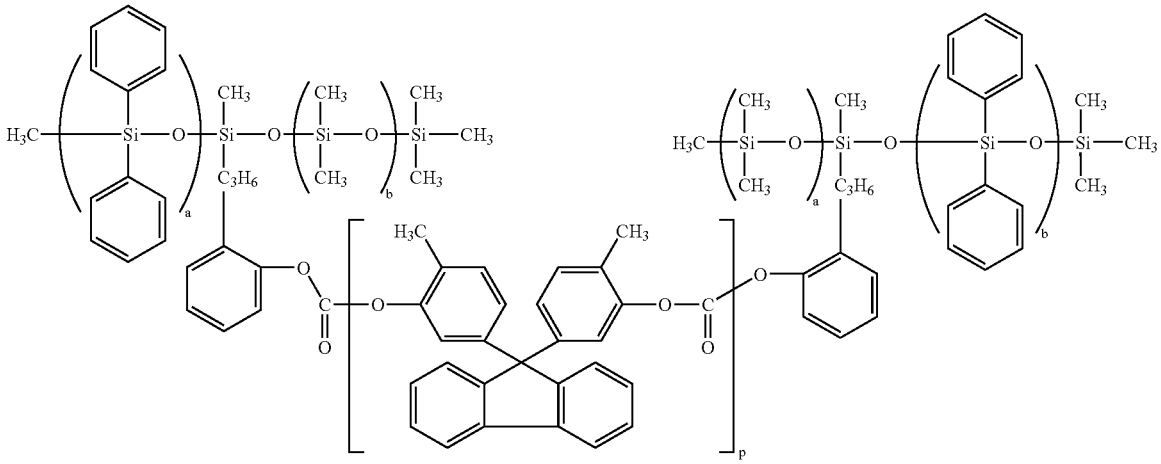

wherein the polymer has an polyalkyl and polyaryl siloxane main chain, and wherein a, b and p are integers representing the number of repeating units, formula (X):

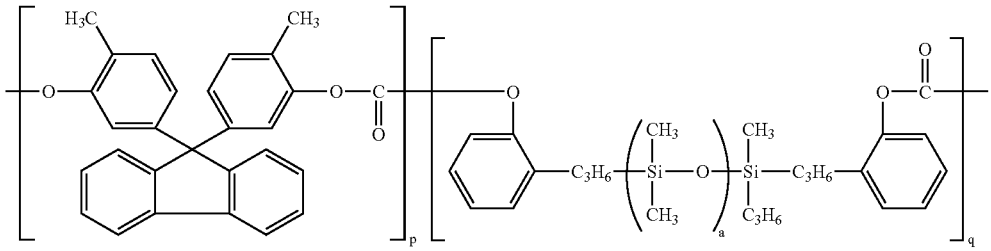

wherein a, p and q are integers representing the number of repeating units, and formula (XI):

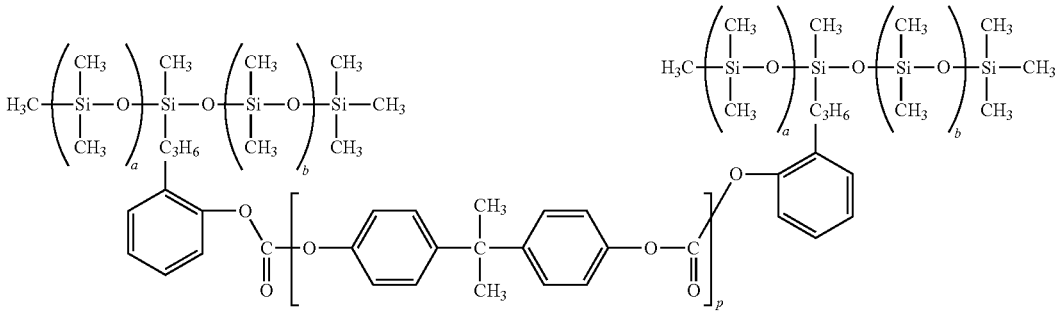

where a, b and p are integers representing the number of repeating units, and mixtures thereof.

5. The electrophotographic imaging member of claim 4, wherein the anticurl back coating further includes a polyhedral oligomeric silsesquioxane.

6. The electrophotographic imaging member of claim 4, wherein a ratio of the first low surface energy modified polycarbonate polymer to the second low surface energy polymer is from about 5:95 to about 95:5 in weight percent.

7. The electrophotographic imaging member of claim 1, wherein the anticurl back coating further includes a polyhedral oligomeric silsesquioxane.

8. The electrophotographic imaging member of claim 7, wherein the polyhedral oligomeric silsesquioxane is present in an amount of from about 1 weight percent to about 10 weight percent by total weight of the anticurl back coating.

9. The electrophotographic imaging member of claim 6, wherein the polyhedral oligomeric silsesquioxane is selected from the group consisting of poly(dimethyl-co-methylhydrido-co-methylpropyl polyhedral oligomeric silsesquioxane)siloxane, fluoro(13)disilanolisobutyl-polyhedral oligomeric silsesquioxane, poly(dimethyl-co-methylvinyl-co-methylethylsiloxy-polyhedral oligomeric silsesquioxane) siloxane, trisfluoro(13)cyclopentyl polyhedral oligomeric silsesquioxane, fluoro(13)disilanolcyclopentyl-polyhedral oligomeric silsesquioxane, fluoro(13)disilanolisobutyl-polyhedral oligomeric silsesquioxane, fluoro(13)disilanolcyclopentyl-polyhedral oligomeric silsesquioxane, phenylisooctyl polyhedral oligomeric silsesquioxane, trisilanolphenyl-polyhedral oligomeric silsesquioxane, cyclohexenyl-polyhedral oligomeric silsesquioxane, methacrylfluoro(3)-polyhedral oligomeric silsesquioxane, and mixtures thereof.

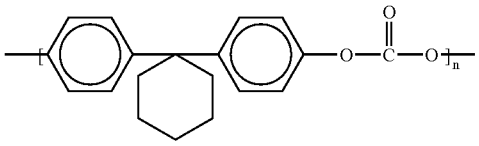

wherein n indicates each respective degree of polymerization, a modified bisphenol Z polycarbonate of poly(4,4'-diphenyl-1,1'-cyclohexane) carbonate having the following formula (D):

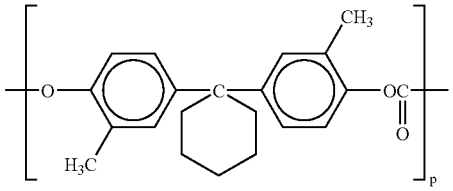

wherein p indicates each respective degree of polymerization, a phthalate-bisphenol A polycarbonate having the following formula (E):

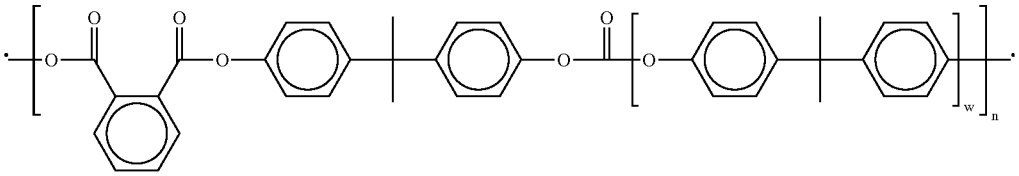

10. The electrophotographic imaging member of claim 1, wherein the anticurl back coating has an inner layer and an outer exposed layer and the inner layer further comprises a bisphenol type polycarbonate having a weight average molecular weight of between about 20,000 and about 200,000 being selected from the group consisting of a bisphenol A polycarbonate of poly(4,4'-isopropylidene diphenyl) carbonate having the following formula (A):

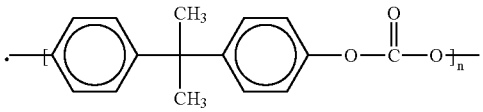

wherein n indicates each respective degree of polymerization, a modified bisphenol A polycarbonate of poly(4,4'-isopropylidene diphenyl) carbonate having the following formula (B):

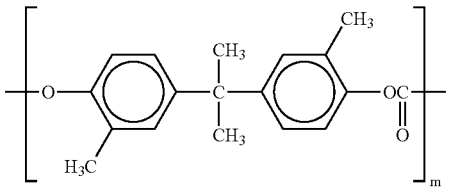

wherein m indicates each respective degree of polymerization, a bisphenol Z polycarbonate of poly(4,4'-diphenyl-1,1'-cyclohexane) carbonate having the following formula (C):

wherein w is an integer from about 1 to about 20 and n is the degree of polymerization, and mixtures thereof, and an adhesion promoter; and the outer layer further comprises the low surface energy modified polycarbonate polymer being formed and selected from the group consisting of formula (III) and formula (IV).

11. The electrophotographic imaging member of claim 10, wherein the outer exposed layer further includes a blend consisting of the low surface energy modified polycarbonate polymer selected from the group consisting of formula (III) and formula (IV) and the bisphenol type polycarbonate being selected from the group consisting of formula (A), formula (B), formula (C), formula (D), and formula (E), and a POSS additive.

12. The electrophotographic imaging member of claim 10, wherein the adhesion promoter in the inner layer is a copolyester.

13. The electrophotographic imaging member of claim 10, wherein the outer exposed layer has a thickness of from about equal the thickness of the inner layer to about ⅕ the thickness of the inner layer.

14. An electrophotographic imaging member comprising:

a flexible substrate with a conducting layer;

at least one imaging layer positioned on a first side of the substrate;

an anticurl back coating positioned on a second side of the substrate opposite to the at least one imaging layer, wherein the anticurl back coating has at least one layer and a thickness of from about 5 to about 80 microns and further comprises a low surface energy modified polycarbonate polymer, the polymer being formed and selected from the bisphenol type polycarbonate having a weight average molecular weight of between about 20,000 and about 200,000 being selected from the group consisting of:

(a) a modified Bisphenol A polycarbonate of poly(4,4'-isopropylidene diphenyl carbonate) having a small fraction of polydimethyl siloxane in the polymer back bone and having the following formula (I):

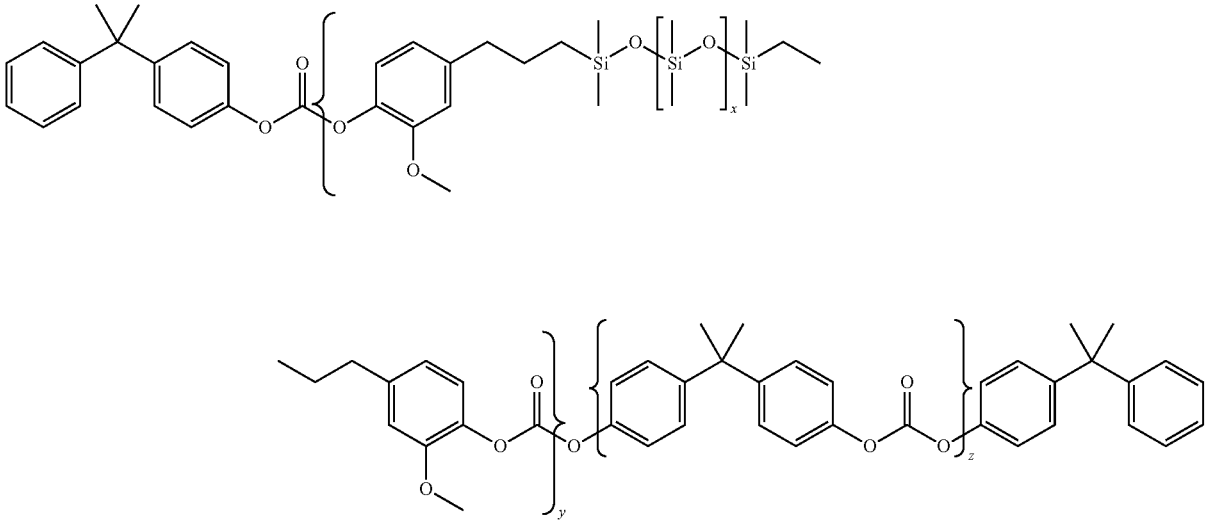

wherein x is an integer between about 40 and about 50 while y and z are integers representing a number of the respective repeating units, (b) a modified Bisphenol Z polycarbonate of poly(4,4'-diphenyl-1,1'-cyclohexane carbonate) having a small fraction of polydimethyl siloxane in the polymer back bone and having the following formula (II):

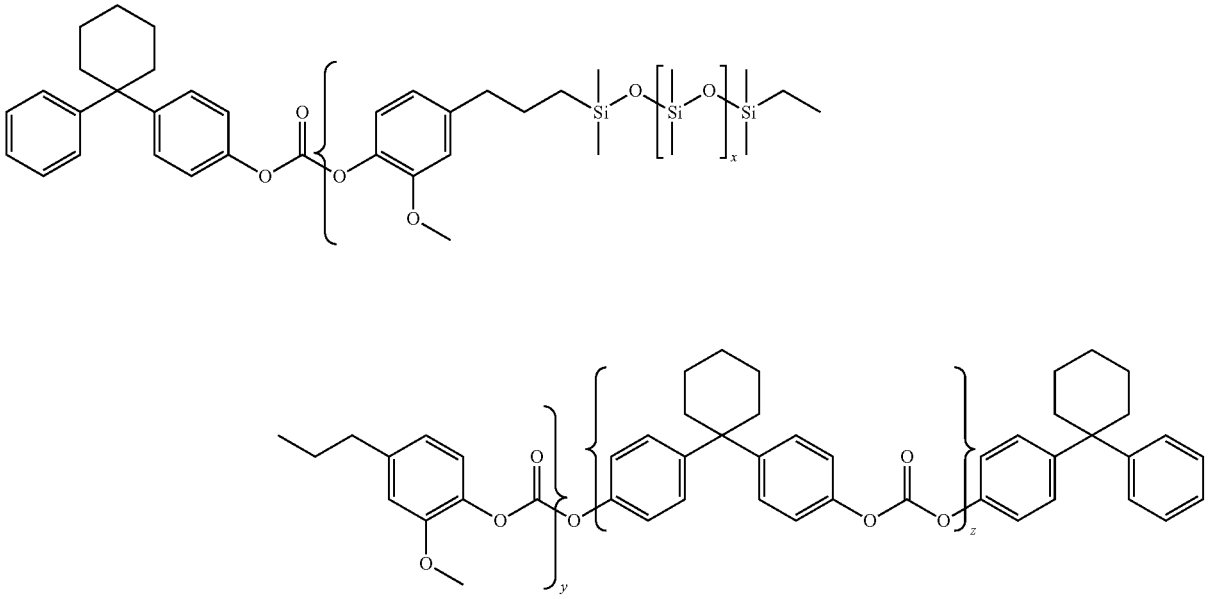

wherein x is an integer between about 40 and about 50 while y and z are integers representing a number of the respective repeating units, (c) a modified Bisphenol C polycarbonate of poly(4,4'-isopropylidene di-(2-methylphenyl)carbonate) having a small fraction of polydimethyl siloxane in the polymer back bone and having the following formula (III):

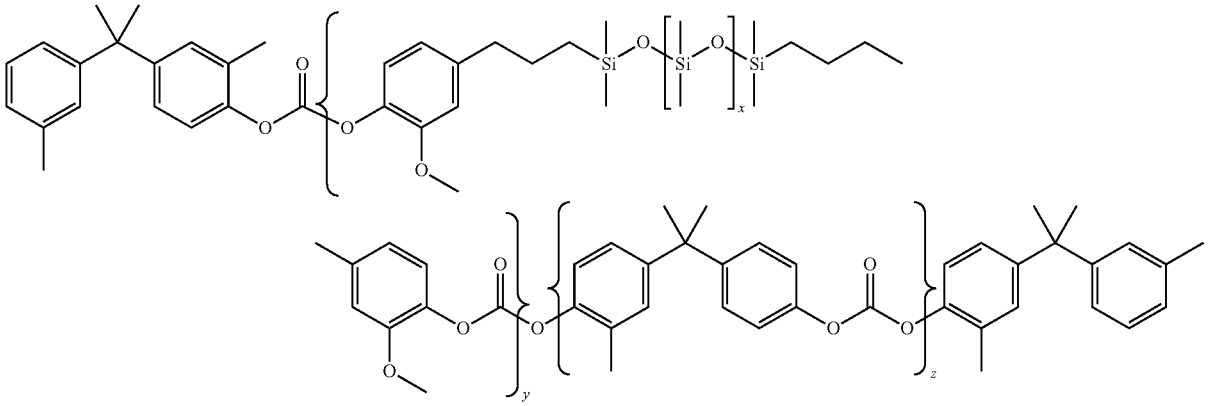

wherein x is an integer between about 40 and about 50 while y and z are integers representing a number of the respective repeating units, (d) a modification of the modified Bisphenol Z polycarbonate of poly(4,4'-diphenyl-1,1'-cyclohexane carbonate) having a small fraction of polydimethyl siloxane in the polymer back bone and having the following formula (IV):

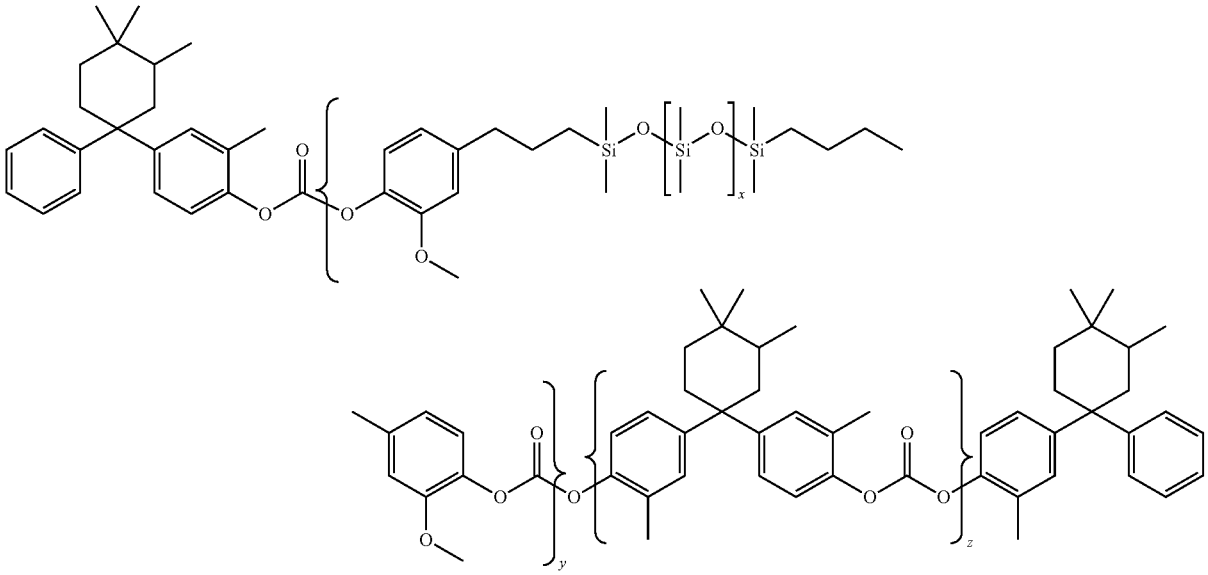

wherein x is an integer between about 40 and about 50 while y and z are integers representing a number of the respective repeating units, and mixtures thereof;

wherein the anticurl back coating has an inner layer and an outer exposed layer and the inner layer further comprises a bisphenol type polycarbonate having a weight average molecular weight of between about 20,000 and about 200,000 and being selected from the group consisting of a bisphenol A polycarbonate of poly(4,4'-isopropylidene diphenyl) carbonate having the following formula (A):

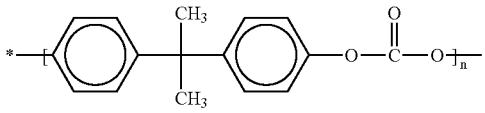

wherein n indicates each respective degree of polymerization, a modified bisphenol A polycarbonate of poly(4,4'-isopropylidene diphenyl) carbonate having the following formula (B):

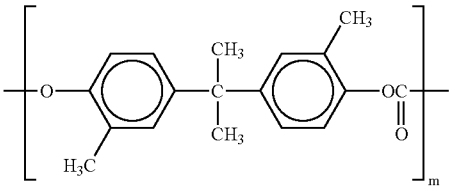

wherein m indicates each respective degree of polymerization, a bisphenol Z polycarbonate of poly(4,4'-diphenyl-1,1'-cyclohexane) carbonate having the following formula (C):

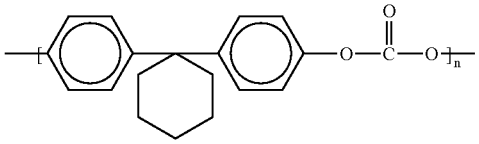

wherein n indicates each respective degree of polymerization, a modified bisphenol Z polycarbonate of poly(4,4'-diphenyl-1,1'-cyclohexane) carbonate having the following formula (D):

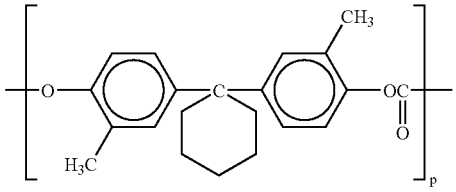

wherein p indicates each respective degree of polymerization, a phthalate-bisphenol A polycarbonate having the following formula (E):

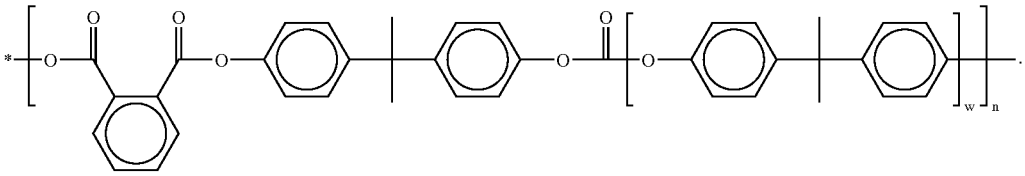

wherein w is an integer from about 1 to about 20 and n is the degree of polymerization, and mixtures thereof, and an adhesion promoter; and the outer layer further comprises the low surface energy modified polycarbonate polymer being formed and selected from the group consisting of formula (I), formula (II), formula (III), and formula (IV);

wherein the outer exposed layer further includes a blend comprising the low surface energy modified polycarbonate polymer selected from the group consisting of formula (I), formula (II), formula (III) and formula (IV) and a second low surface energy polymer having a formula selected from the group consisting of:

formula (V):

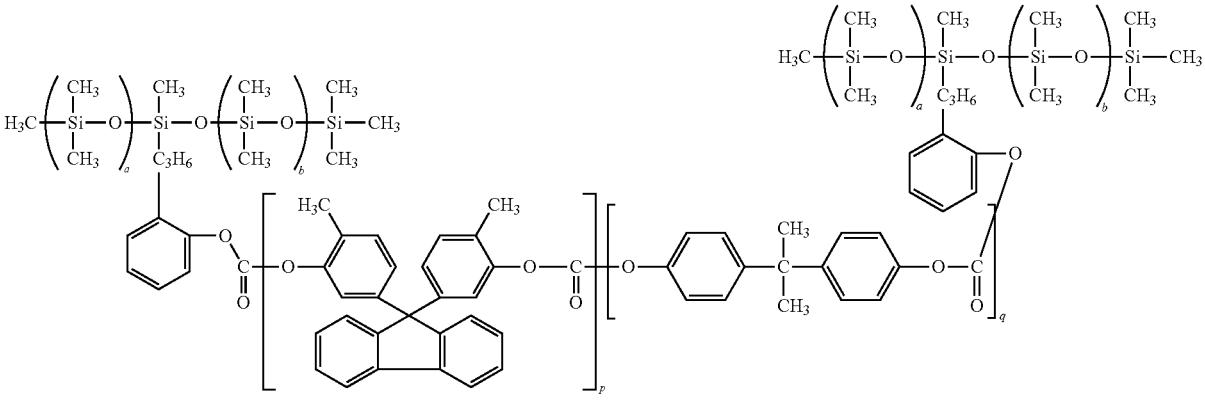

wherein a, b, p and q are integers representing a number of repeating units,
formula (VII):
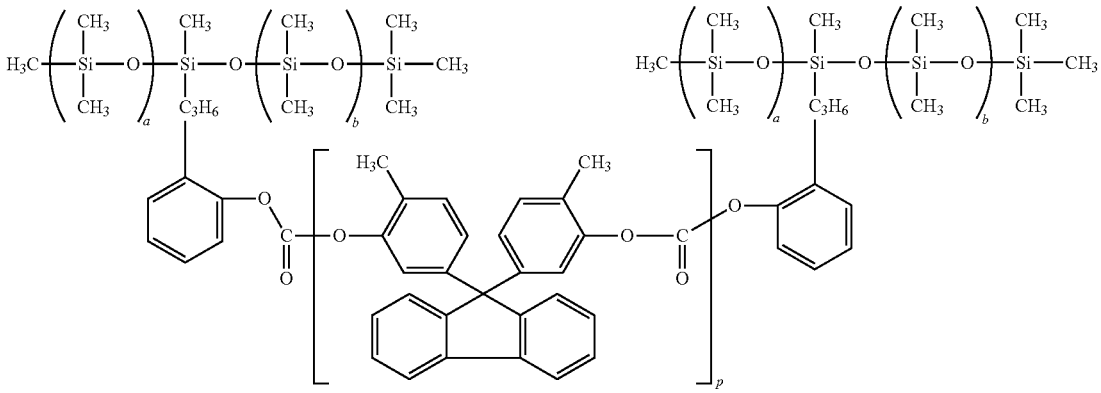
wherein a, b and p are integers representing the number of repeating units,
formula (VIII):
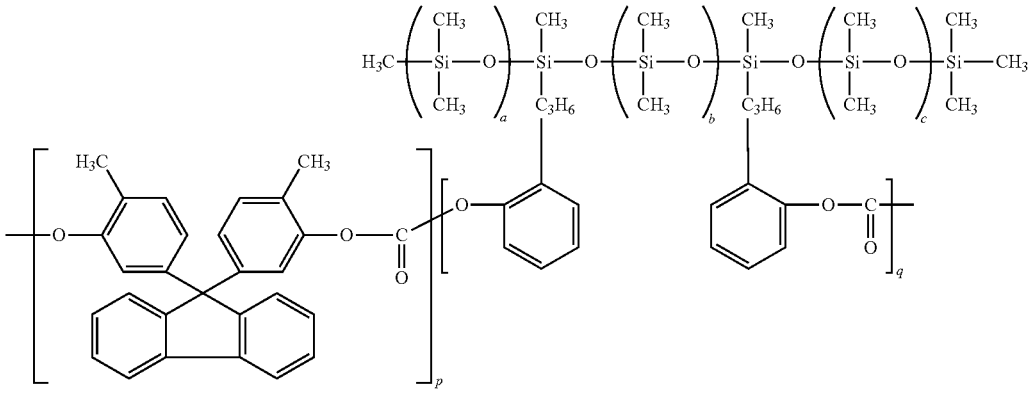
wherein a, b, c, p and q are integers representing the number of repeating units,
formula (IX):
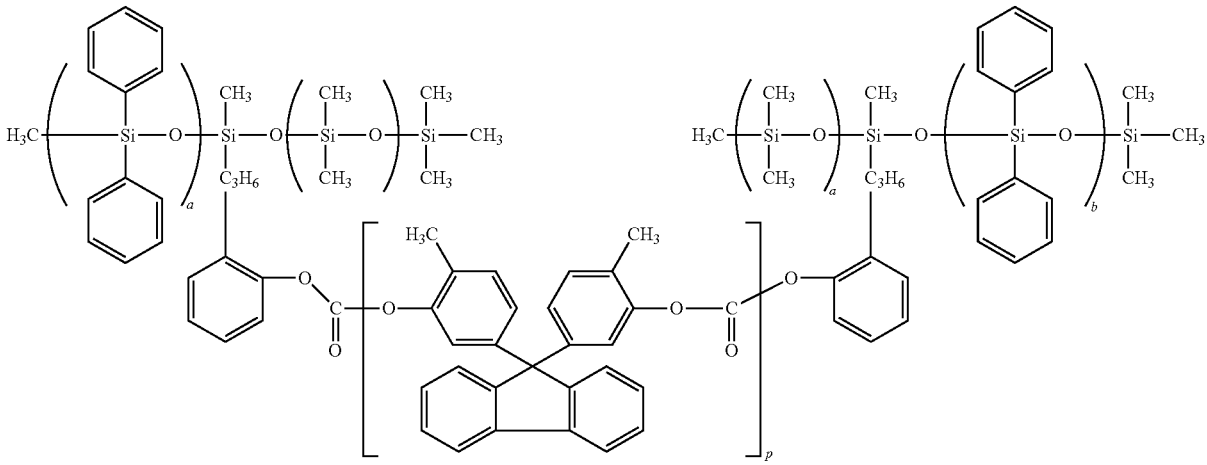

wherein the polymer has an polyalkyl and polyaryl siloxane main chain, and wherein a, b and p are integers representing the number of repeating units, formula (X):

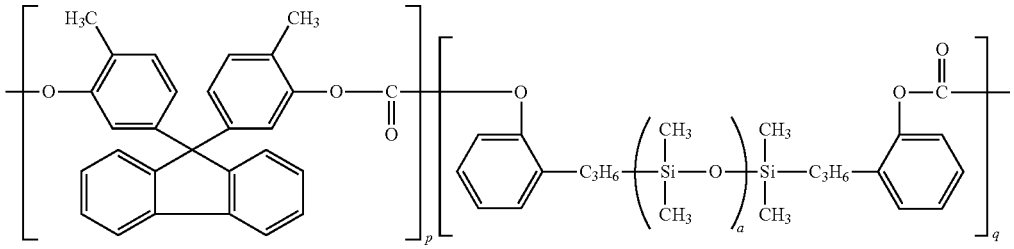

wherein a, p and q are integers representing the number of repeating units, and formula (XI):

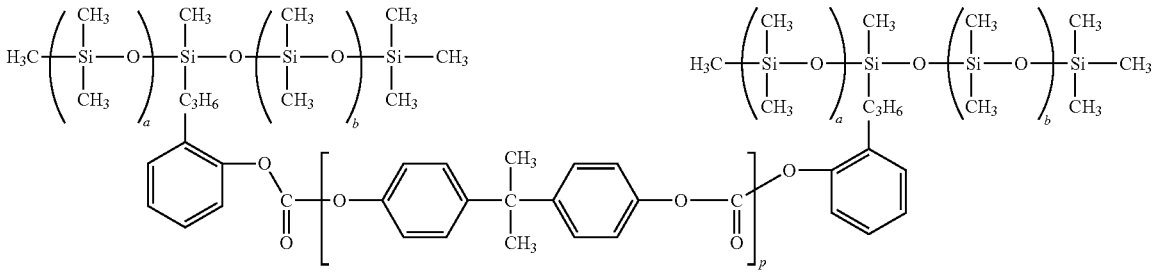

where a, b and p are integers representing the number of repeating units, and mixtures thereof; wherein the outer exposed layer does not include an adhesion promoter; and an optional overcoat layer on the at least one imaging layer.

15. An electrophotographic imaging member comprising:

a flexible substrate with a conducting layer;

at least one imaging layer positioned on a first side of the substrate;

an anticurl back coating positioned on a second side of the substrate opposite to the at least one imaging layer, wherein the anticurl back coating has at least one layer and a thickness of from about 5 to about 80 microns and further comprises a low surface energy modified polycarbonate polymer having a weight average molecular weight of between about 20,000 and about 200,000, the polymer being formed and selected from the group consisting of:

(a) a modified Bisphenol A polycarbonate of poly(4,4'-isopropylidene diphenyl carbonate) having a small fraction of polydimethyl siloxane in the polymer back bone and having the following formula (I):

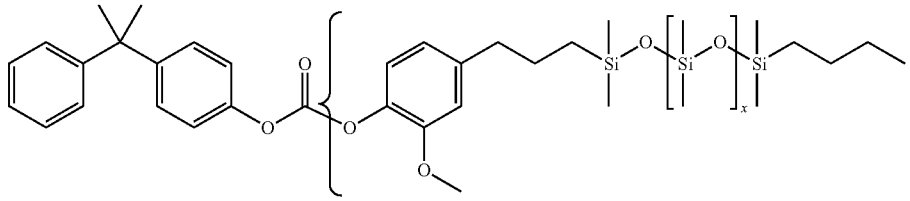

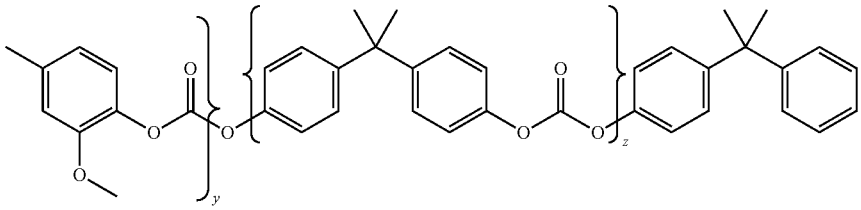

wherein x is an integer between about 40 and about 50 while y and z are integers representing a number of the respective repeating units, (b) a modified Bisphenol Z polycarbonate of poly(4,4'-diphenyl-1,1'-cyclohexane carbonate) having a small fraction of polydimethyl siloxane in the polymer back bone and having the following formula (II):

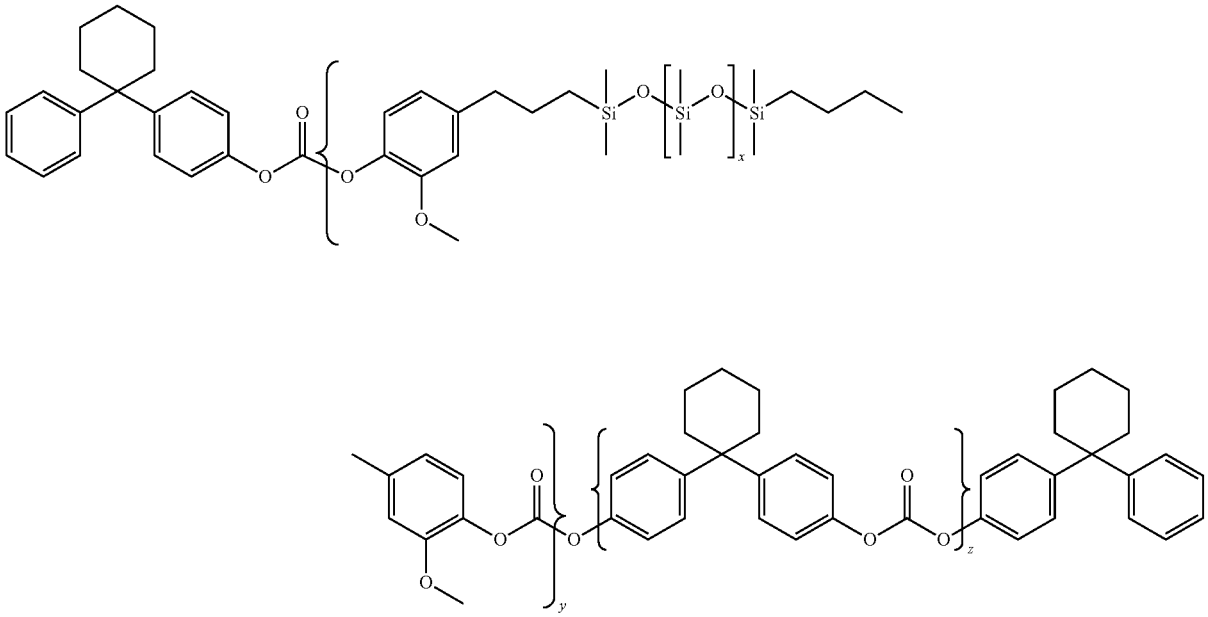

wherein x is an integer between about 40 and about 50 while y and z are integers representing a number of the respective repeating units, (c) a modified Bisphenol C polycarbonate of poly(4,4'-isopropylidene di-(2-methylphenyl)carbonate) having a small fraction of polydimethyl siloxane in the polymer back bone and having the following formula (III):

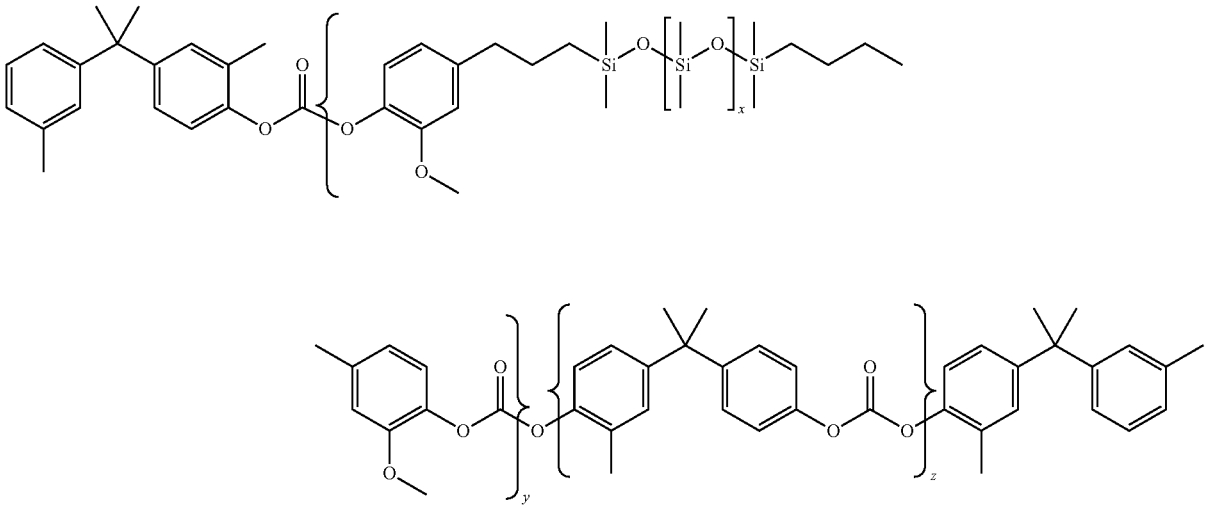

wherein x is an integer between about 40 and about 50 while y and z are integers representing a number of the respective repeating units, (d) a modification of the modified Bisphenol Z polycarbonate of poly(4,4'-diphenyl-1,1'-cyclohexane carbonate) having a small fraction of polydimethyl siloxane in the polymer back bone and having the following formula (IV):

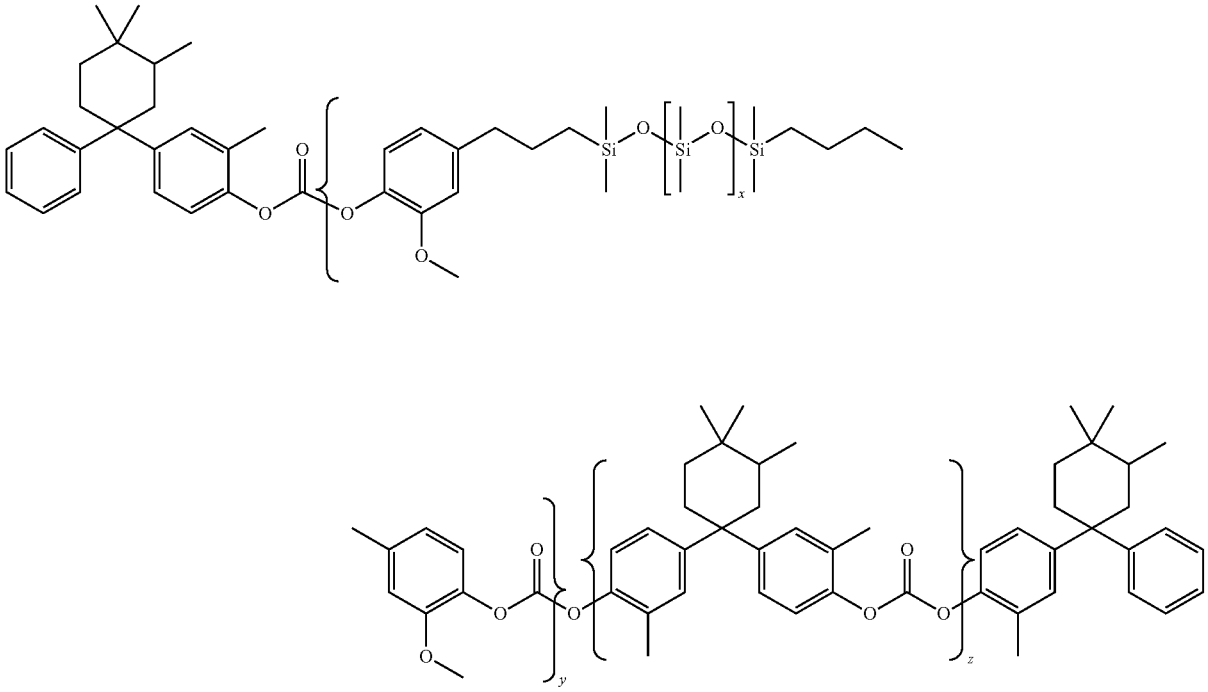

wherein x is an integer between about 40 and about 50 while y and z are integers representing a number of the respective repeating units, and mixtures thereof;

wherein the anticurl back coating has an inner layer and an outer exposed layer and the inner layer further comprises a bisphenol type polycarbonate having a weight average molecular weight of between about 20,000 and about 200,000 and being selected from the group consisting of a bisphenol A polycarbonate of poly(4,4'-isopropylidene diphenyl) carbonate having the following formula (A):

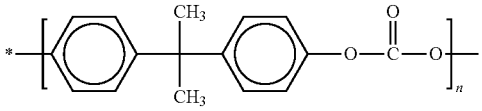

wherein n indicates each respective degree of polymerization, a modified bisphenol A polycarbonate of poly(4,4'-isopropylidene diphenyl) carbonate having the following formula (B):

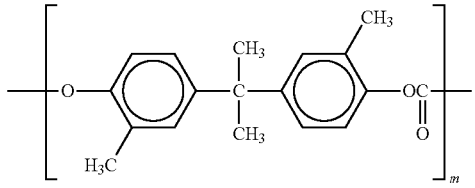

wherein m indicates each respective degree of polymerization, a bisphenol Z polycarbonate of poly(4,4'-diphenyl-1,1'-cyclohexane) carbonate having the following formula (C):

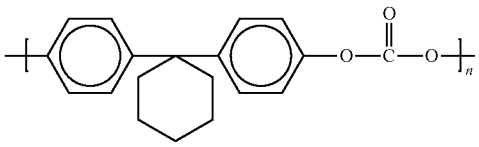

wherein n indicates each respective degree of polymerization, a modified bisphenol Z polycarbonate of poly(4,4'-diphenyl-1,1'-cyclohexane) carbonate having the following formula (D):

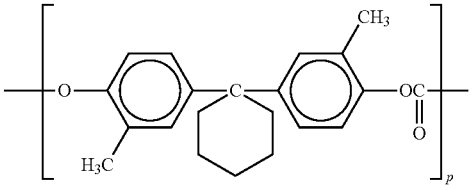

wherein p indicates each respective degree of polymerization, a phthalate-bisphenol A polycarbonate having the following formula (E):

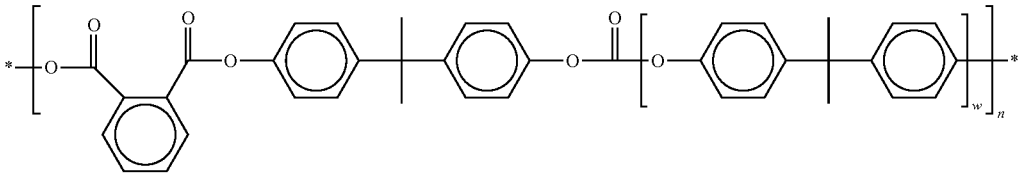

wherein w is an integer from about 1 to about 20 and n is the degree of polymerization, and mixtures thereof, and an adhesion promoter; and the outer layer further comprises the low surface energy modified polycarbonate polymer being formed and selected from the group consisting of formula (I), formula (II), formula (III), and formula (IV);

wherein the outer exposed layer further includes a polyhedral oligomeric silsesquioxane, and does not include an adhesion promoter; and an optional overcoat layer on the at least one imaging layer.

16. The electrophotographic imaging member of claim 15, wherein the outer exposed layer further includes an ozone suppression agent selected from the group consisting of:

(a) a diethylene glycol bis(allyl carbonate) having the following formula (1):

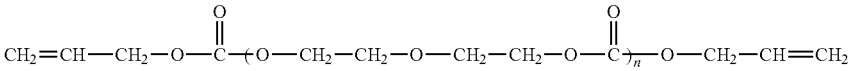

wherein n is an integer from about 1 to about 6, (b) a bis(allyl carbonate) of Bisphenol A having the following formula (2):

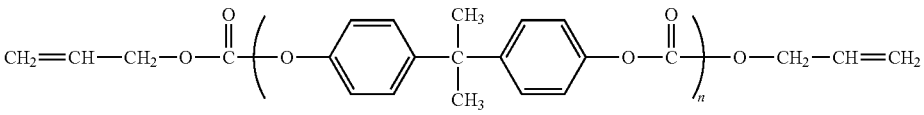

wherein n is an integer from about 1 to about 6, and (c) a polystyrene having the following formula (3):

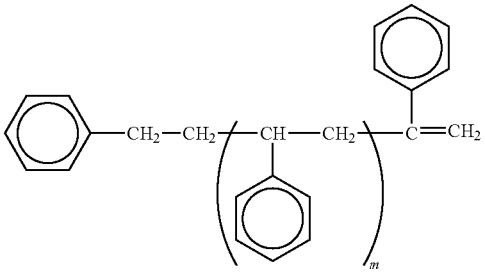

wherein m is the degree of polymerization and m is an integer from about 3 to about 10; and a slip agent of a liquid polyester modified polysiloxane having the following formula (4):

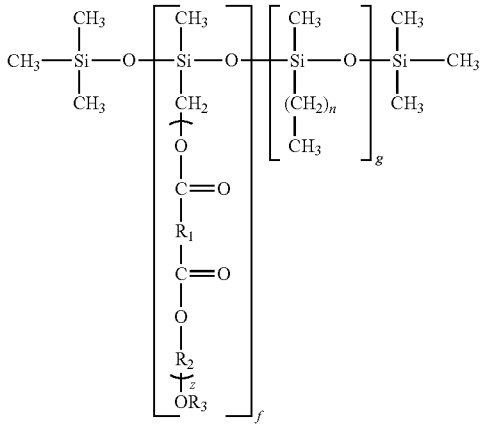

wherein $R_1$ and $R_2$ are independently selected from alkylene groups containing from 1 to 10 carbon atoms; $R_3$ is hydrogen or alkyl having 1 to 3 carbon atoms; n is an integer from 0 to 10; f and g are independently integers from 5 to 500; and z is an integer from 1 to 30.

17. An electrophotographic imaging member comprising: a flexible substrate with a conducting layer;

at least one imaging layer positioned on a first side of the substrate;

an anticurl back coating positioned on a second side of the substrate opposite to the at least one imaging layer, wherein the anticurl back coating has an outer exposed layer and an inner layer and the inner layer comprises a bisphenol type polycarbonate having a weight average molecular weight of between about 20,000 and about 200,000 being selected from the group consisting of a bisphenol A polycarbonate of poly(4,4'-isopropylidene diphenyl) carbonate having the following formula (A):

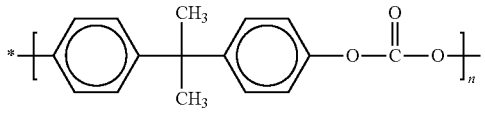

wherein n indicates each respective degree of polymerization, a modified bisphenol A polycarbonate of poly(4,4'-isopropylidene diphenyl) carbonate having the following formula (B):

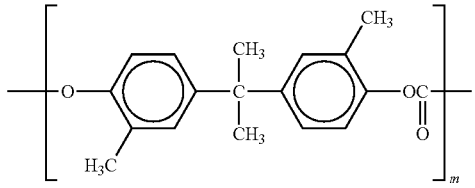

wherein m indicates each respective degree of polymerization, a bisphenol Z polycarbonate of poly(4,4'-diphenyl-1,1'-cyclohexane) carbonate having the following formula (C):

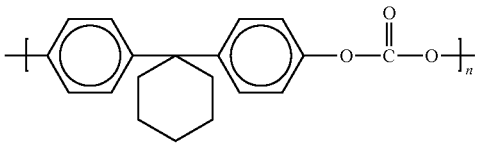

wherein n indicates each respective degree of polymerization, a modified bisphenol Z polycarbonate of poly(4,4'-diphenyl-1,1'-cyclohexane) carbonate having the following formula (D):

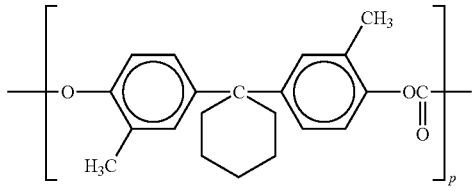

wherein p indicates each respective degree of polymerization, a phthalate-bisphenol A polycarbonate having the following formula (E):

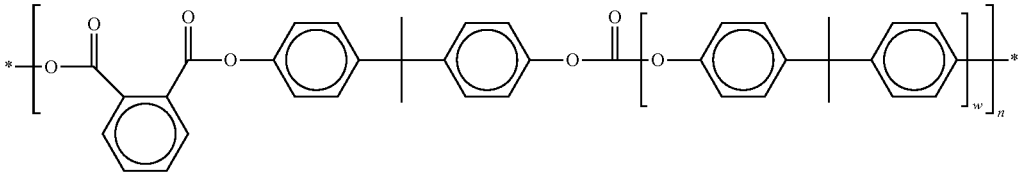

wherein w is an integer from about 1 to about 20 and n is the degree of polymerization, and mixtures thereof, and an adhesion promoter; and the outer exposed layer comprises a low surface energy modified polycarbonate polymer, the polymer being formed and selected from the group consisting of:

(b) a modified Bisphenol Z polycarbonate of poly(4,4'-diphenyl-1,1'-cyclohexane carbonate) having a small fraction of polydimethyl siloxane in the polymer back bone and having the following formula (II):

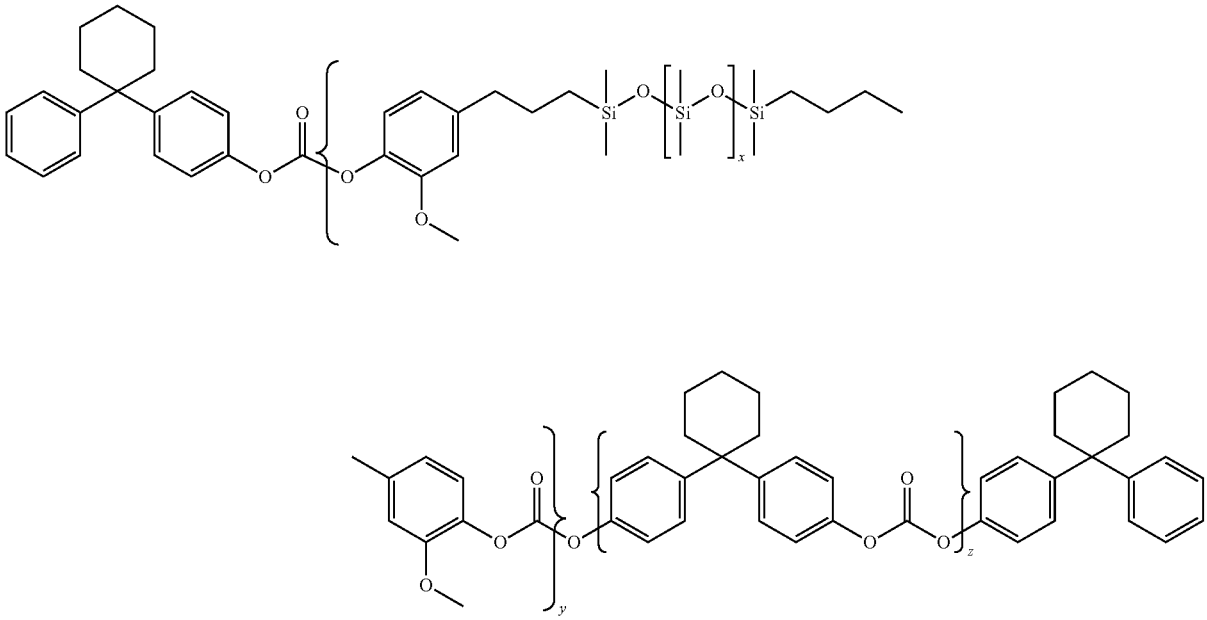

wherein x is an integer between about 40 and about 50 while y and z are integers representing a number of the respective repeating units, (c) a modified Bisphenol C polycarbonate of poly(4,4'-isopropylidene di-(2-methylphenyl)carbonate) having a small fraction of polydimethyl siloxane in the polymer back bone and having the following formula (III):

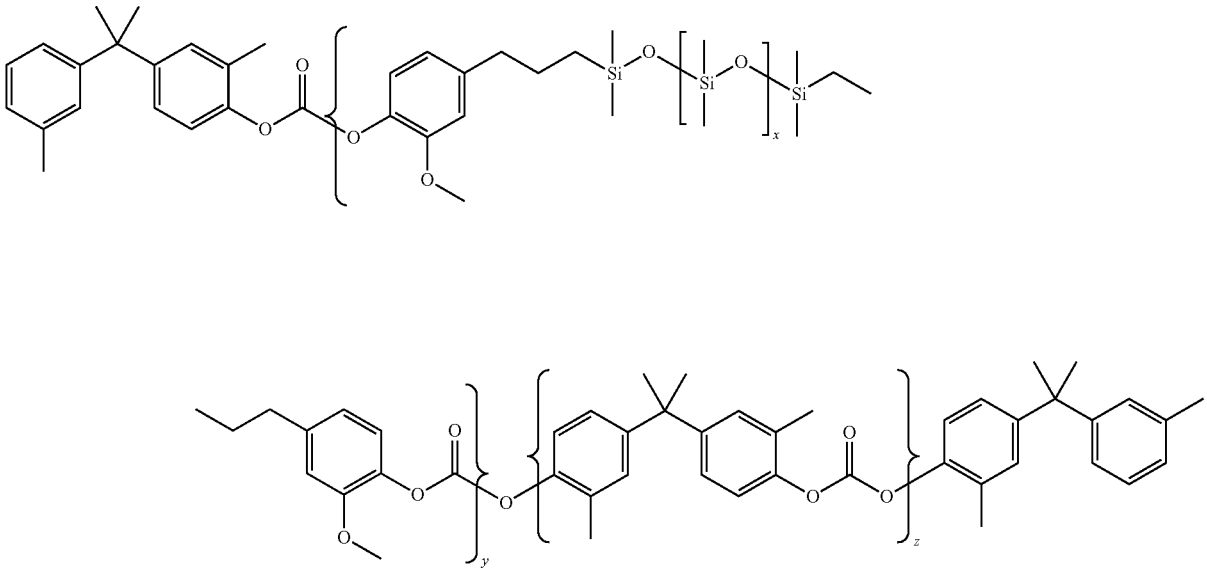

wherein x is an integer between about 40 and about 50 while y and z are integers representing a number of the respective repeating units, (d) a modification of the modified Bisphenol Z polycarbonate of poly(4,4'-diphenyl-1,1'-cyclohexane carbonate) having a small fraction of polydimethyl siloxane in the polymer back bone and having the following formula (IV):

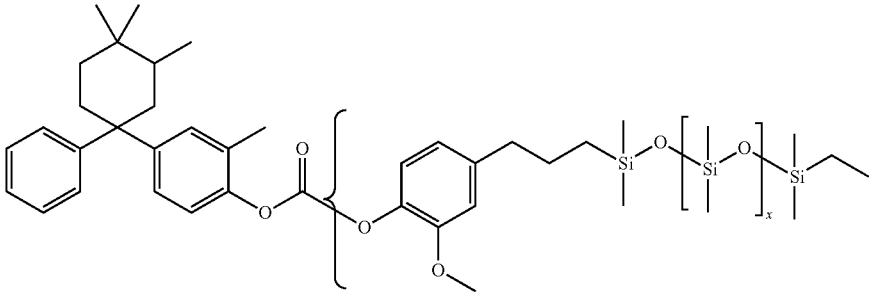

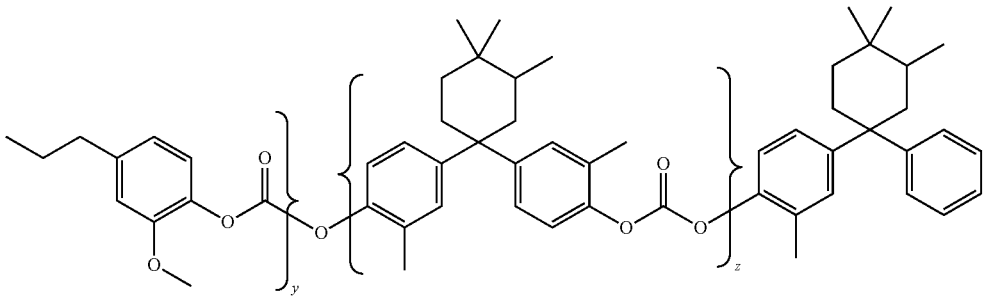

wherein x is an integer between about 40 and about 50 while y and z are integers representing a number of the respective repeating units, and mixtures thereof; and an optional overcoat layer on the at least one imaging layer.

18. The electrophotographic imaging member of claim 17, wherein the outer exposed layer further includes a blend comprising the low surface energy modified polycarbonate polymer selected from the group consisting of formula (II), formula (III), and formula (IV) and a second low surface energy polymer having a formula selected from the group consisting of:

formula (V):

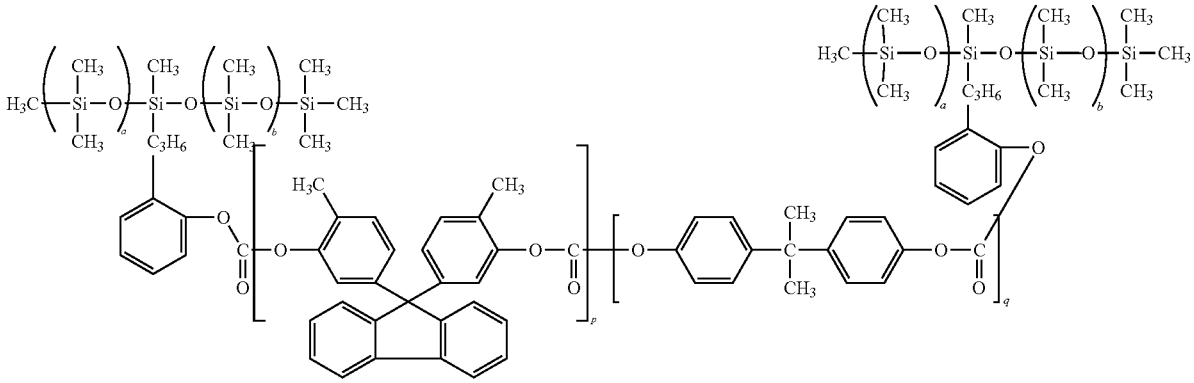

wherein a, b, p and q are integers representing a number of repeating units, formula (VII):
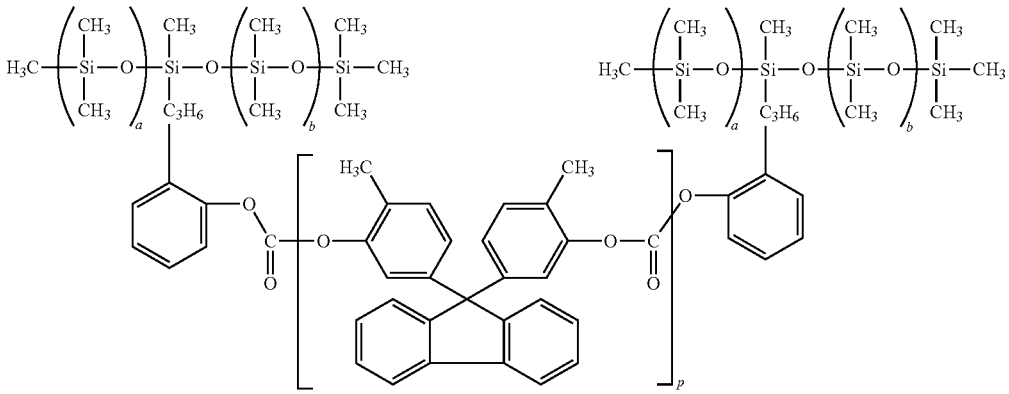
wherein a, b and p are integers representing the number of repeating units,
formula (VIII):
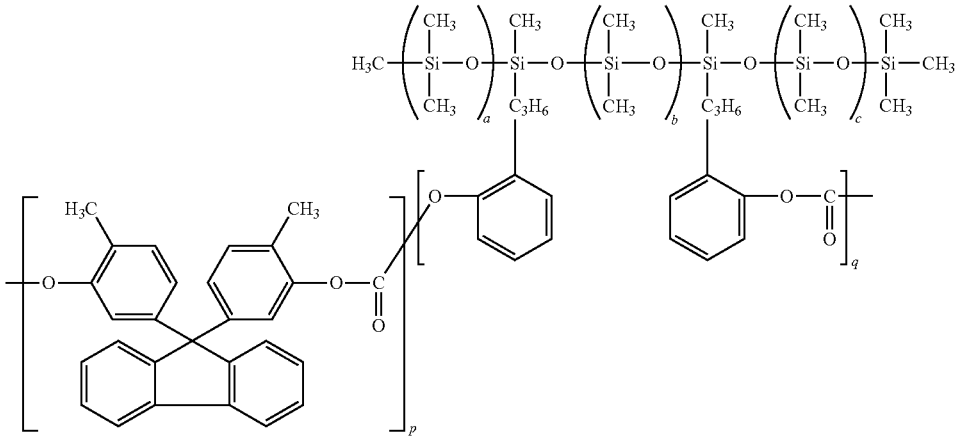
wherein a, b, c, p and q are integers representing the number of repeating units, formula (IX):

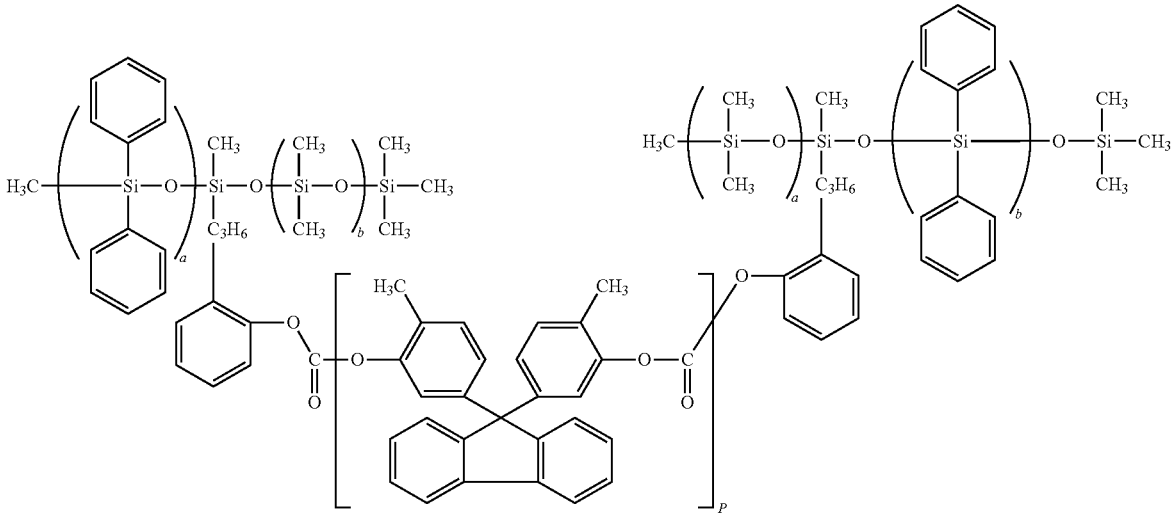

wherein the polymer has an polyalkyl and polyaryl siloxane main chain, and wherein a, b and p are integers representing the number of repeating units, formula (X):

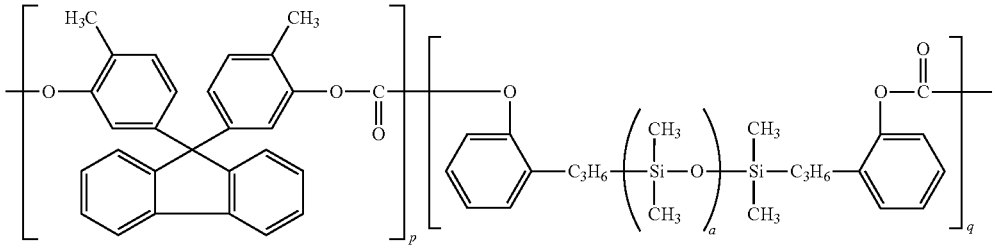

wherein a, p and q are integers representing the number of repeating units, and formula (XI):

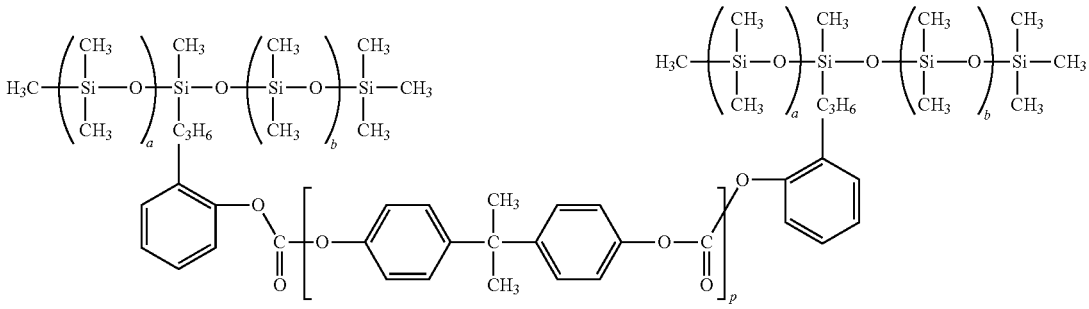

where a, b and p are integers representing the number of repeating units.

19. An electrophotographic imaging member comprising:

a flexible substrate with a conducting layer;

at least one imaging layer positioned on a first side of the substrate;

an anticurl back coating positioned on a second side of the substrate opposite to the at least one imaging layer, wherein the anticurl back coating has an outer exposed layer and an inner layer and the inner layer comprises a bisphenol type polycarbonate having a weight average molecular weight of between about 20,000 and about 200,000 and being selected from the group consisting of a bisphenol A polycarbonate of poly(4,4'-isopropylidene diphenyl) carbonate having the following formula (A):

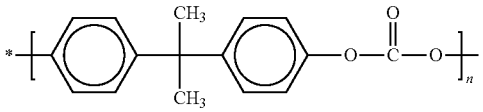

wherein n indicates each respective degree of polymerization, a modified bisphenol A polycarbonate of poly(4,4'-isopropylidene diphenyl) carbonate having the following formula (B):

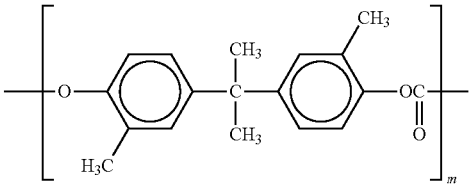

wherein m indicates each respective degree of polymerization, a bisphenol Z polycarbonate of poly(4,4'-diphenyl-1,1'-cyclohexane) carbonate having the following formula (C):

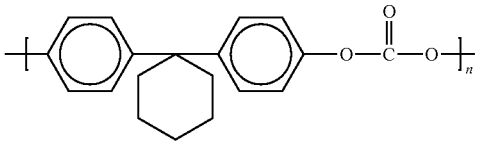

wherein n indicates each respective degree of polymerization, a modified bisphenol Z polycarbonate of poly(4,4'-diphenyl-1,1'-cyclohexane) carbonate having the following formula (D):

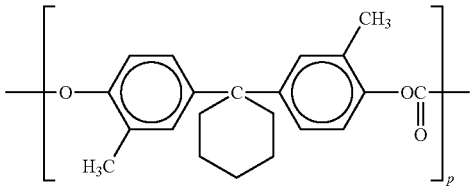

wherein p indicates each respective degree of polymerization, a phthalate-bisphenol A polycarbonate having the following formula (E):

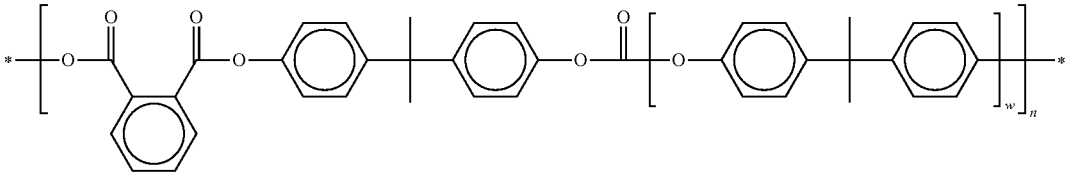

wherein w is an integer from about 1 to about 20 and n is the degree of polymerization, and mixtures thereof, and an adhesion promoter; and the outer exposed layer comprises a low surface energy modified polycarbonate polymer, the polymer being formed and selected from the group consisting of:

(a) a modified Bisphenol A polycarbonate of poly(4,4'-isopropylidene diphenyl carbonate) having a small fraction of polydimethyl siloxane in the polymer back bone and having the following formula (I):

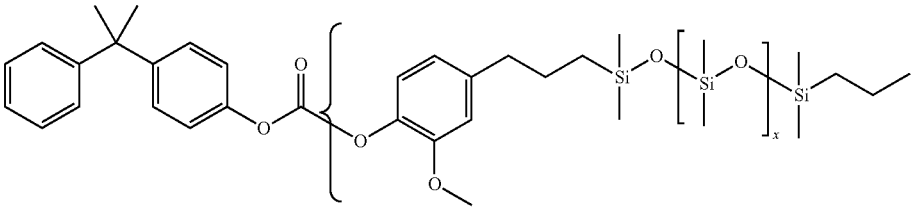

-continued

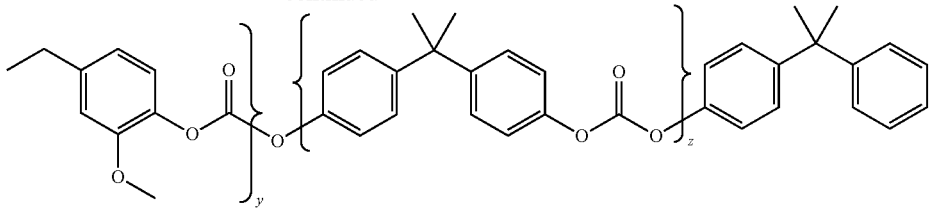

wherein x is an integer between about 40 and about 50 while y and z are integers representing a number of the respective repeating units, (b) a modified Bisphenol Z polycarbonate of poly(4,4'-diphenyl-1,1'-cyclohexane carbonate) having a small fraction of polydimethyl siloxane in the polymer back bone and having the following formula (II):

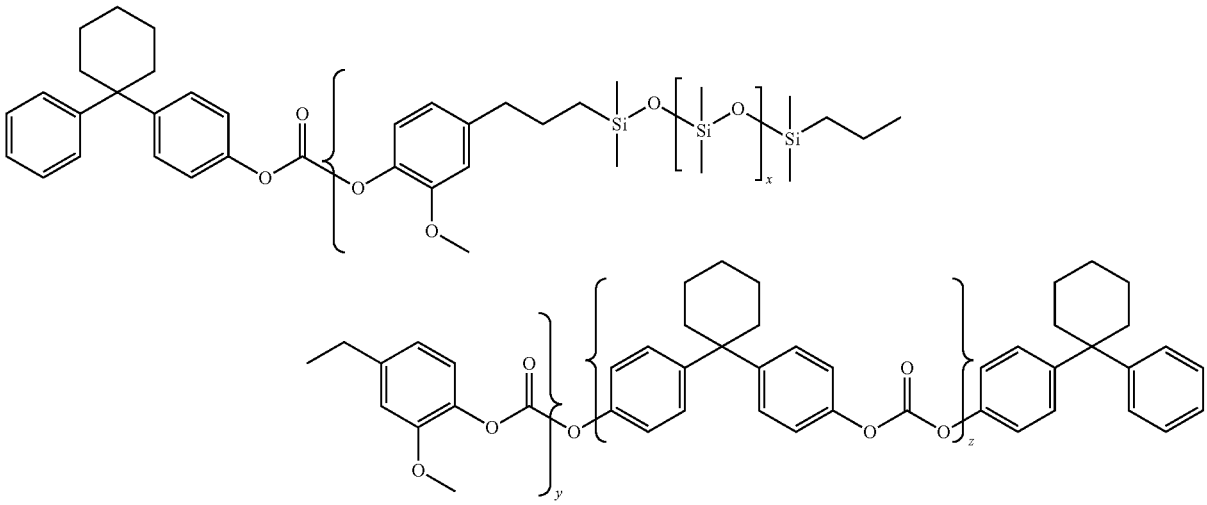

wherein x is an integer between about 40 and about 50 while y and z are integers representing a number of the respective repeating units, (c) a modified Bisphenol C polycarbonate of poly(4,4'-isopropylidene di-(2-methylphenyl)carbonate) having a small fraction of polydimethyl siloxane in the polymer back bone and having the following formula (III):

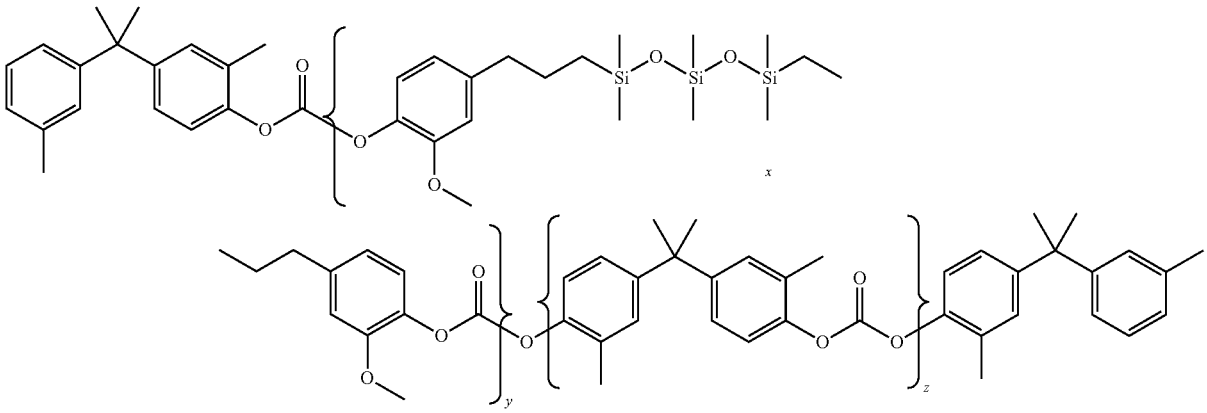

wherein x is an integer between about 40 and about 50 while y and z are integers representing a number of the respective repeating units, (d) a modification of the modified Bisphenol Z polycarbonate of poly(4,4'-diphenyl-1,1'-cyclohexane carbonate) having a small fraction of polydimethyl siloxane in the polymer back bone and having the following formula (IV):

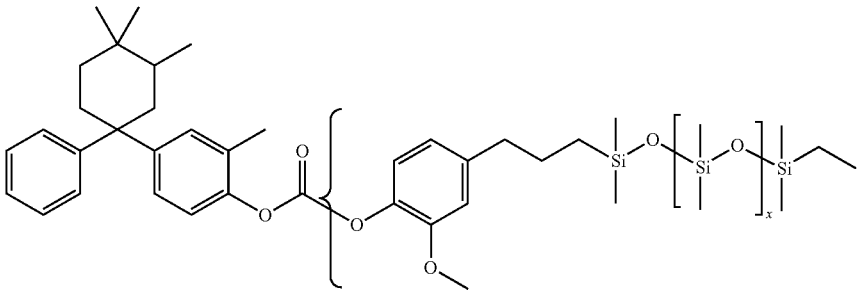

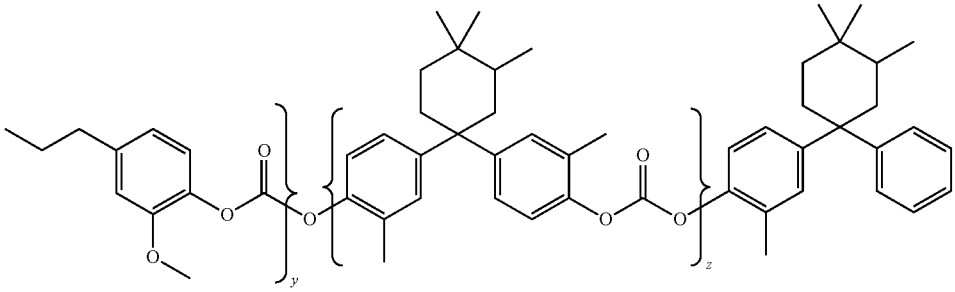

wherein x is an integer between about 40 and about 50 while y and z are integers representing a number of the respective repeating units, and mixtures thereof;

wherein the outer exposed layer further includes an ozone suppression agent selected from the group consisting of:

(a) a diethylene glycol bis(allyl carbonate) having the following formula (1):

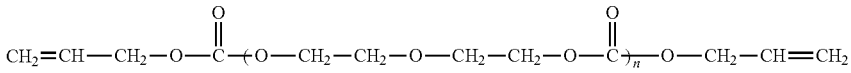

wherein n is an integer from about 1 to about 6, (b) a bis(allyl carbonate) of Bisphenol A having the following formula (2):

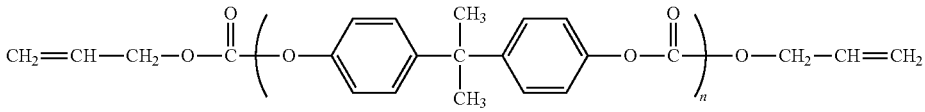

wherein n is an integer from about 1 to about 6, and (c) a polystyrene having the following formula (3):

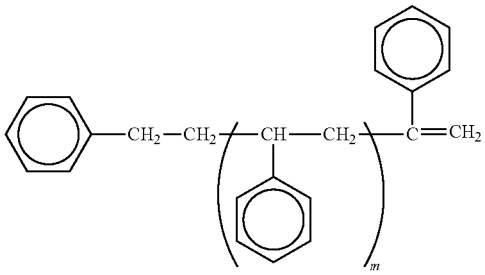

wherein m is the degree of polymerization and m is an integer from about 3 to about 10, a slip agent of a liquid polyester modified polysiloxane having the following formula (4):

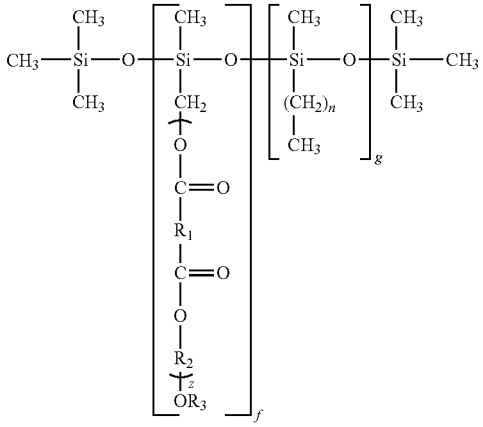

wherein $R_1$ and $R_2$ are independently selected from alkylene groups containing from 1 to 10 carbon atoms; $R_3$ is hydrogen or alkyl having 1 to 3 carbon atoms; n is an integer from 0 to 10; f and g are independently integers from 5 to 500; and z is an integer from 1 to 30, and a polyhedral oligomeric silsesquioxane; and an optional overcoat layer on the at least one imaging layer.

* * * * *